United States Patent [19]

Meckler

[11] Patent Number: 4,959,970

[45] Date of Patent: Oct. 2, 1990

[54] AIR CONDITIONING APPARATUS

[76] Inventor: Gershon Meckler, 1176 Providence Cir., Apt. B, Reston, Va. 22090

[21] Appl. No.: 327,980

[22] PCT Filed: May 12, 1988

[86] PCT No.: PCT/US88/01585

§ 371 Date: Jan. 12, 1989

§ 102(e) Date: Jan. 12, 1989

[87] PCT Pub. No.: WO88/08947

PCT Pub. Date: Nov. 17, 1988

[51] Int. Cl.[5] ..... F25D 17/08

[52] U.S. Cl. ..... 62/176.1; 62/271; 98/38.1

[58] Field of Search ..... 62/93, 94, 176.1, 271; 98/38.1

[56] References Cited

U.S. PATENT DOCUMENTS

| | | | |
|---|---|---|---|
| 2,057,938 | 10/1936 | Crawford | 62/271 X |
| 2,256,940 | 9/1941 | Crawford | 62/94 X |
| 2,290,465 | 7/1942 | Crawford | 62/271 X |
| 3,102,399 | 9/1963 | Meckler | 62/271 |
| 3,247,679 | 4/1966 | Meckler | 62/271 |
| 4,222,244 | 9/1980 | Meckler | 62/271 X |
| 4,448,111 | 5/1984 | Doherty | 98/38.1 |

*Primary Examiner*—William E. Tapolcai

*Attorney, Agent, or Firm*—John C. Purdue; David C. Purdue

[57] ABSTRACT

Air conditioning apparatus is disclosed. The apparatus includes, referring to FIG. 28 of the drawings, a number of air outlets 636, a dehumidifier 630, a constant pressure blower 833 in the dehumidifier 630 a duct 653 for circulating dehumidified air to the outlets 636, dampers 655 for controlling the rate at which dehumidified air circulated to the outlets 636 is delivered to a space to be conditioned, and panels 637 positioned in heat transfer relationship with space to be conditioned by the apparatus. The constant pressure blower controls the rate at which dehumidified air is delivered to the air outlets 636 so that dehumidified air is available at the rate required from time to time by each of the air outlets 636. Each of the air outlets 636 is operable to deliver air circulated thereto to a space to be conditioned. The dehumidifier 630 cools the air it conditions to a temperature sufficiently low that its moisture content and temperature are such that the dehumidified air is incapable, at the rate at which it is required for humidity control, of maintaining the desired space temperature at the maximum design cooling load.

4 Claims, 36 Drawing Sheets

AIR CONDITIONING APPARATUS

BACKGROUND OF THE INVENTION

1. Field of the Invention

This invention relates to air conditioning apparatus and to a method for operating that apparatus. The apparatus is admirably suited for a building which has a sprinkler system, an electrical grid, or both.

2. The Prior Art

Air conditioning apparatus for a building which has a sprinkler system, and which comprises an air handler, a plurality of induction mixing units, air circulating means, means for dehumidifying air circulated through the air handler, heat transfer means for carrying a part of the air conditioning load, cooling means for transferring heat from a heat transfer fluid, and a circulating system which includes a part of the sprinkler system of the building for transferring heat from the heat transfer means to the cooling means is suggested in "Westenhofer and Meckler", U.S. Pat. No. 4,286,667, 1981 (see, also, "Meckler", U.S. Pat. No. 4,033,740, 1977 and "Meckler (2)", U.S. Pat. No. 3,918,525, 1975). Such apparatus has been installed by The Social Security Administration in its Metro West Facility, Baltimore, Maryland, and in the Monroe County Court House, Stroudsburg, Pa. (see *Specifying Engineer*, Jan., 1986).

A variable air volume induction mixing unit in which a flow of primary, conditioned air through venturi nozzles induces a flow of room air to temper, or plenum air to reheat, the primary, conditioned air is suggested in "Meckler (3)", U.S. Pat. No. 3,883,071, 1975.

The use of a cogenerator to produce both shaft work and heat has been suggested, for example by "McGrath", U.S. Pat. No. 2,242,588, 1941; "Miller", U.S. Pat. No. 2,284,914, 1942; "Meckler (4)", U.S. Pat. No. 3,247,679, 1966; "Meckler (5)", U.S. Pat. No. 3,401,530, 1968; and "Meckler (6)", U.S. Pat. No. 4,304,955, 1981.

Both Meckler (4) and Meckler (5) disclose apparatus which includes an internal combustion engine operatively connected to drive the compressor of compression refrigeration apparatus and means for conducting heat from the engine to regenerate a chemical desiccant.

McGrath discloses a "heating system" which includes two compressors, both driven by an internal combustion engine for pumping heat in two stages from ambient air to a building. The internal combustion engine also drives an electric generator and furnishes heat to the refrigerant of the heat pump. Heat is transferred to the refrigerant both from the exhaust gases of the internal combustion engine and from the cooling jacket thereof.

Miller discloses apparatus wherein the shaft of an internal combustion engine drives both an electric generator and the compressor of compression refrigeration apparatus. The apparatus also includes means for transferring exhaust heat from the internal combustion engine to the desiccant of a regenerator of a chemical dehumidifier to provide heat necessary for regeneration of the desiccant.

Meckler (6) discloses apparatus including an electric generator driven by an internal combustion engine and operation of the engine to supplement a solar collector, as required, to provide heat for the regeneration of a chemical desiccant; the electricity generated when the engine is operated provides energy for pumps, blowers and the like of an air conditioning system.

Apparatus which heats a house by pumping heat from low temperature water and produces ice for subsequent cooling is disclosed by "Schutt", U.S. Pat. No. 1,969,187, 1934.

Air conditioning apparatus in which a humidistat controls a humidified air valve is disclosed in British patent No. 1,077,372, 1967, "Ozonair".

BRIEF DESCRIPTION OF THE INVENTION

This invention relates to air conditioning apparatus which is admirably suited for a building having a sprinkler system, an electrical grid, or both.

BRIEF DESCRIPTION OF THE DRAWINGS

FIG. 37 is a schematic diagram showing apparatus which includes two desiccant wheels, one of which serves as an enthalpy exchanger, and a heat exchanger wherein heat from a hot refrigerant is transferred to regeneration air.

FIG. 38 is a schematic diagram showing apparatus which includes two desiccant wheels, one which serves as an enthalpy exchanger, and a heat exchanger wherein heat from the engine of a cogenerator is transferred to regeneration air.

FIG. 39 is a schematic diagram showing apparatus which includes two desiccant wheels, one which serves as an enthalpy exchanger, and a heat exchanger wherein heat from a gas heater is transferred to regeneration air.

FIG. 40 is a schematic diagram showing apparatus which includes two desiccant wheels, one which serves as an enthalpy exchanger, a heat exchanger wherein heat from a hot desiccant is transferred to regeneration air, and heat exchangers wherein heat is transferred from air being conditioned before and after it passes through the second desiccant wheel.

DESCRIPTION OF PREFERRED EMBODIMENTS

Figure 1:
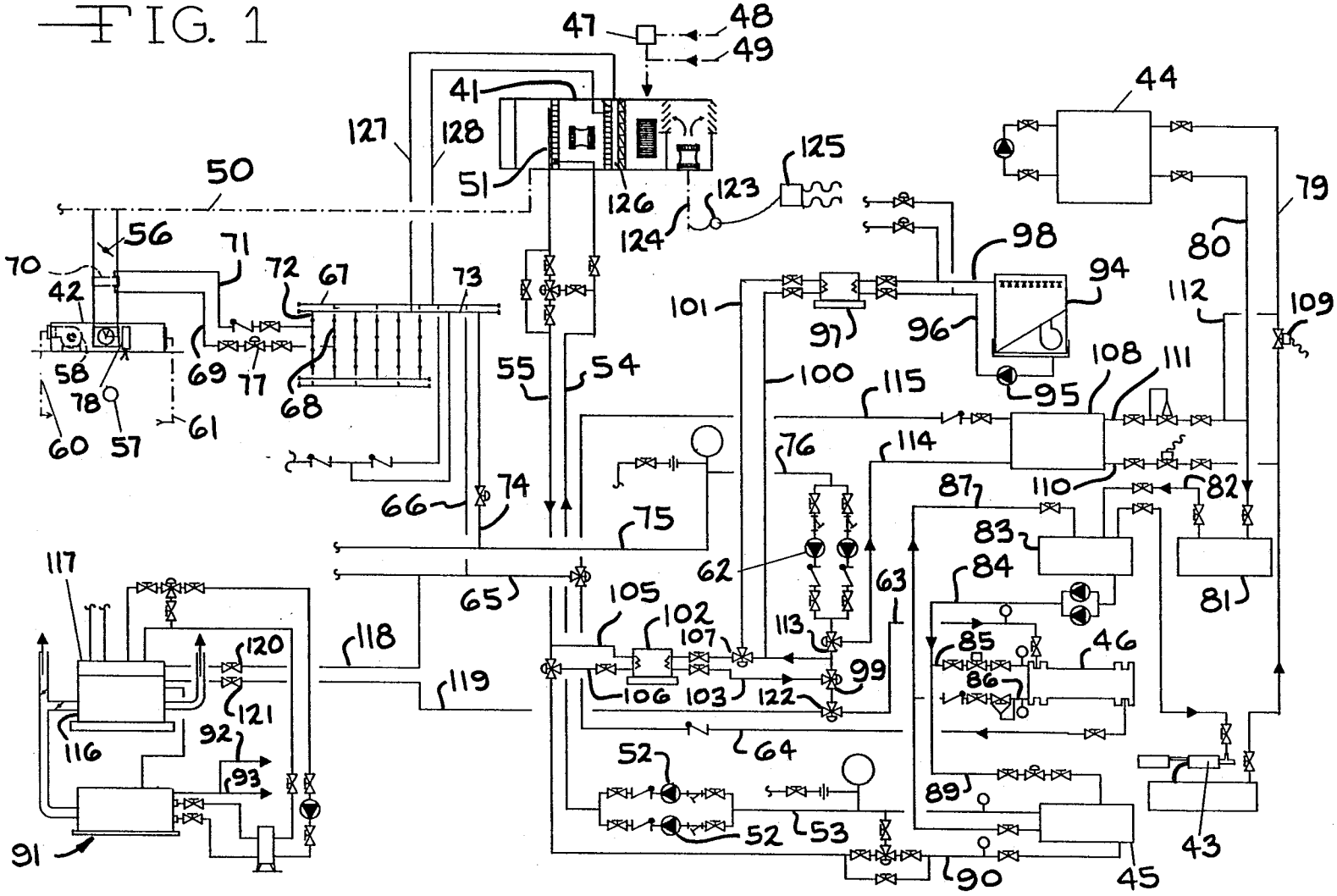
FIG. 1 is schematic diagram showing heating, ventilating and air conditioning apparatus according to the instant invention.

Preferred apparatus according to the invention shown in FIG. 1 comprises an air handler 41, a plurality of induction mixing units 42 (one of which is shown in FIG. 1) and refrigeration apparatus which includes a compressor 43, an evaporative condenser 44, and two different evaporators, one which serves an ice storage tank 45 and one which serves a water chiller 46. The evaporator which serves the ice storage tank 45 operates to produce ice when its operation does not increase the demand charge, for example, on night cycle when the building served by the apparatus is unoccupied, while the evaporator which serves the water chiller 46 operates when it is needed, for example, on day cycle.

Outside air can be directed through or by-passed around an indirect evaporative cooler 47, as indicated by arrows 48 and 49, before it is conditioned in the air handler 41 and distributed through risers (not illustrated) and ducts (one of which is shown in FIG. 1, designated 50) to the building. In the air handler 41, air is conditioned by contact with a coil 51 to a dry bulb temperature of substantially 42° F. (6° C.). Ice water from the ice storage tank 45 at, say, 38° F. (3° C.) is circulated by pumps 52, flowing through a line 53, the pumps 52, a line 54, the coil 51 and a line 55 back to the tank 45. The flow of ice water through the coil 51 is modulated to maintain the 42° F. (6° C.) temperature of the conditioned air leaving the air handler 41. Whenever the ambient air has a low moisture content, it is economically desirable to use the indirect evaporative cooler 47 and, thereby, to reduce the requirement for ice water in the coil 51.

Conditioned air from the duct 50 is delivered to the induction mixing units 42 at a rate which varies, depending upon the settings of individual dampers 56, each of which is actuated by a thermostat controller 57. The induction mixing units 42 are of the "fan" type, having constant speed fans 58, which have a capacity greater than the maximum flow of conditioned air to the induction mixing units 42 when the dampers 56 are in their full open position; as a consequence, air is caused to flow from a space served thereby into each of the induction mixing units, mixing with conditioned air, and returning to the space from the fan discharge mixed with conditioned air. The spaces served by the induction mixing units 42 are below, while the induction mixing units 42 are above, ceilings 59. The air flow described above is indicated in FIG. 1 by an arrow having a head 60 which represents the flow of a mixture of conditioned air and recirculated air from the induction mixing unit 42 and a tail 61 which represents the flow of air from the space into the unit 42.

Pumps 62 cause chilled water to flow through a line 63, the water chiller 46, a line 64, a main header 65, a supply line 66, a header 67 of a first sprinkler grid, one of several sprinkler conduits 68 of the first sprinkler grid, a supply line 69, coils 70 (one of which is shown in FIG. 1), a return line 71, one of several sprinkler conduits 72 of a second sprinkler grid, a header 73 of the second sprinkler grid, a return line 74, a main return 75 and a line 76 back to the pumps 62. The chilled water circulated through the coils 70 is at a comparatively high temperature, sufficiently high that cold conditioned air that flows over the coils 70 is warmed by heat transfer therefrom. In a typical instance, the water in the coils 70 will be at 58° F. (14° C.), and the air will be at 42° F. (6° C.). The capacity of each of the fans 58 is such that, when the air conditioning load is at the maximum design load and the associated damper 56 is in its full open position, a sufficient amount of room air will be induced to flow as indicated by the arrow tail 61 into the induction mixing units 42 to temper the cold primary air sufficiently that the mixture returned to the space does not cause discomfort.

The operation of the induction mixing units 42 is controlled by the thermostat controllers 57. When the air conditioning load is the maximum design load in a space served by a given one of the units 42, that unit operates as just described, with the associated damper 56 in its full open position. As the load on that space decreases below the maximum design load, the damper 56 is modulated (by the thermostat controller 57) so that the rate at which conditioned air is delivered to the induction mixing unit 42 from the duct 50 varies as required to maintain the design temperature as the air conditioning load varies. Ordinarily, it is necessary to maintain some minimum flow of ventilation air into the space being conditioned; as a consequence, the minimum setting for each of the dampers 56 is that setting which provides the minimum ventilation air, usually 0.10 to 0.15 cubic foot per minute per square foot of space served by a given induction mixing unit. When the load is less than that which can be accommodated by air from the duct 50 being delivered to a given space at the minimum rate required for ventilation, a valve 77, under the control of the thermostat controller 57, is opened, and modulated as required to add heat to the air delivered by the induction mixing unit 42 which serves that space. At still lower air conditioning loads, electric heaters 78 (one of which is shown in FIG. 1) can be energized as required to heat the room air flowing through the induction mixing units 42.

The apparatus of FIG. 1 is usually operated to serve a part of a building while the rest of the building is served by apparatus which is identical to that of FIG. 1 except that it includes induction mixing units (not illustrated in FIG. 1) which can be identical to the units 42 except that they additionally include coils positioned for heat transfer with recirculated air before that air is mixed with conditioned air, and means for causing chilled water to flow from the sprinkler grid which includes the sprinkler conduits 68 to those coils and back to the sprinkler grid which includes the sprinkler conduits 72, so that cooling is done, in part, by cold primary air and, in part, by chilled water from the sprinkler grid. The apparatus of FIG. 1 serves the portion of the building where, for whatever reason, the additional cooling that the chilled water from the sprinkler grid is capable of providing is not required, and uses that chilled water to reheat the cold primary air.

As has been stated above, the refrigeration apparatus includes the compressor 43, the evaporative condenser 44, and two different evaporators, one which serves the ice storage tank 45 and one which serves the water chiller 46. On day cycle, the ice storage tank 45 contains a supply of ice sufficient to provide all the chilled water required by the coil 51 until the evaporator which serves the ice storage tank 45 is again operated. Only the evaporator which serves the water chiller 46 is operated, the refrigerant flow being from the compressor 43 through a line 79, the evaporative condenser 44, a line 80, a high pressure receiver 81, a line 82, a low pressure receiver 83, a line 84, a line 85, the water chiller 46, lines 86 and 87, the low pressure receiver 83 and a line 88 to the suction side of the compressor 43. The evaporator which serves the water chiller 46 is controlled to maintain the required chilled water temperature in the coils 70.

The refrigeration apparatus is also operated when the water chiller 46 is idle, but to produce ice. The refrigerant flow is from the compressor 43 through the line 79, the evaporative condenser 44, the line 80, the high pressure receiver 81, the line 82, the low pressure receiver 83, the line 87, a line 89, the ice storage tank 45, a line 90, the line 87, the low pressure receiver 83 and the line 88 to the suction side of the compressor 43. Enough ice is produced while the water chiller 46 is idle to provide all the chilled water required by the coil 51 during the next period of operation of the water chiller 46.

The apparatus of FIG. 1 is highly advantageous from the standpoint of the cost of energy (electricity) required for operation. A "demand" charge, which is a flat monthly fee based upon the maximum rate of energy usage during critical times, is a substantial part of the energy costs for conventional HVAC systems; the demand charge, of course, reflects the high cost of new generating equipment, which makes it highly desirable for a utility, for the country, to keep the maximum rate at which electricity is used as low as possible. The apparatus of FIG. 1 makes ice when there is no demand charge (because the usage of energy by the shopping mall, by the community served by the utility, is low), and then uses that ice during the day to carry a major portion of the peak air conditioning load. While the refrigeration apparatus operates during the time when the electricity it uses contributes to the demand charge, its energy requirements during this time are small by comparison with the total requirements of the HVAC system. Furthermore, the apparatus includes a gas engine-generator 91 which can be operated to generate electricity to be supplied to the electrical grid of the building (not illustrated) as indicated by an arrow 92, to provide emergency power as indicated by an arrow 93, or both. It is highly advantageous to operate the gas engine-generator 91 whenever such operation prevents an increase in "demand".

The apparatus of FIG. 1 also includes a cooling tower 94 and a pump 95 for circulating tower water from the cooling tower 94 through a line 96, through a plate and frame heat exchanger 97, and through a line 98 back to the cooling tower 94. Whenever the ambient humidity is sufficiently low to make it worth while, the tower 94 can be operated, and cooled water can be circulated therefrom to the heat exchanger 97 as just described for heat transfer with heat transfer fluid discharged from the pumps 62 and diverted by a three-way valve 99 to flow through a line 100, the heat exchanger 97, a line 101, a plate and frame heat exchanger 102 and a line 103 before entering the line 63 for flow to the water chiller 46 and to the coils 70 as previously described. If the water from the tower is sufficiently cold, it is not necessary to operate the water chiller; if not, reduced operation is sufficient. The apparatus also includes a three-way valve 104 which can be used to divert heat transfer fluid in the line 55 (returning to the ice storage tank 45 from the coil 51) for flow through a line 105, through the heat exchanger 102 and through a line 106 back to the line 55 for return to the ice storage tank 45. When heat transfer fluid is diverted to flow through the heat exchanger 102, as just described, the valve 99 and a valve 107 can be used to divert the flow of heat transfer fluid discharged by the pumps 62 directly into the heat exchanger 102 for heat transfer to the fluid diverted from the line 55 and flow through the lines 103 and 63 to the water chiller 46. Such operation may be advantageous whenever the ice in the ice storage tank 45 has excess heat absorbing capacity, beyond that required by the coil 51 to provide air at 42° F. (6° C.) for the rest of the day of operation. Heat exchange between the two fluids, as described, reduces the requirement for refrigeration to provide water at 58° F. (14° C.) to serve the coils 70, and may eliminate that requirement altogether if the ice has sufficient excess capacity.

The apparatus of FIG. 1 also includes a heat recovery unit 108 which can be used on night cycle to provide warm heat transfer fluid, as required, for circulation to the coils 70, to coils in induction mixing units (not illustrated in FIG. 1) as described above, or both. This is done by closing a valve 109 at least partially so that warm refrigerant from the compressor 43 flows from the line 79 through a line 110 to the unit 108, leaving the unit 108 through a line 111 and either flowing through a line 112 back into the line 79 or flowing directly into the line 80. In either event, there is warm refrigerant in the unit 108 from which heat can be transferred to the fluid circulated by the pumps 62. This is done by setting a valve 113 to divert heat transfer fluid discharged by the pumps 62 for flow through a line 114 to the unit 108. After heat has been transferred thereto from the refrigerant in the unit 108, the fluid flows through a line 115 to the main 65 and then through whichever ones of the coils 70 or coils in induction mixing units (not illustrated) which serve other portions of the building require heat and back to the pumps 62 as previously described.

The apparatus of FIG. 1 also includes a waste heat recovery unit 116, absorption refrigeration apparatus indicated generally at 117, pipes 118 and 119, and valves 120, 121 and 122. The unit 116 is operably connected to supply heat to energize the apparatus 117. When the gas engine generator 91 is operating and the apparatus of FIG. 1 is being used on summer cycle to air condition a building, the valves 120 and 121 are open and the valves 113, 99 and 122 are set so that heat transfer fluid discharged from the pumps 62 is directed into the line 119, flows through the absorption apparatus 117, and is cooled before flowing through the line 118 to the main header 65 and from thence, as previously described, through the coils 70 and back to the pumps 62. In this mode of operation, there is no need for the compressor 43 to operate, as the chilled water required for the coils 70 and other coils (not illustrated in FIG. 1) is provided by the absorption refrigeration apparatus 117, supplemented, if required, by heat transfer from the heat transfer fluid in the heat exchanger 102 as previously described. Heat from the absorber and condenser (not illustrated) of the apparatus 117 can be transferred to the cooling tower 94.

The apparatus of FIG. 1 also includes a humidistat 123 in a return air duct 124. The humidistat 123 is operably associated with an overriding controller 125 for the dampers 56 which keeps them in the full open position until a signal from the humidistat indicates that the humidity of the air in the duct 124 is sufficiently low that the dampers 56 can be controlled by the thermostat controllers as previously described.

A coil 126 in the air handler 41 is connected by pipes 127 and 128 to receive chilled water from the header 67 of the first sprinkler grid and to return that water to the header 73 of the second sprinkler grid. This enables the shifting of a substantial portion of the load carried by the air handler 41 to be shifted to the chiller 46 or to the absorption apparatus 117.

Figure 2:
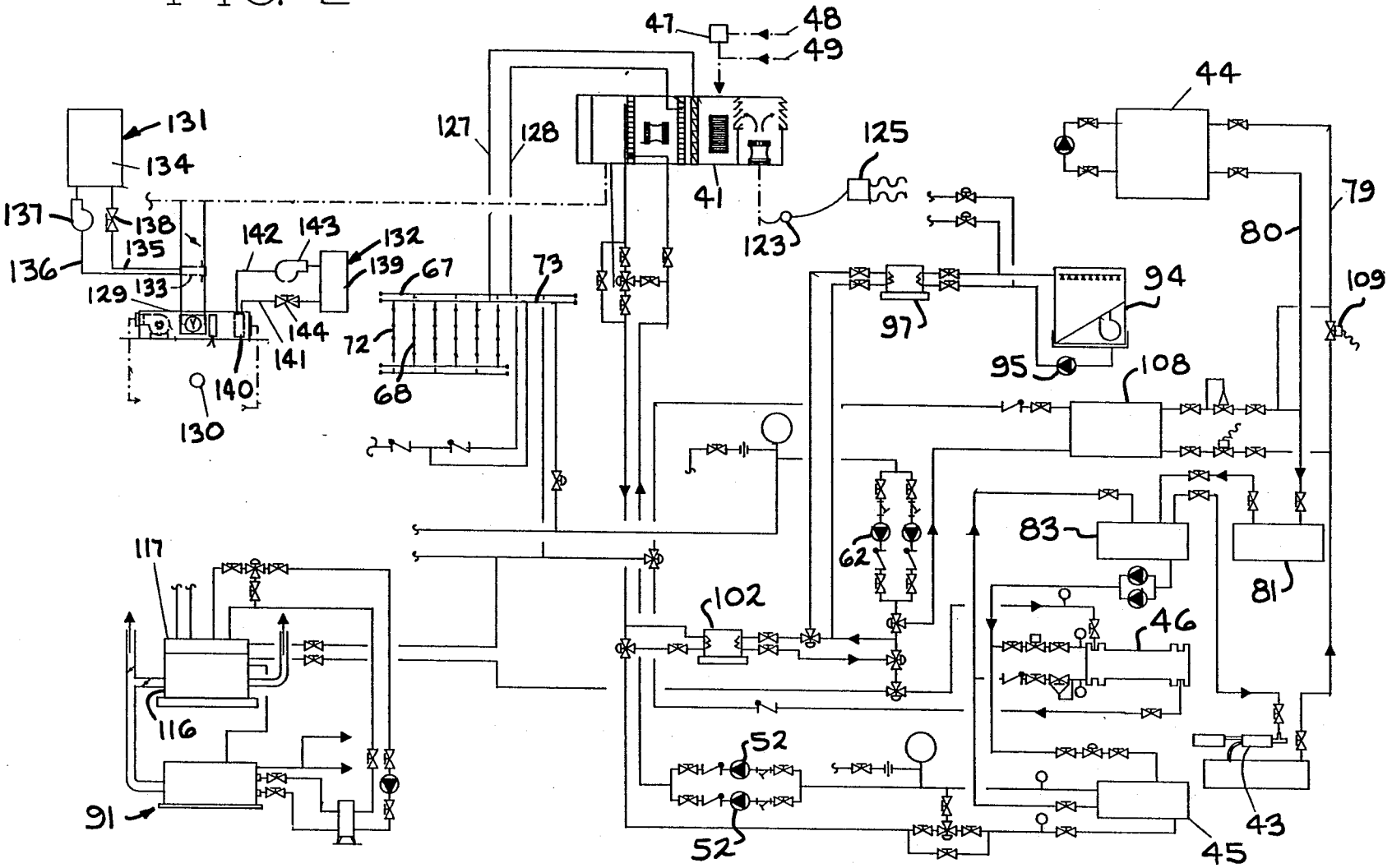
FIG. 2 is a schematic diagram showing apparatus similar to that of FIG. 1, but differing in that a reheat coil of the induction mixing unit has been replaced by a heat pipe and a heat pipe for cooling has been added.

Apparatus which is the same as that of FIG. 1 except that the induction mixing units 42 have been replaced by induction mixing units 129 is shown in FIG. 2. The induction mixing units 129, which are controlled, as is subsequently explained in more detail, by thermostat/-humidistat-controllers 130, have heat pipes indicated generally at 131 and 132. The heat pipe 131 has a condensing section 133, an evaporating section 134, a vapor pipe 135, a liquid return line 136 and a pump 137 in the liquid return line 136. The pump 137 is operable to pump condensate from the condensing section 133 to the evaporating section 134. A valve 138 controls the operation of the heat pipe 131. The heat pipe 132 has a condensing section 139, an evaporating section 140, a vapor pipe 141, a liquid return line 142 and a pump 143 in the liquid return line 142. The pump 143 is operable to pump condensate from the condensing section 139 to the evaporating section 140. A valve 144 controls the operation of the heat pipe 132.

When the induction mixing units 130 are operating, dampers 145 thereof are modulated by the thermostat/-humidistat-controllers 130 as required for humidity control. When cold primary air at the rate of flow required to control humidity is insufficient to counteract heat gains in the space served by one of the units 129, the relevant thermostat/humidistat-controller 130 senses a temperature above the set point and, in response, activates the associated heat pipe 132 by energizing the pump 143 and opening the valve 144 thereof. The liquid of the heat pipe 132 is then pumped into the evaporating section 140, where it is vaporized by heat transferred thereto from air flowing through the induction mixing unit 129 from the space. The vapor which results flows through the vapor pipe to the condensing section 139 where it is condensed by heat transfer therefrom to air in the plenum with which it is in heat transfer relationship. It will be appreciated that the heat pipe 132 must be in a cooled plenum to be capable of transferring heat from recirculated air as just described; chilled water can be circulated through the sprinkler systems of the apparatus of the instant invention cool the plenums in which they are installed to enable the heat pump 132 to operate. When one of the heat pipes 132 is not energized, the associated thermostat/humidistat-controller 130, in response to a sensed temperature below the set point, activates the relevant one of the heat pipes 131 by energizing the pump 137 and opening the valve 138. The liquid of the heat pipe 131 is then pumped into the evaporating section 134, where it is vaporized by heat transferred thereto from air in the plenum. The vapor which results flows through the vapor pipe to the condensing section 133 where it is condensed by heat transfer thereto from cold primary air flowing in heat transfer relationship therewith. The heat pipe 131 is capable of operating either in a cooled plenum or in a plenum that is heated to a temperature several degrees above the space temperature because it is tranferring heat to cold primary air.

Figure 3:
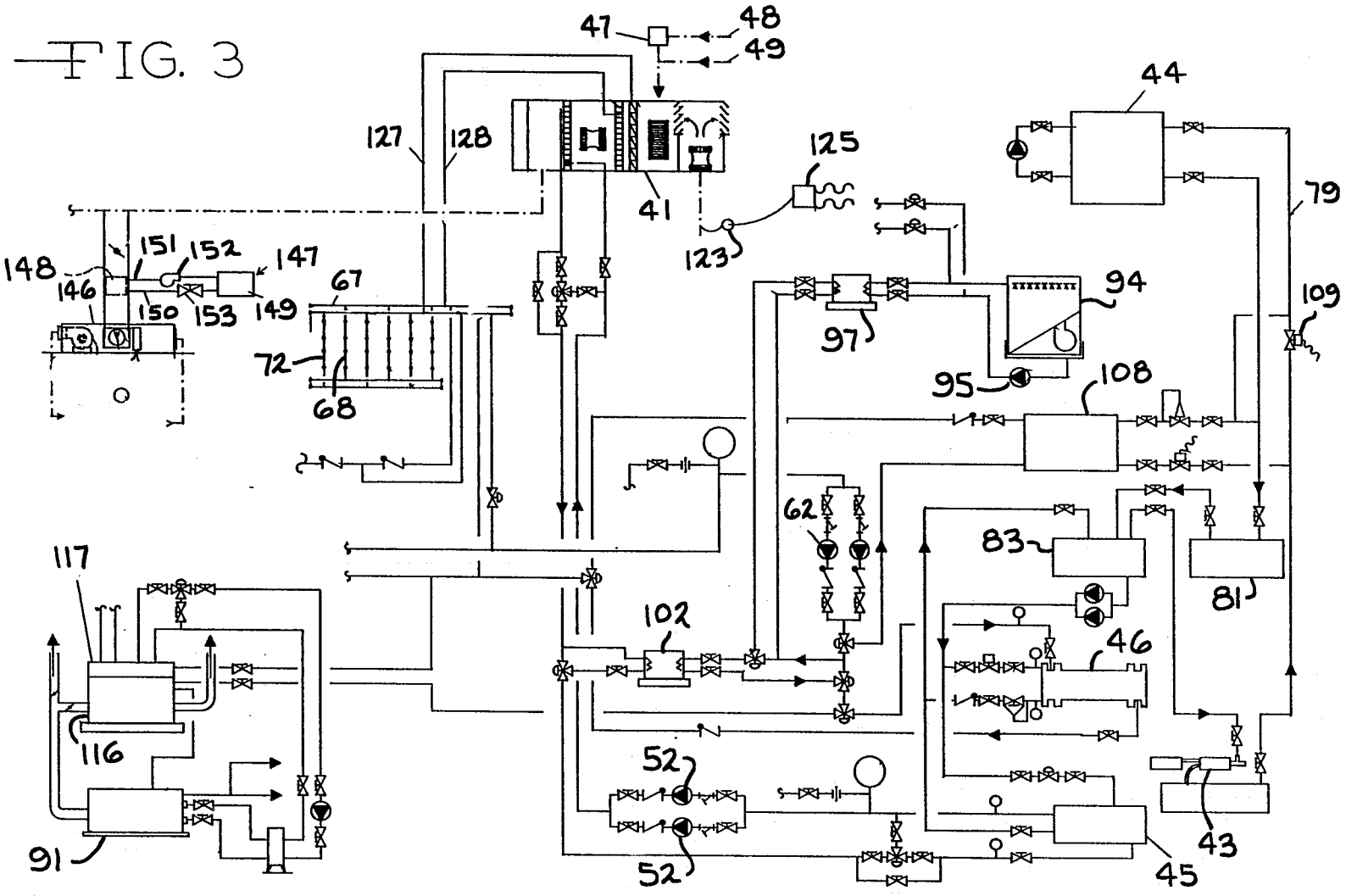
FIG. 3 is a schematic diagram showing apparatus similar to that of FIG. 2, but differing in that one of the heat pipes has been omitted from the induction mixing unit.

The apparatus of FIG. 3 is the same as that of FIG. 2 except that the induction mixing units 129 have been replaced by induction mixing units 146 which have heat pipes indicated generally at 147. The heat pipes 147 have a condensing section 148, an evaporating section 149, a vapor pipe 150, a liquid return line 151 and a pump 152 in the liquid return line 151. The pump 152 is operable to pump condensate from the condensing section 148 to the evaporating section 149. A valve 152 controls the operation of the heat pipe 147.

Figure 4:
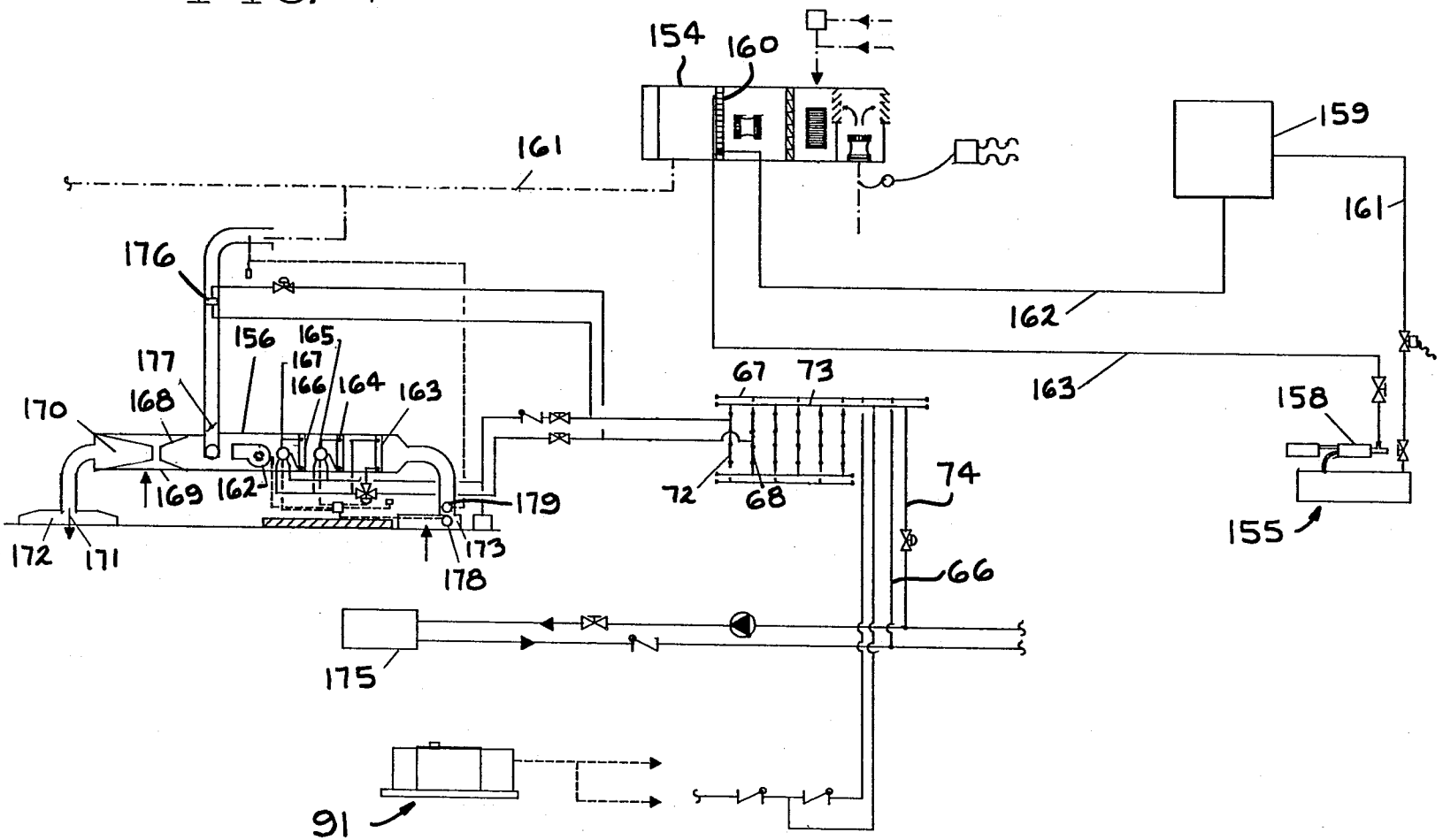
FIG. 4 is a schematic diagram in elevation showing details of an induction mixing unit which can be used in apparatus according to the invention.
Figure 5:
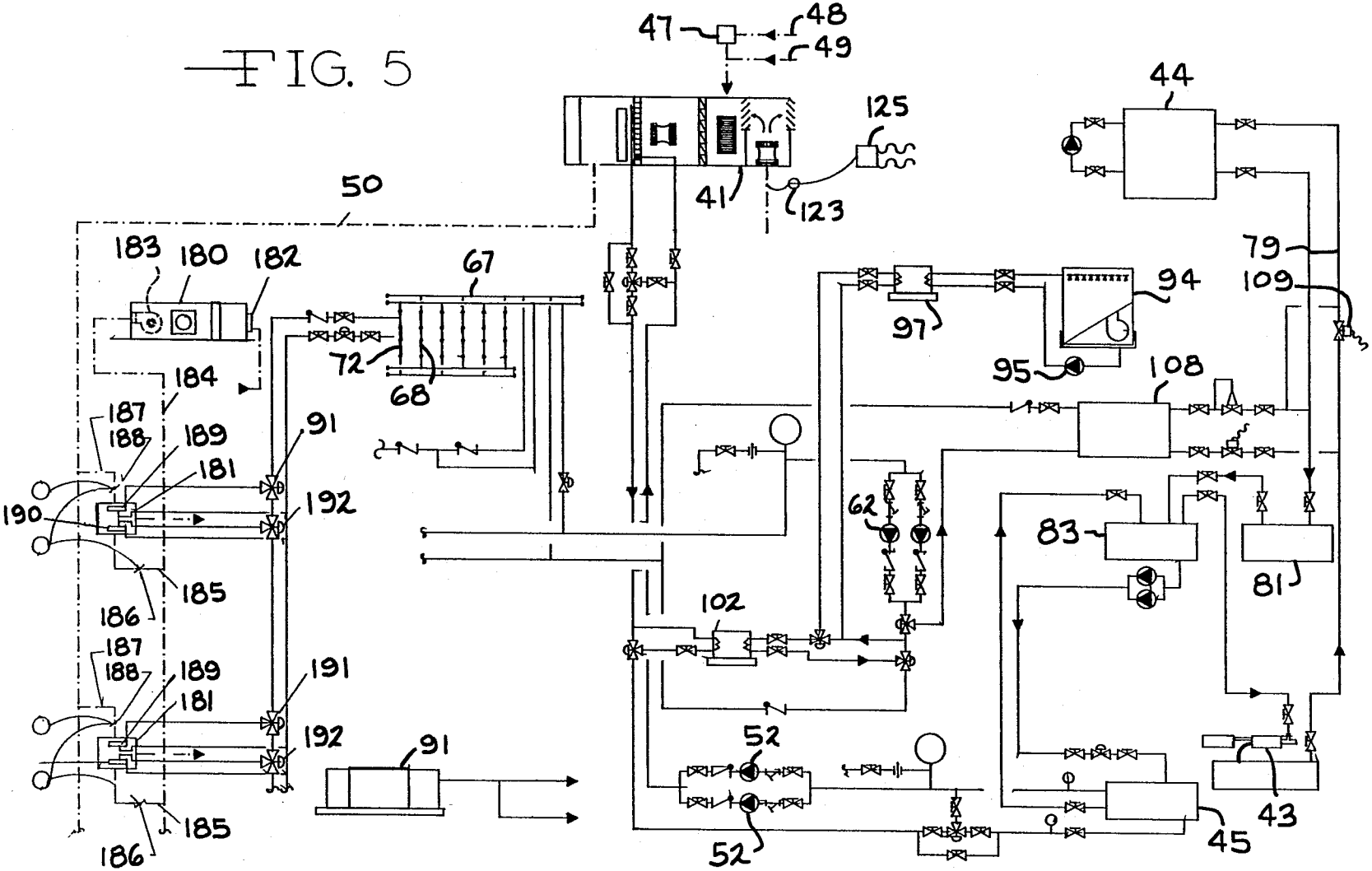
FIG. 5 is a schematic diagram in plan showing further details of the induction mixing unit of FIG. 4.
Figure 6:
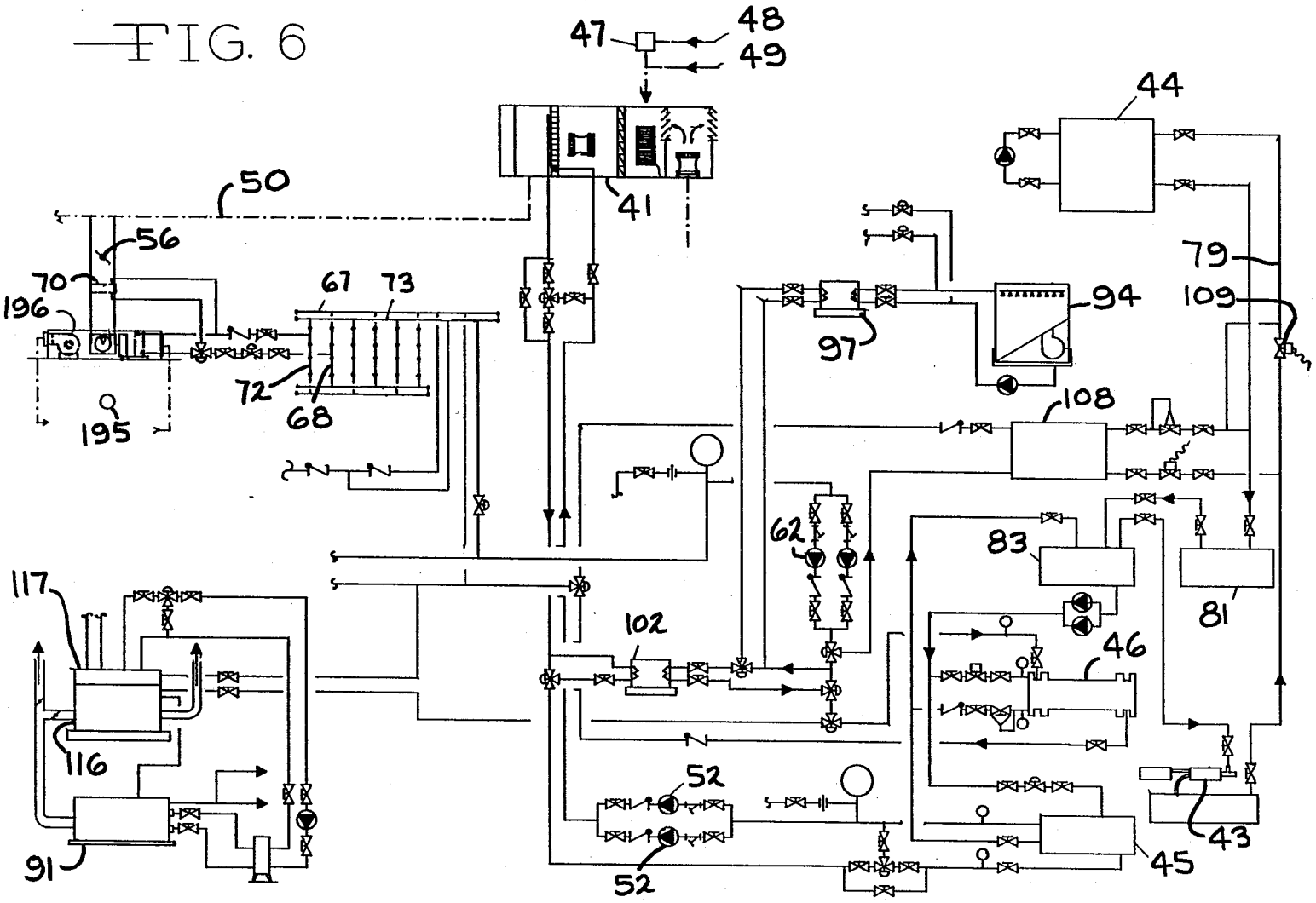
FIG. 6 is a schematic diagram in elevation showing another embodiment of an induction mixing unit similar to that of FIG. 4.

Apparatus shown in FIG. 4 comprises an air handler 154, compression refrigeration apparatus indicated generally at 155, a plurality of induction mixing units 156 (one of which is shown in FIG. 4) and a closed circuit evaporative cooler 157. The refrigeration apparatus comprises a compressor 158, an evaporative condenser 159 and a direct expansion coil 160. Refrigerant flows from the compressor 158 through a line 161 to the evaporative condenser 159, through a line 162 from the evaporative condenser to the direct expansion coil 160, and through a line 163 from the direct expansion coil 160 back to the suction side of the compressor 158. Cold air from the air handler 154 flows through ducts 161 (one of which is shown in FIG. 4) to the induction mixing units 156, which are of the "fan/coil" type, having constant speed fans 162 and coils 163; they are also of the unitary heat pump type, having coils 164 to which heat can be pumped from condensers 165 of first heat pumps and coils 166 from which heat can be pumped to evaporators 167 of second heat pumps; finally, they are of the induction type, having a plurality of induction nozzles 168, one of which is shown in FIG. 4, through which conditioned air from the ducts 161 flows, inducing a flow of recirculated air from the space or from a plenum, as indicated by an arrow, through induced air inlets 169. Air which enters the induction mixing units 156 through the induced air inlets 169 mixes with air discharged from the induction nozzles 168 in mixing portions 170 of the induction mixing units 156, so that it is a mixture of these streams that is delivered to the spaces, as indicated by an arrow 171, from discharge ends 172 of the induction mixing units 156.

The fans 162 of the induction mixing units 156 have a capacity greater than the maximum flow of conditioned air to the induction mixing units 156; as a consequence, when the fans 162 are operating, air is caused to flow through an air inlet 173 from a space served thereby into each of the induction mixing units 156, where it is mixed with conditioned air. The mixture of air from the space and conditioned air flows through the induction nozzles 168, inducing a further flow of recirculated air through the induced air inlets 169; the air delivered to the spaces is a mixture of the air which flows through the nozzles 168 and the air that its flow induces. An arrow 174 indicates the flow of air through the air inlets 174.

Evaporatively cooled heat transfer fluid is delivered to the induction mixing units 156, being circulated thereto as previously described from a closed circuit evaporative cooler 175. This water is supplied to the cooling coils 163, to the condensers 165 or the evaporators 167, as required, so that the required cooling can be done by the coils 163 or by the coils 164 or the required heating can be done by the coils 166. The apparatus also includes a coil 176 positioned for heat transfer with conditioned air before it flows through the nozzles 168. Heat transfer from this coil will often provide all the reheat that is necessary, in which case the coils 163, the evaporators 167 and the associated heat pumps can be omitted. Similarly, chilled water can be circulated to the coils 163 and used as previously described, and will often provide all of the supplemental cooling that is required, beyond that done by the conditioned air from the ducts 161.

The induction mixing unit 156 is admirably suited for task cooling when a damper 177 is controlled by a humidistat-controller 178 to maintain the humidity in a space it serves at a predetermined level while the operation of the fan 162, of the coils 163 and 176 and of the first and second heat pumps if they are present is controlled by a thermostat-controller 179 in cooperation with a signal indicating that the space served is occupied. The signal can be from a motion sensor (not illustrated) or can be one which an occupant of the space served actuates, e.g., by turning on the lights or by turning a separate switch to the on position. When there is no signal indicating that the space is occupied, the fan 162 is not energized and the first and second heat pumps, if they are present, are not energized; as a consequence, the coils 163, 164 and 166 are essentially ineffective to counteract heat gains or losses in the space. The coil 176, however, is operated by the controller 179 as previously described for reheat if the space temperature is below the set point. Whenever there is a signal which indicates that the space served is occupied, the fan 162 is operated and chilled or evaporatively cooled water is made available to the coil 163 and to the condenser 165 and the evaporator 167 if the first and second heat pumps are used.

Figure 9:
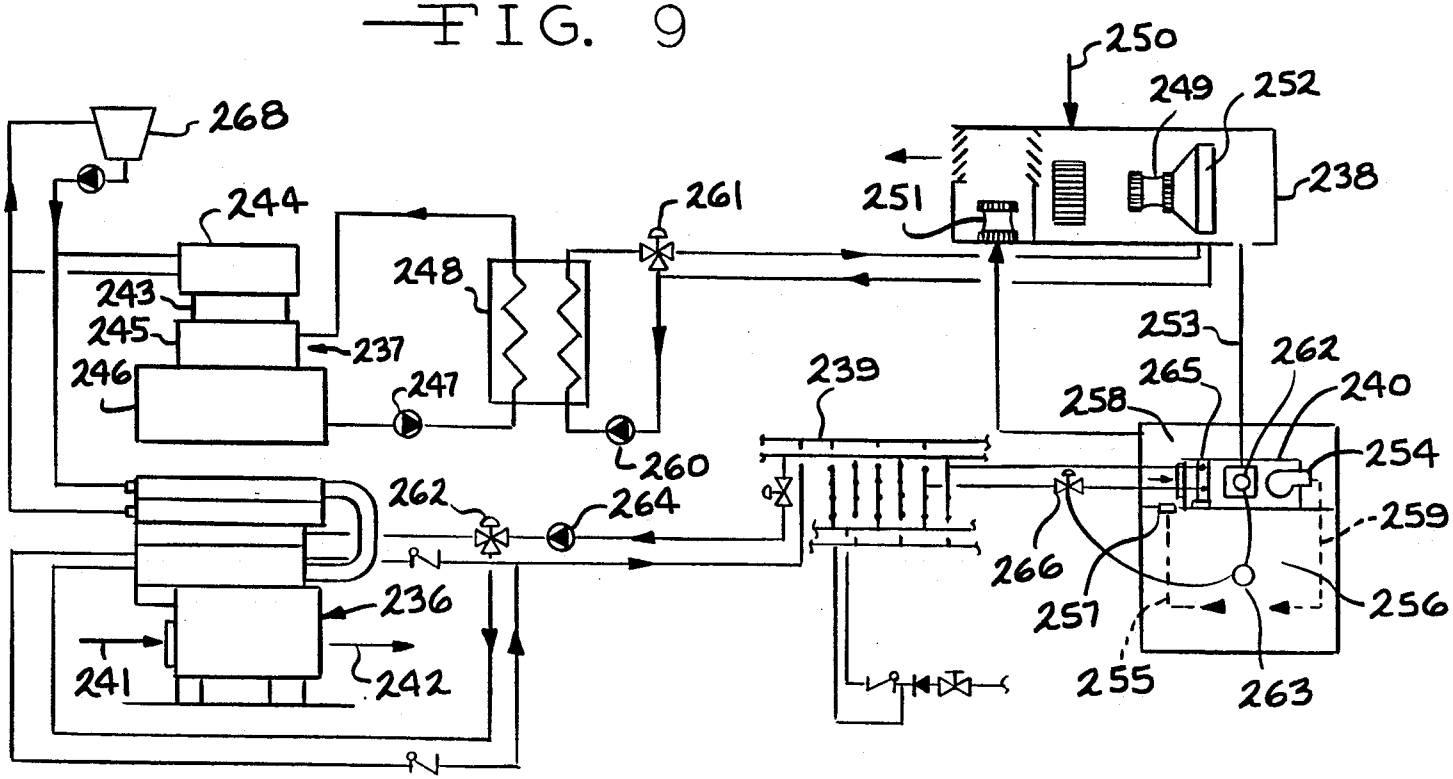
FIG. 9 is a schematic diagram showing apparatus according to the invention which includes mixing boxes of the dual duct type which have cooling and reheat coils.

Apparatus which includes many of the elements of that of FIG. 1 (but not the water chiller 46 and associated apparatus), and which additionally includes an induction unit 180 and mixing boxes 181 is shown in FIG. 9. The induction unit 180 has an inlet 182 for recirculated air and a blower 183 which induces air from the zone served by the induction unit 180 to flow through the inlet 182 and discharges that air into a duct 184 from which it is delivered to the mixing boxes 181, flowing through ducts 185 at a rate which is determined by the settings of dampers 186. Conditioned air from one of the ducts 50 is also delivered to the mixing boxes 181, flowing thereto through ducts 187 at rates which depend upon the settings of dampers 188.

The mixing boxes 181 have coils 189 positioned for heat exchange with cold primary air entering from the ducts 187 and coils 190 positioned for heat exchange with recirculated air from the ducts 185. The flow of heat transfer fluid to the coils 189 and 190 is determined by the positions of valves 191 and of valves 192, respectively.

The dampers 186 and 187 and the valves 191 and 192 are controlled by humidistat controllers 193 and thermostat controllers 194. In operation, the dampers 188 are modulated as required to maintain a set humidity in the space served by each of the mixing boxes 181, and the dampers 186 are modulated in opposition to maintain a substantially constant flow of total air to the space served by each of the mixing boxes 181. When one of the thermostat controllers 194 senses a space temperature above the set point, it opens the associated one of the valves 192 to enable a heat transfer fluid at about 58° F. (14° C.) to flow through the associated coil 190, and modulates that valve as required to maintain the set temperature. Should the space temperature remain above the set point with the associated valve 192 in a full open position, the thermostat controller 194 overrides the associated humidistat controller 193 and modulates the dampers 186 and 189 in opposition to maintain the set temperature; during this time, the valve 192 is kept in its full open position. When one of the thermostat controllers senses a space temperature below the set point, it opens the associated one of the valves 191 and modulates that valve as required to maintain the set temperature. The valve 192 is closed while the associated valve 191 is being modulated for reheat.

The apparatus of FIG. 9 is also admirably suited for task cooling. Whenever there is no signal indicating that the space served is occupied, the damper 186 serving that space is closed, and the associated damper 188 is modulated by the humidistat controller 193 as required for humidity control. If the thermostat controller 194 senses a temperature below the set point, it modulates the valve as required for reheat. As soon as there is a signal indicating that the space is occupied, operation as described above is resumed.

Figure 10:
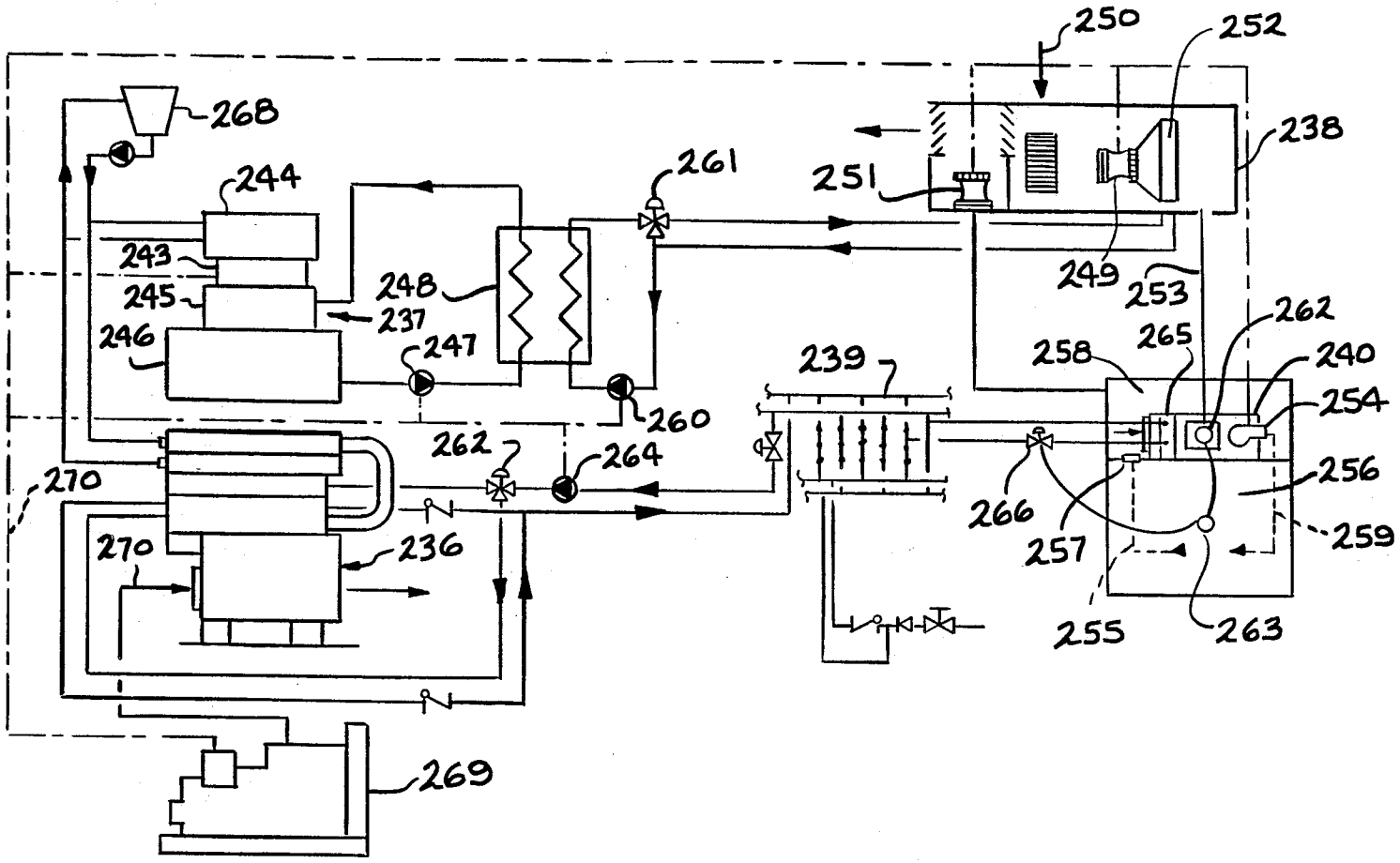
FIG. 10 is a schematic diagram showing apparatus similar to that of FIG. 1 differing in that a humidistat which measures the moisture content of the return air has been omitted and thermostat/humidistat-controllers associated with each of several induction mixing units have been added.

Apparatus which is similar to that of FIG. 1 except that the humidistat 123 and the controller 125 have been omitted, the thermostat controller 57 has been replaced by a humidistat/thermostat controller 195, and the induction mixing unit 42 has been replaced by a unit 196 is shown in FIG. 10. The induction mixing units 196 have all of the features of the units 42, and additionally have coils 197 which are operably connected to receive cooled water from the first sprinkler grid and to return water to the second grid. Each of the humidistat/thermostat controllers 195 modulates the associated damper 56 as required to maintain the humidity of the space it serves within control limits, controls the flow of cooled water to the coil 197 as required to maintain temperature when the amount of conditioned air required for humidity control is too little to overcome heat gains, and controls the flow of cooled water to the coil 70 as required to maintain temperature when the amount of conditioned air required for humidity control more than overcomes heat gains. Because the apparatus of FIG. 10 has no humidistat measuring the overall or average humidity of the building in which the induction mixing units 196 are situated, the option of using a single humidity reading to control the apparatus is not available.

The apparatus of FIG. 10 is admirably suited for use in conjuction with that of FIG. 1, the latter serving zones of a building where there are comparatively large variations in the air conditioning load, and the former serving zones where there are smaller variations in the air conditioning load, or where the humidity load is high.

Figure 11:
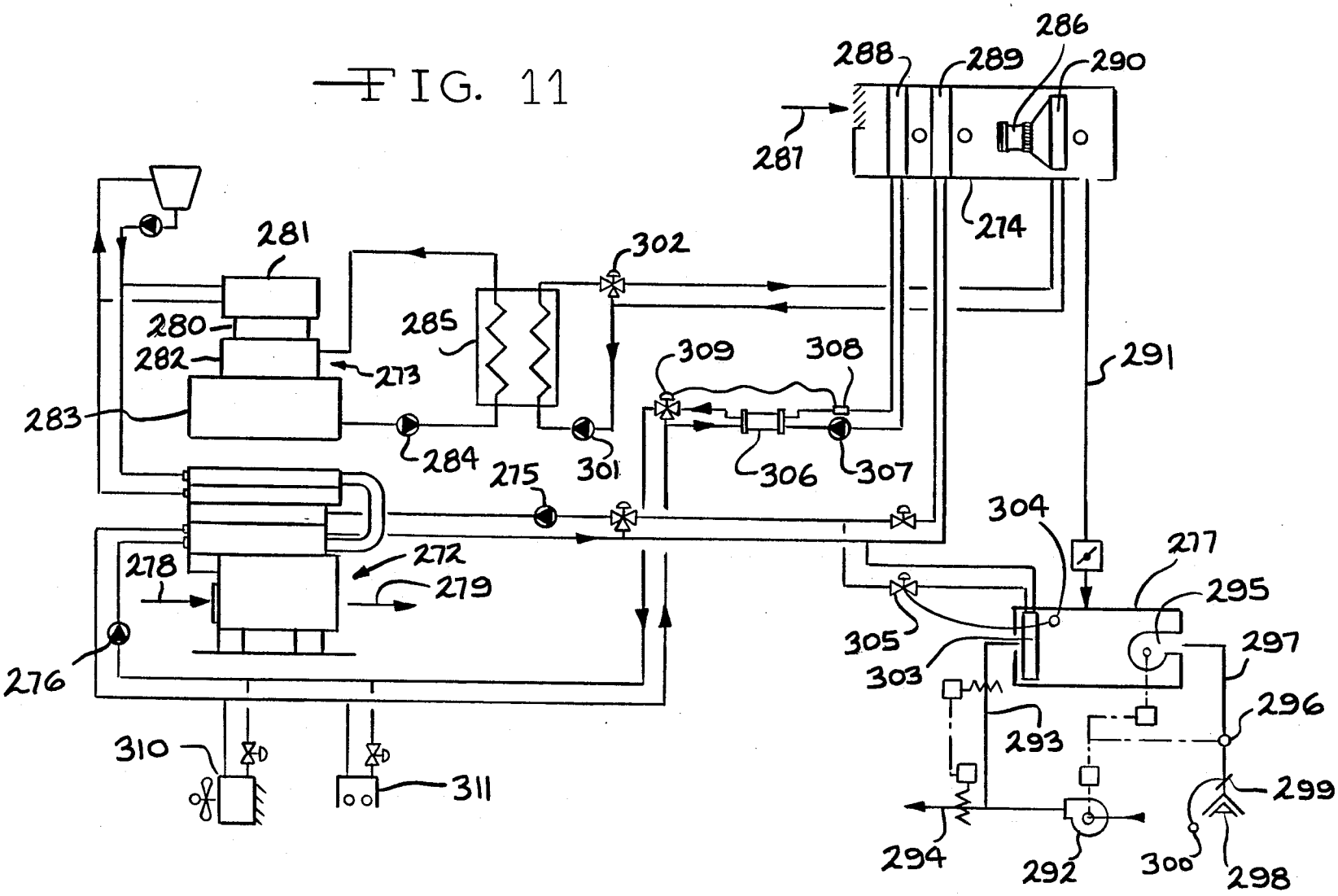
FIG. 11 is a schematic diagram showing apparatus similar to that of FIG. 1, differing in that an induction mixing unit, in the apparatus of FIG. 11, delivers a mixture of primary conditioned air and recirculated air to a plurality of variable air volume diffusers, each of which serves a zone, while, in the apparatus of FIG. 1, that induction mixing unit delivers a mixture of primary conditioned air and recirculated air to a single zone at a constant rate.

Apparatus similar to that of FIG. 10, except that the induction mixing units 196, instead of delivering a mixture of primary conditioned air and recirculated air to a single zone at a constant rate, serve a plurality of variable air volume diffusers 198 is shown in FIG. 11. The diffusers 198 deliver air to the spaces they serve, as indicated by arrows 199, at a rate which depends upon the positions of dampers 200, as set by temperature sensor/controllers 201. Each of the sensor/controllers 201 modulates the one of the dampers 200 associated therewith to maintain a set temperature in the space it serves. The induction mixing units 196 are controlled by sensor/controllers 202:

(1) to maintain a constant pressure in a duct 203, and (2) to maintain an instantaneously set temperature in the duct 203.

When the apparatus is first energized, the dampers 200 are all in their full open positions, and there is no flow of chilled water through coils 204. This mode of operation continues until the humidistat 123 senses a moisture content which indicates that humidity control has been established. The apparatus then enables each of the sensor/controllers 201 to control the associated one of the dampers 200 and the associated one of the valves 77. Initially, each of the dampers is set in its minimum position, i.e., the one which provides the minimum ventilation air or the minimum setting which provides humidity control, depending upon the design of the apparatus, and each of the valves 77 is set in its full open position while a three-way valve 205 directs water from the sprinkler grid through the coil 197 in the induction mixing unit 196 to remove heat from recirculated air; this mode of operation continues until one of the sensor/controllers 201 senses a temperature (1) above its set point with the associated damper 200 in the full open position, or (2) below its set point with the associated damper 200 in its minimum position.

In case (1), the sensor/controller 202 is activated to control the associated one of the dampers 56 to maintain the sensed temperature about 2° F. (1° C.) below that sensed at the time of activation; thereafter, the set point for the sensor controller is lowered whenever there is a reoccurrence of case (1) or raised when there is an occurrence of case (2), until such time as the damper 56 is in its minimum position again. In case (2), the sensor/controller 202 is activated to control the associated one of the valves 77 to maintain the sensed temperature about 2° F. (1° C.) above that sensed at the time of activation; thereafter, the set point for the sensor controller is raised whenever there is a reoccurrence of case (2) or lowered when there is an occurrence of case (1) until such time as the valve 77 is again in its full open position.

The apparatus of FIG. 11 is also capable of doing task cooling. In response to a signal indicating that none of the spaces served by one of the induction mixing units 196 is occupied, for example, when all of the lights in those spaces are de-energized, the associated sensor/controller 202 sets the relevant one of the dampers 56 in its minimum position, de-energizes a fan 207 in the relevant one of the induction mixing units 196 and closes the relevant one of the valves 77. A back-draft damper (not illustrated) prevents the flow of conditioned air to the right in FIG. 11 out of the mixing unit 196 so that the flow is, instead, through the duct 203 and into the spaces served by the diffusers 198. The sensor/controller 202 also has another manual setting in which, in response to the signal indicating that none of the spaces served by one of the induction mixing units 196 is occupied, it closes the relevant one of the valves 77, but does not de-energize the associated fan 207.

Figure 12:
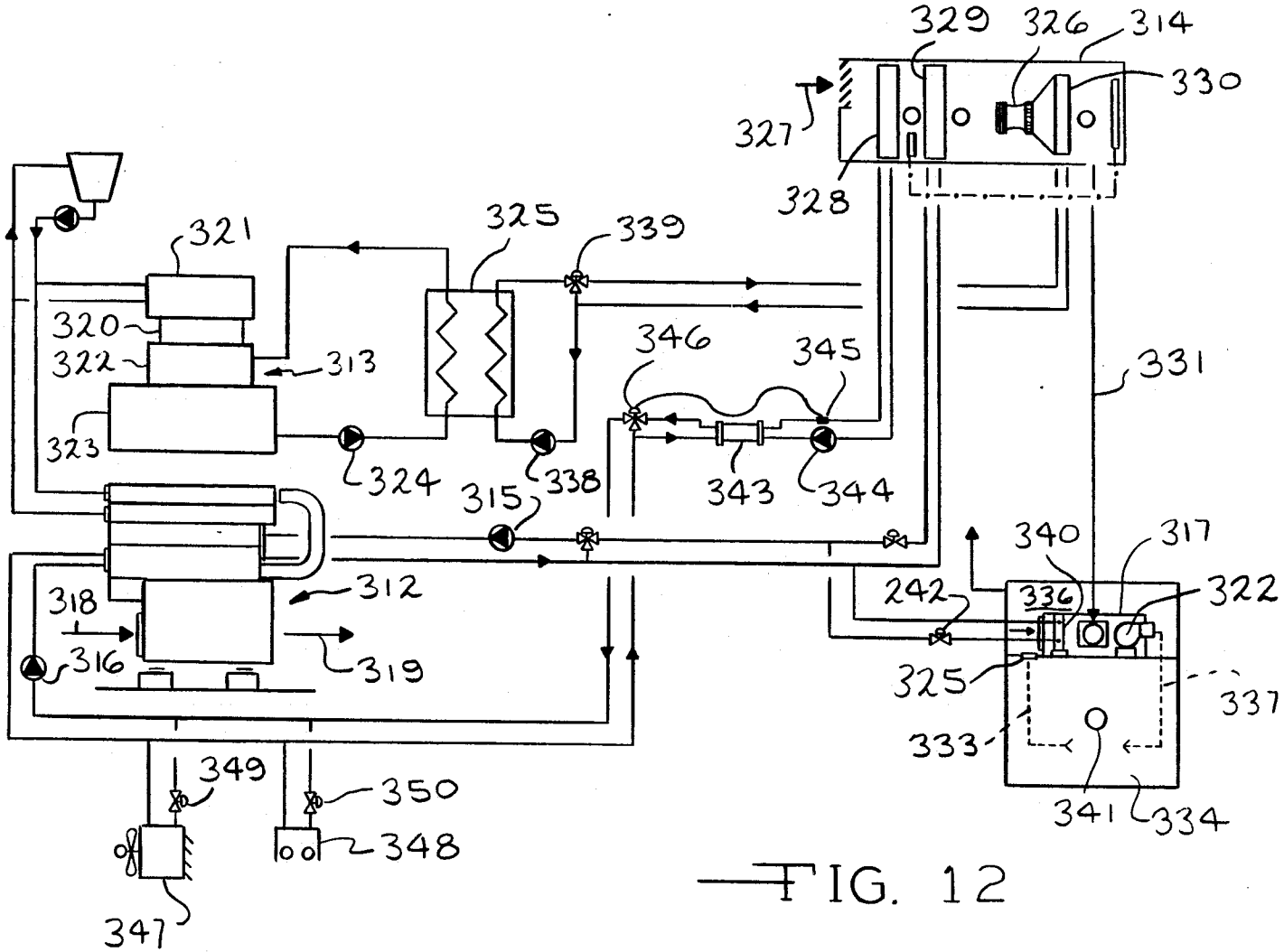
FIG. 12 is a schematic diagram showing apparatus comprising absorption refrigeration apparatus, compression refrigeration apparatus, an air handler, a circulating system which includes a plurality of sprinkler branches, and a plurality of induction mixing units.

Apparatus comprising absorption refrigeration apparatus indicated generally at 208, compression refrigeration apparatus indicated generally at 209, an air handler 210, a circulating system which includes a plurality of sprinkler branches, one of which is designated generally at 211, and a plurality of induction mixing units, one of which is designated generally at 212, is shown in FIG. 12. The absorption refrigeration apparatus 208 is a direct fired unit to which a gas fuel is supplied as indicated by an arrow 213, and from which exhaust gases are discharged as indicated by an arrow 214 and vented to a chimney (not illustrated). The compression refrigeration apparatus 209 comprises a compressor 215, a condenser 216 and a direct expansion coil 217.

In operation, a supply air fan 218 causes a mixture of outside air, as indicated by an arrow 219, and return air from a return fan 220 to flow over a cooling coil 221 and the direct expansion coil 217 and then through a duct 222 to the induction mixing unit 212. A blower 223 causes air to flow, as indicated by a tail 224 of an arrow from a space 225 served by the induction mixing unit 212 through an opening 226 into a plenum 227 and from thence into the induction mixing unit 212 where it is mixed with air from the duct 222; the resulting mixture enters the suction side of the blower 223 and is delivered to the space 225 as indicated by a head 228 of an arrow. A pump 229 circulates chilled water from the absorption apparatus 208 to the coil 221 and back to the absorption apparatus 208; the water can be at a temperature of 48° F. (9° C.) when it leaves the absorption apparatus 208 and at a temperature of 56° F. (13° C.) when it returns, while the compression apparatus 209 can operate to maintain the direct expansion coil 217 at 38° F. (3° C.) so that the mixture of outside air and return air is cooled to 58° F. (14° C.) by the coil 221 and to 42° F. (6° C.) by the direct expansion coil 217. Air at 42° F. (6° C.), then, is delivered to the induction mixing unit 212 at a rate which is determined by a damper 230 under the control of a thermostat/controller 231. The damper 230 is modulated, as required for temperature control, by the thermostat/controller 231 between a position that provides the minimum ventilation air and a full open position. Whenever the minimum ventilation air cools the space 225 excessively, the thermostat/controller 231 modulates a valve 232 so that warm water circulated by a pump 233 from the absorption apparatus 208 through the sprinkler branch 211, a coil 234 and the sprinkler branch 211 back to the absorption apparatus 208 heats air entering the induction mixing unit 212 from the plenum 227 to the extent required to maintain a desired temperature.

Heat is rejected, as required, from the absorption apparatus 208 and from the condenser 216 of the compression apparatus 209 to a cooling tower 235.

Figure 8:
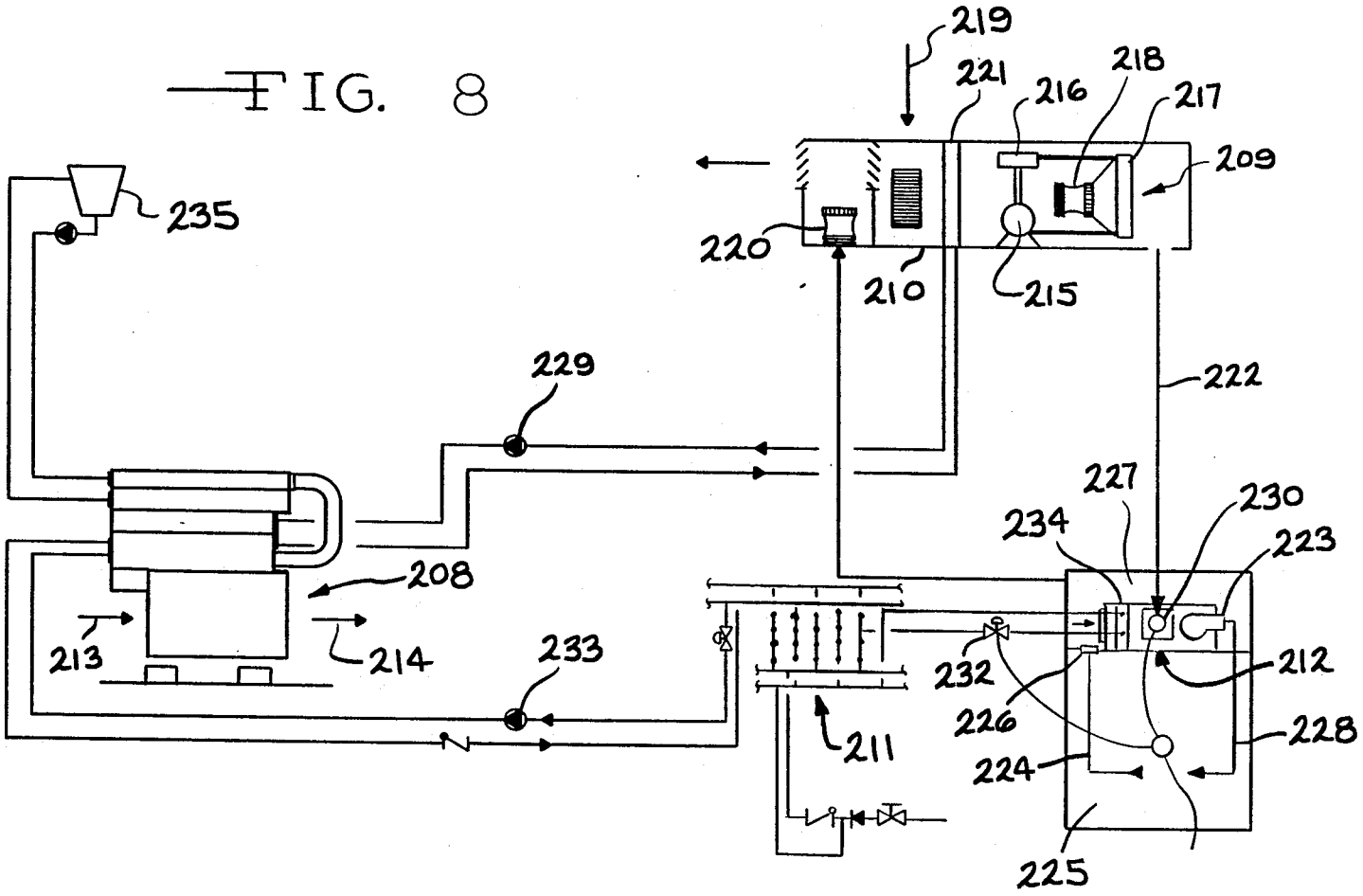
FIG. 8 is a schematic diagram showing apparatus according to the instant invention which includes a new induction mixing unit.

It will be appreciated that the compressor 215 of the apparatus of FIG. 8 operates during times of peak usage of electricity when a demand charge is imposed. However, its operation can be constant, because the absorption apparatus 208 can be operated to account for all variations in load, producing, for example, air at 50° F. (10° C.) saturated with water vapor whatever the entering conditions of the air to the coil 221. This minimizes the demand component of the total cost of electricity per kilowatt hour.

Apparatus comprising absorption refrigeration apparatus indicated generally at 236, compression refrigeration apparatus indicated generally at 237, an air handler 238, a circulating system which includes a plurality of sprinkler branches, one of which is designated generally at 239, and a plurality of induction mixing units, one of which is designated generally at 240, is shown in FIG. 9. The absorption refrigeration apparatus 236 is a direct fired unit to which a gas fuel is supplied as indicated by an arrow 241, and from which exhaust gases are discharged as indicated by an arrow 242 and vented to a chimney (not illustrated). The compression refrigeration apparatus 237 comprises a compressor 243, a condenser 244 and an evaporator 245 which is operably associated with an ice water storage tank 246. Water is circulated from the storage tank 246 by a pump 247, flowing through a heat exchanger 248, to the evaporator 245 and returning from the evaporator 245 to the tank 246. The apparatus 237 can be operated while water is circulated as described, either to produce ice or merely to remove sensible heat from the water before it is returned to the tank 246, or the apparatus 237 can be idle, in which case the heated water is merely returned to the tank 246.

In operation, a supply air fan 249 causes a mixture of outside air, as indicated by an arrow 250, and return air from a return fan 251 to flow over a cooling coil 252, and then through a duct 253 to the induction mixing unit 240. A blower 254 causes air to flow, as indicated by a tail 255 of an arrow from a space 256 served by the unit 240 through an opening 257 into a plenum 258 and from thence into the unit 240 where it is mixed with air from the duct 253; the resulting mixture enters the suction side of the blower 254 and is delivered to the space 256 as indicated by a head 259 of an arrow. A pump 260 circulates chilled water from the heat exchanger 248 to the coil 252 and back to the heat exchanger 248, while the pump 247 circulates water from the tank 246 to the heat exchanger 248 and, as previously described, back to the tank 246. A valve 261 is modulated to maintain the water delivered to the coil 252 at a temperature of 36° F. (2° C.) so that the mixture of outside air and return air is cooled to 40° F. (4° C.) by the coil 252, and is delivered to the unit 240 at a rate which is determined by a damper 262 under the control of a thermostat-humidistat/controller 263. The damper 262 is modulated, as required for humidity control, by the humidistat-thermostat/controller 263 between a position that provides the minimum ventilation air and a full open position.

Whenever the thermostat-humidistat/controller 263 senses a suitable humidity, chilled water from the absorption apparatus 236 is circulated by a pump 264 from the absorption apparatus 236 through the sprinkler branch 239 to a coil 265 in the induction mixing unit 240 and from thence through the sprinkler branch 239 and back to the absorption apparatus 236. The controller 263 opens and closes a valve 266 so that the chilled water which flows through the coil 265 maintains the temperature of the space 256 within control limits. When the valve 266 is in its full open position and the temperature is still above the control temperature, the controller 263 opens the damper 262 so that there is a flow of air from the duct 253 in excess of that required for humidity control to control space temperature.

The apparatus also includes a valve 267 which can be set so that the pump 264 circulates warm water from the absorption apparatus 236 through the sprinkler branch 239, the coil 265 and the sprinkler branch 239 back to the absorption apparatus 236 to heat air entering the induction mixing unit 240 from the plenum 258.

Heat is rejected, as required, from the absorption apparatus 236 to a cooling tower 268 and in any suitable way (not illustrated) from the compression apparatus 237.

The compressor 243 of the apparatus of FIG. 9 can operate only during off-peak times when the usage of electricity does not contribute to a demand charge, or it can operate substantially 24 hours per day. The operation can be constant whenever it contributes to a demand charge because the rate at which ice is melted can change as required when there are variations in the load on the coil 252. The apparatus must be larger if the compressor 243 operates only during off peak times so which mode of operation is optimum depends upon whether the demand component or the increased equipment component of the total cost of electricity per kilowatt hour is greater.

Apparatus shown in FIG. 10 is identical to that of FIG. 9 and, in addition, includes a cogenerator 269. Exhaust heat from the cogenerator 269, as indicated by an arrow 270, energizes the absorption apparatus 236, while, as indicated by a line 271, electricity from the cogenerator 269 energizes the compressor 243, the blowers 249, 251 and 254, and the pumps 247, 260 and 264. The operation of the apparatus of FIG. 10 is identical to the operation of the apparatus of FIG. 9, as described above, but it does not contribute to a demand charge.

Apparatus comprising absorption refrigeration apparatus indicated generally at 272, compression refrigeration apparatus indicated generally at 273, an air handler 274, a circulating system which includes a pump 275, a circulating system which includes a pump 276, and a plurality of induction mixing units, one of which is designated generally at 277, is shown in FIG. 11. The absorption refrigeration apparatus 272 is a direct fired unit to which a gas fuel is supplied as indicated by an arrow 278, and from which exhaust gases are discharged as indicated by an arrow 279 and vented to a chimney (not illustrated). The compression refrigeration apparatus 273 comprises a compressor 280, a condenser 281 and an evaporator 282 which is operably associated with an ice water storage tank 283. Water is circulated from the storage tank 283 by a pump 284, flowing through a heat exchanger 285, to the evaporator 282 and returning from the evaporator 282 to the tank 283. The apparatus 273 can be operated while water is circulated as described, either to produce ice or merely to remove sensible heat from the water before it is returned to the tank 283, or the apparatus can be idle, in which case the water is merely returned to the tank 283 at the temperature to which it is warmed in the heat exchanger 285.

In operation, a supply air fan 286 causes outside air, as indicated by an arrow 287, to flow into the air handler 274, over a heating coil 288, over a pre-cooling coil 289, over a cooling coil 290 and then through a duct 291 to an induction mixing unit 277. A relief air blower 292 withdraws air from the space served by the induction mixing unit 277, returning a part of the withdrawn air through a duct 293 to the induction mixing unit 277, and venting the rest as relief air through a duct 294. A blower 295 discharges from the induction mixing unit 277 a mixture of return air from the duct 293 and conditioned air from the duct 291. The blower 295 is controlled to maintain constant the static pressure measured by a sensor 296 in a duct 297, while the blower 292 is controlled to deliver air at the same rate as the blower 295, air being vented through the duct 294 at the same rate that conditioned air enters the induction mixing unit 297. Air from the duct 297 is delivered to a plurality of diffusers 298 and from thence to the spaces they serve. The rate at which air is delivered by each of the diffusers 298 is determined by the position of a damper 299, each of which is controlled by a thermostat controller 300 to maintain a predetermined space temperature.

The pump 275 circulates water at a temperature of about 48° F. (9° C.) from the absorption refrigeration apparatus 272 to the pre-cooling coil 289 and back to the apparatus 272. A pump 301 circulates chilled water from the heat exchanger 285 to the coil 290 and back to the heat exchanger 285, while the pump 284 circulates water from the compression refrigeration apparatus 273 to the heat exchanger 285 and back to the compression refrigeration apparatus 273. A valve 302 is modulated to maintain the water delivered to the coil 290 at a temperature of 36° F. (2° C.) so that the outside air is cooled in the air handler 274, first to 60° F. (16° C.) by the coil 289 and then to 40° F. (4° C.) by the coil 290. This air is delivered to the duct 291 and the induction mixing unit 277 at a constant rate which is at least sufficient to provide the minimum ventilation air and humidity control.

The pump 275 also circulates water from the absorption apparatus 272 to a cooling coil 303 in the induction mixing unit 277. A temperature sensor/controller 304 controls a valve 305 to maintain a predetermined temperature on the downstream side of the coil 303. This temperature can be raised or lowered to accommodate variations in the air conditioning load on the spaces served by the diffusers 298.

The pump 276 of the apparatus of FIG. 11, when heating is required, circulates heated water from the absorption refrigeration apparatus 272 to a heat exchanger 306 and back to the apparatus 272, while a pump 307 circulates another stream of water from the heat exchanger 306 to the pre-heat coil 288 and back to the heat exchanger 306. The temperature of the coil 288 is determined by a temperature sensor/controller 308, which modulates a valve 309 to maintain the temperature it senses within control limits. Plenum unit heaters 310 and baseboard heaters 311 are also operably connected to the circulating system served by the pump 276 for use, as required, to introduce heat into a plenum above the spaces served or into the spaces themselves. The apparatus also includes valves in the circulating system served by the pump 276 and the valves serve to control the flow of heated water to the plenum heaters 310 and to the baseboard heaters 311.

Apparatus comprising absorption refrigeration apparatus indicated generally at 312, compression refrigeration apparatus indicated generally at 313, an air handler 314, a circulating system which includes a pump 315, a circulating system which includes a pump 316, and a plurality of induction mixing units, one of which is designated generally at 317, is shown in FIG. 12. The absorption refrigeration apparatus 312 is a direct fired unit to which a gas fuel is supplied as indicated by an arrow 318, and from which exhaust gases are discharged as indicated by an arrow 319 and vented to a chimney (not illustrated). The compression refrigeration apparatus 313 comprises a compressor 320, a condenser 321 and an evaporator 322 which is operably associated with an ice water storage tank 323. Water is circulated from the storage tank 323 by a pump 324, flowing through a heat exchanger 325, to the evaporator 322 and returning from the evaporator 322 to the tank 323. The apparatus 313 can be operated while water is circulated as described, either to produce ice or merely to remove sensible heat from the water before it is returned to the tank 323, or the apparatus 313 can be idle, in which case the water is merely returned to the tank 323 at the temperature to which it is warmed in the heat exchanger 325.

In operation, a supply air fan 326 causes outside air, as indicated by an arrow 327, to flow into the air handler 314, over a heating coil 328, over a pre-cooling coil 329, over a cooling coil 330 and then through a duct 331 to an induction mixing unit 317. A blower 332 causes air to flow, as indicated by a tail 333 of an arrow from a space 334 served by the induction mixing unit 317 through an opening 335 into a plenum 336 and from thence into the induction mixing unit 317 where it is mixed with air from the duct 331; the resulting mixture enters the suction side of the blower 332 and is delivered to the space 334 as indicated by a head 337 of an arrow.

The pump 315 circulates water at a temperature of about 48° F. (9° C.) from the absorption refrigeration apparatus 312 to the pre-cooling coil 329 and back to the apparatus 312. A pump 338 circulates chilled water from the heat exchanger 325 to the coil 330 and back to the heat exchanger 325, while the pump 324 circulates water from the compression refrigeration apparatus 313 to the heat exchanger 325 and back to the compression refrigeration apparatus 313. A valve 339 is modulated to maintain the water delivered to the coil 330 at a temperature of 36° F. (2° C.) so that the outside air is cooled in the air handler 314, first to 60° F. (16° C.) by the coil 329 and then to 40° F. (4° C.) by the coil 330. This air is delivered to the duct 331 and the induction mixing unit 317 at a constant rate which is at least sufficient to provide the minimum ventilation air and humidity control.

The pump 315 also circulates water from the absorption apparatus 312 to a cooling coil 340 in the induction mixing unit 317. A humidity-temperature sensor/controller 1055 controls a valve 342, keeping it closed until it senses a humidity at which water from the absorption apparatus 312 in the coil 340 will not cause condensation, and then modulating the valve 342 as required to maintain a set temperature in the space 334.

The pump 316 of the apparatus of FIG. 12, when heating is required, circulates heated water from the absorption refrigeration apparatus 312 to a heat exchanger 343 and back to the apparatus 312, while a pump 344 circulates another stream of water from the heat exchanger 343 to the pre-heat coil 328 and back to the heat exchanger 325. The temperature of the coil 328 is determined by a temperature sensor/controller 345, which modulates a valve 346 to maintain the temperature it senses within control limits. Plenum unit heaters 347 and baseboard heaters 348 are also operably connected to the circulating system served by the pump 316 for use, as required, to introduce heat into a plenum above the spaces served or into the spaces themselves. The apparatus also includes valves 349 and 350 to control the flow of heated water to the plenum heaters 347 and to the baseboard heaters 348, respectively.

Figure 13:
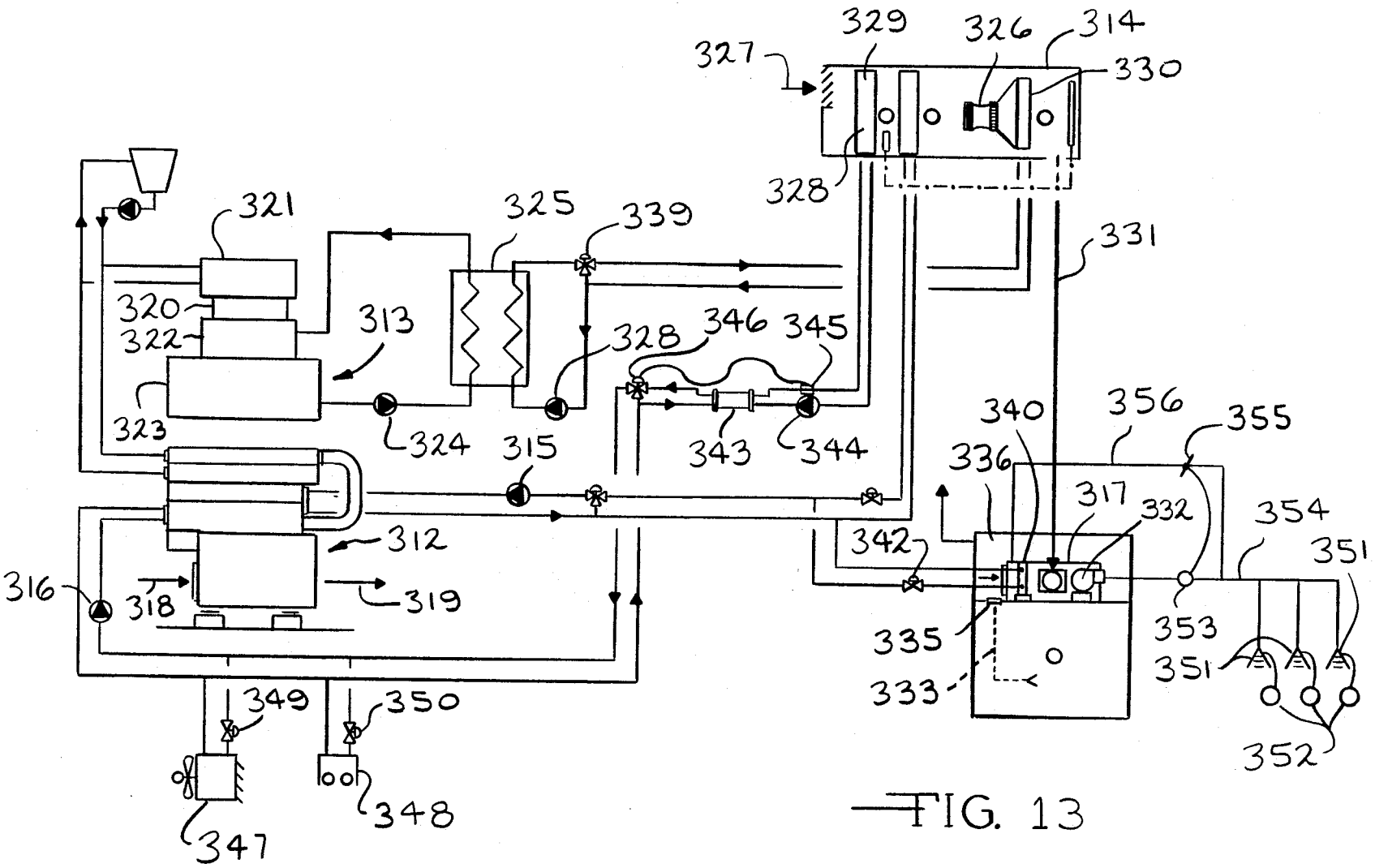
FIG. 13 is a schematic diagram showing apparatus comprising absorption refrigeration apparatus, compression refrigeration apparatus, an air handler, a circulating system which includes a plurality of sprinkler branches, one of which is designated generally at, and a plurality of induction mixing units.

As is stated above, the blower 295 of FIG. 11 is controlled to maintain constant the static pressure measured by the sensor 296 in the duct 297. This can be done by controlling either the speed of the blower 295 or by controlling a vortex damper in the blower 295. Apparatus shown in FIG. 13 accomplishes the result in a different way. The apparatus is identical with that of FIG. 12 except that the discharge of the blower 332 is ducted to a plurality of diffusers 351, each of which serves a space to be air conditioned. Each of the diffusers is served by a thermostat controller 352 which modulates the rate at which conditioned air is delivered by each of the diffusers 351 to the space it serves to maintain a predetermined temperature. A static pressure sensor/controller 353 in a duct 354 which receives the discharge from the blower 332 controls a damper 355 in a by-pass duct 356. The damper 355 is modulated as required to maintain the static pressure in the duct 354 constant, the conditioned air that is by-passed to accomplish this result being returned through the duct 356 to the induction mixing unit 317 on the suction side of the blower 332. When the induction mixing unit 317 is positioned in a plenum 336, duct 356 can discharge into the plenum 336, from which it will ultimately be returned to the space served by one of the induction mixing units 317. The arrangement shown in FIG. 13 is somewhat more energy efficient, but the pressure in the duct 354 can be kept constant by modulating the damper 355 whether the duct 356 discharges into the plenum 336 or into one of the induction mixing units 317.

Figure 14:
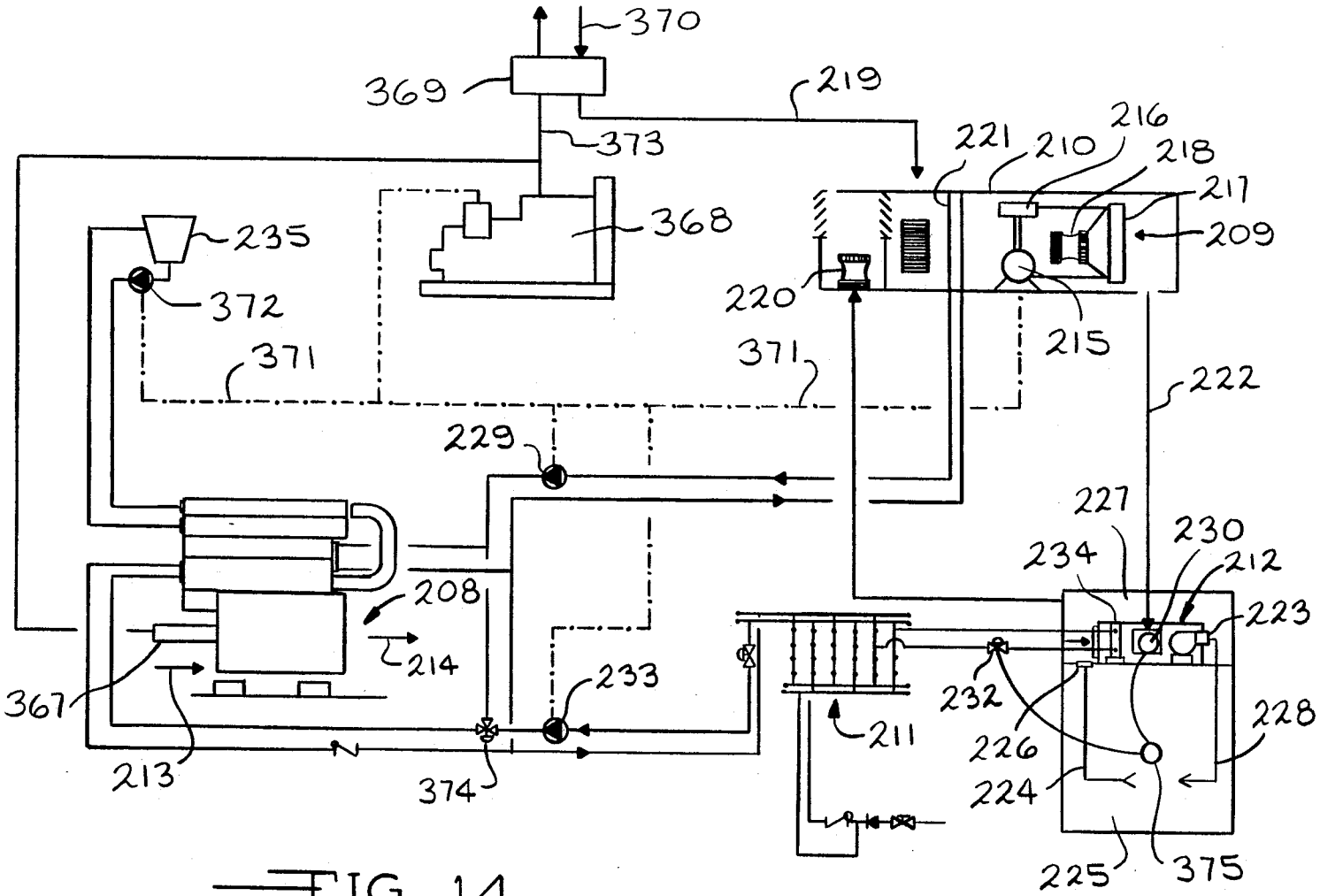
FIG. 14 is a schematic diagram showing apparatus identical to that of FIG. 13 which additionally includes a cogenerator.

Apparatus similar to that of FIG. 8 in that it comprises the absorption refrigeration apparatus 208 with an added heat exchanger 367, the compression refrigeration apparatus 209, the air handler 210, the circulating system which includes a plurality of sprinkler branches, one of which is designated generally at 211, and the plurality of induction mixing units, one of which is designated generally at 212, and which additionally comprises a cogenerator 368 and a dehumidifying wheel 369 is shown in FIG. 14. Outside air enters the apparatus as indicated by an arrow 370, and passes through the dehumidifying wheel 369, where it is dehumidified by contact with, for example, paper impregnated with lithium chloride and then enters the air handler 210. The air can be dehumidified to a moisture content of 45 grains of water vapor per pound of dry air in the wheel 369 so that it will be cooled sensibly, but not dehumidified, by the coil 221. The direct expansion coil 217 will then cool and dehumidify the air, so that it leaves the air handler 210 saturated with water vapor at a dry bulb temperature of 40° F. (4° C.).

The cogenerator 368, which can be a gas turbine, a Sterling engine, a diesel or other combustion engine or a fuel cell generates electricity which, as indicated by a line 371, is distributed to the compressor 215, to the pumps 229 and 233, and to a pump 372 which serves the cooling tower 235. Exhaust heat from the cogenerator 368, as indicated by a line 373, regenerates the desiccant wheel 3692 and provides a part of the energizing heat for the absorption refrigeration apparatus 208.

The coil 234 in the induction mixing unit 212 is connected through the sprinkler branch 211 to receive either chilled water or heated water from the absorption apparatus 208, depending on the setting of a vlave 374. Accordingly, on cooling cycle, a humidistat-thermostat controller 375 keeps the valve 232 closed and opens the damper 230 when the sensed humidity is above a control point and, when humidity control is established, modulates the damper 230 to maintain the set humidity and modulates the valve 374 to maintain a set temperature, modulating the damper 230 to maintain temperature whenever the valve 374 is in a fully open position and the temperature sensed is above the set temperature.

It will be appreciated that the apparatus of FIG. 14 does not use electricity as an energy source and is, therefore, the ultimate so far as elimination of the problems associated with demand charges for electricity. The apparatus, however, has many components, each of which contributes to the initial cost.

New electric generating apparatus has become extremely costly in recent years. As a consequence, it is highly desirable to minimize the peak usage of electricity and thereby to avoid the necessity for new generating capacity. Traditionally, air conditioning apparatus has been of the compression type with compressors driven by electric motors. Such apparatus has a peak demand for electricity at the time when use for other purposes is also at a peak, and has little or no demand at times when use for other purposes is comparatively low. The apparatus of FIGS. 8 through 12 transfers heat at a comparatively high temperature to absorption refrigeration apparatus and transfers heat at a comparatively low temperature to compression refrigeration apparatus or to stored ice made with compression refrigeration apparatus. By comparison with traditional apparatus, the peak demand for electricity is reduced by shifting a part of the load to absorption apparatus; it is also reduced by shifting a part of the load to ice made with compression refrigeration apparatus, provided that the ice is made during periods when there is excess generating capacity. This is an important feature of the apparatus of FIGS. 8 through 13 of the instant invention.

Figure 7:
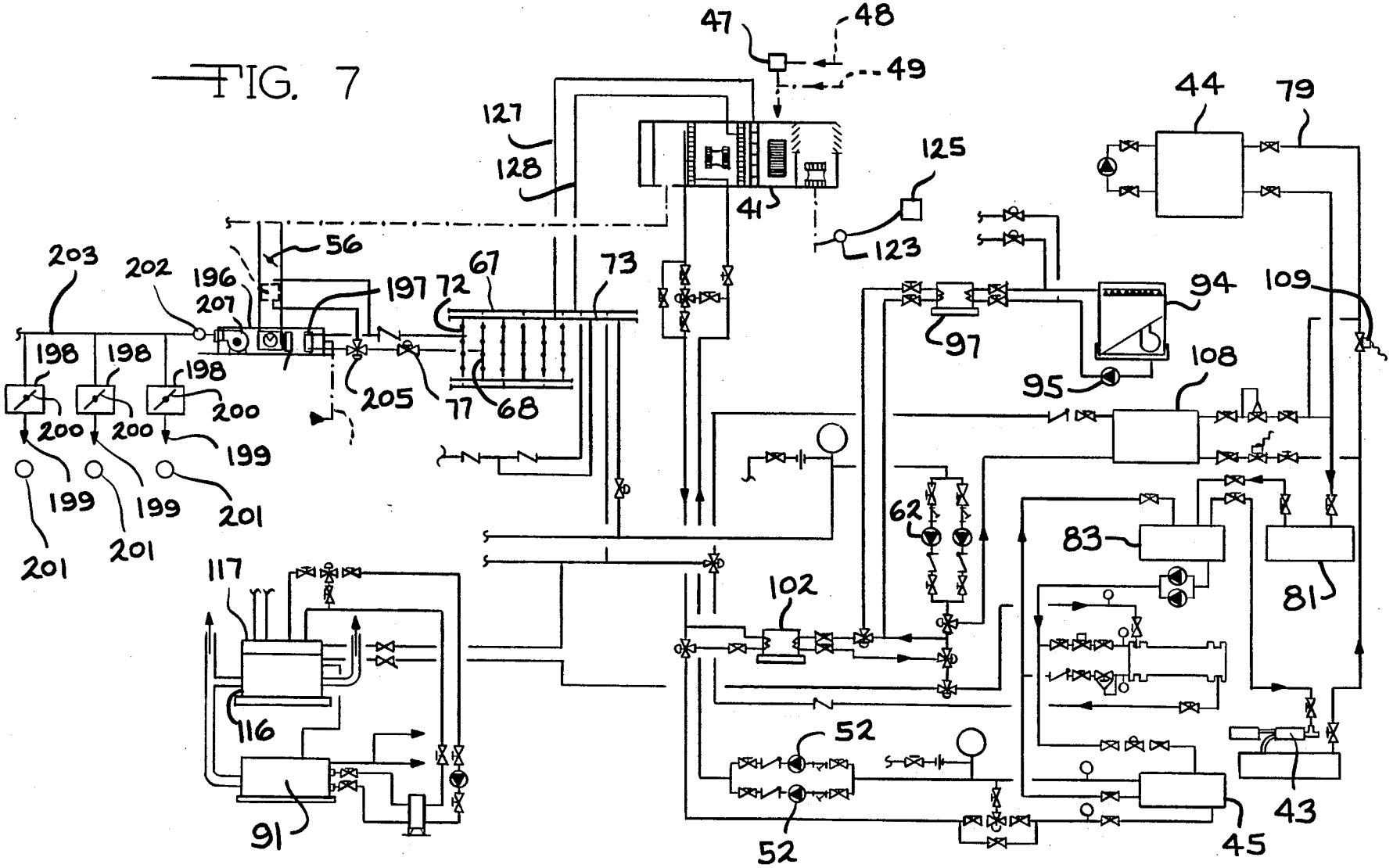
FIG. 7 is a schematic diagram in plan showing further details of the induction mixing unit of FIG. 6.
Figure 15:
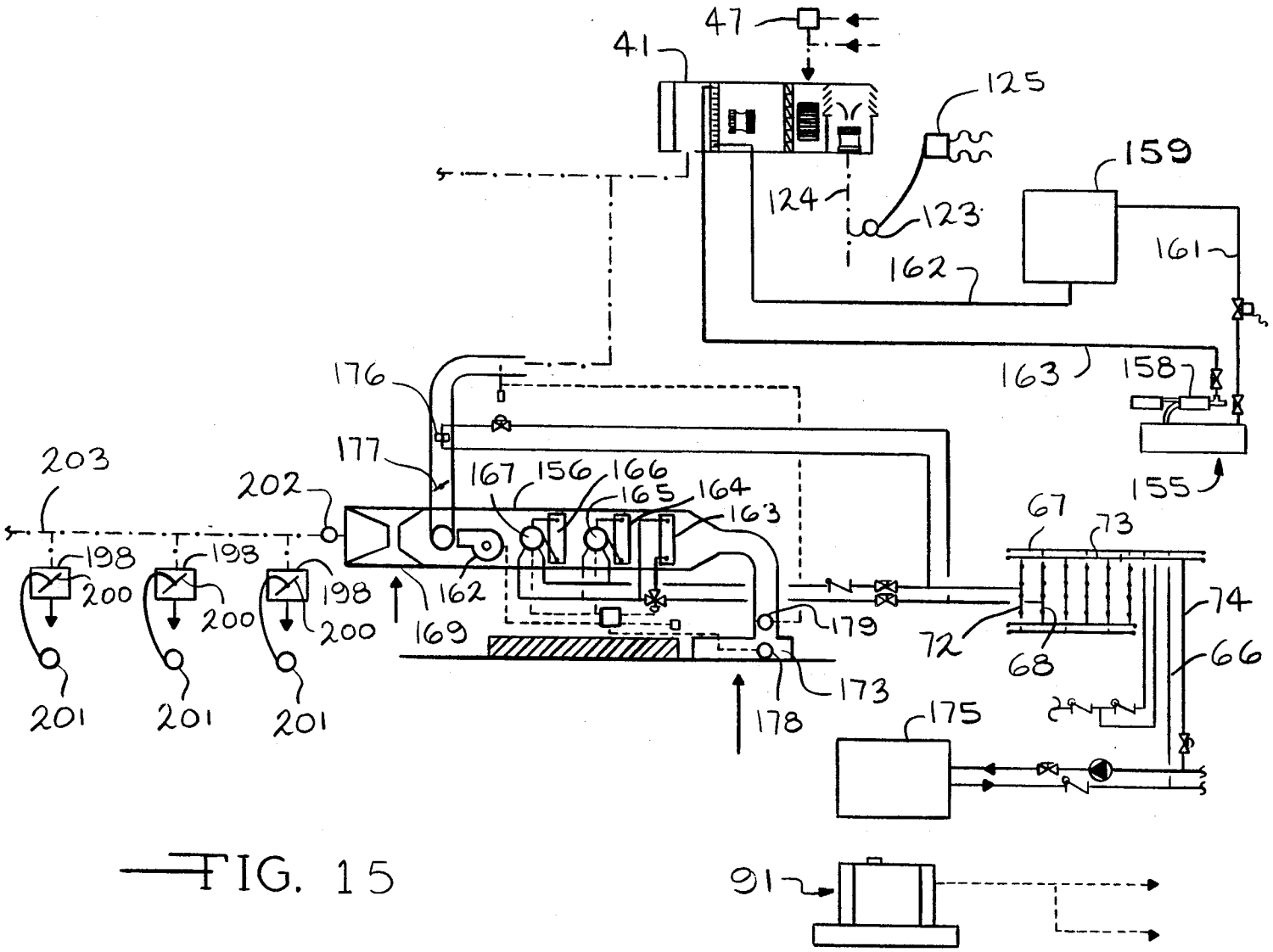
FIG. 15 is a schematic diagram showing apparatus comprising absorption refrigeration apparatus, compression refrigeration apparatus, an air handler, a circulating system which includes a pump, a circulating system which includes a second pump, and a plurality of induction mixing units.

Apparatus similar to that of FIG. 7, except that the induction mixing units 196 and the absorption refrigeration apparatus 117 have been replaced by the induction mixing units 156 (FIG. 4) and the closed circuit evaporative cooler 175, respectively, is shown in FIG. 15. The induction mixing units 156 serve the diffusers 198 and conditioned air is delivered to the space it serves by each of the diffusers 198 as previously described. Similarly, the induction mixing units 156 are controlled by the sensor/controllers 202:

(1) to maintain a constant pressure in the duct 203, and
(2) to maintain an instantaneously set temperature in the duct 203.

When the apparatus is first energized, the dampers 177 are all in their full open positions, and there is no flow of water from the evaporative coolers 175. This mode of operation continues until the humidistat 123 senses a moisture content which indicates that humidity control has been established. The apparatus then enables each of the sensor/controllers 202 to control the damper 177 of the associated one of the induction mixing units 156. Initially, each of the dampers 177 is set in its minimum position, i.e., the one which provides the minimum ventilation air or the minimum setting which provides humidity control, depending upon the design of the apparatus, and, unless this setting maintains the set pressure sensed by the sensor 202, each of the blowers 162 is energized, and each of the units is set to cause the maximum flow of evaporatively cooled water through the coil 163. This mode of operation continues until one of the sensor/controllers 201 senses a temperature (1) above its set point with the associated damper 200 in the full open position, or
(2) below its set point with the associated damper 200 in its minimum position.

In case (1), the sensor/controller 202 is activated to control the associated one of the heat pumps to pump heat from the coils 166 to maintain the sensed temperature about 2° F. (1° C.) below that sensed at the time of activation; thereafter, the set point for the sensor controller 202 is lowered whenever there is a reoccurrence of case (1) or raised when there is an occurrence of case (2), until such time as the heat pump is no longer being operated. In case (2), the sensor/controller 202 is activated to control the associated one of the heat pumps to pump heat to the coil 164 to maintain the temperature about 2° F. (1° C.) above that sensed at the time of activation; thereafter, the set point for the sensor controller 202 is raised whenever there is a reoccurrence of case (2) or lowered when there is an occurrence of case (1) until such time as the heat pump is no longer being operated.

Figure 16:
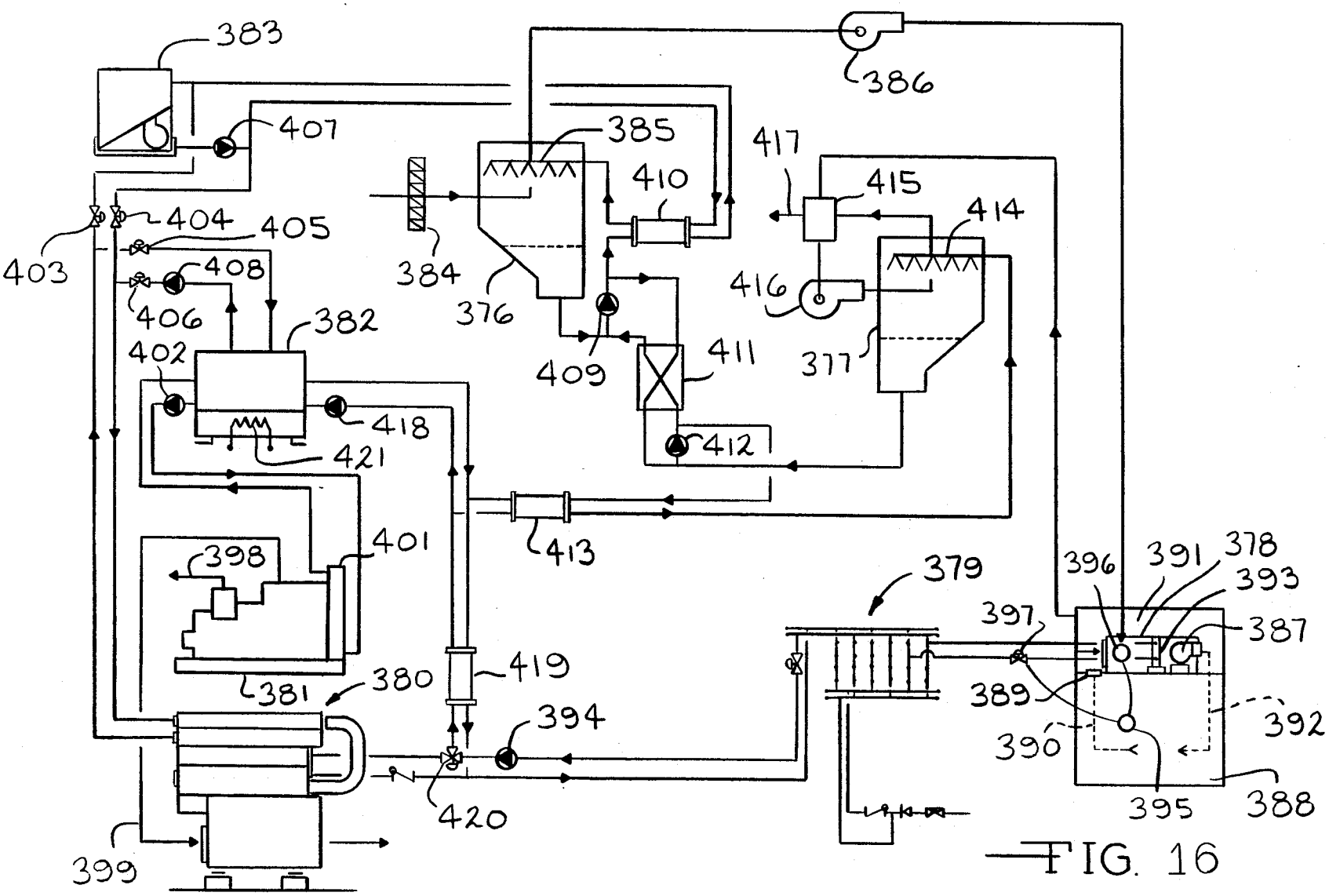
FIG. 16 is a schematic diagram showing apparatus comprising absorption refrigeration apparatus, compression refrigeration apparatus, an air handler, a circulating system which includes a pump, a circulating system which includes a second pump, and a plurality of induction mixing units.

Apparatus comprising a conditioner 376, a regenerator 377, an induction mixing unit 378, a sprinkler branch 379, absorption refrigeration apparatus indicated generally at 380, a cogenerator 381, a hot water storage tank 382 and a cooling tower 383 is shown in FIG. 16. In operation, air to be dehumidified, usually a mixture of outside air and return air, flows through a filter 384, through the conditioner 376 where it is dehumidified by a desiccant solution, lithium chloride, for example, which is sprayed from nozzles 385, through a blower 386 and to the induction mixing unit 378. A fan 387 causes air to flow from a space 388 through a ceiling opening 389 as indicated by a tail 390 of an arrow and a plenum 391 into the induction mixing unit 378 where it is mixed with dehumidified air and delivered to the space 388 as indicated by a head 392 of an arrow. The mixture of air from the space and dehumidified air flows over a coil 393 inside the induction mixing unit 378, and heat is transferred therefrom to cool water circulated by a pump 394 from the absorption refrigeration apparatus 380 through the sprinkler branch 379 to the coil 393, and back through the sprinkler branch 379 to the apparatus 380. A humidistatthermostat/controller 395 modulates a damper 396 to cause the rate at which dehumidified air enters the space 388 to vary between the minimum ventilation rate and the maximum rate, as required for humidity control, and modulates a valve 397, as required for temperature control.

Electricity from the cogenerator 381 is circulated to the pumps and blowers of the apparatus as indicated by an arrow 398; combustion products therefrom are circulated to the absorption refrigeration apparatus 380 as indicated by an arrow 399 to provide energizing heat, and are discharged as indicated by an arrow 400 and vented to a chimney (not illustrated); while hot jacket water from the cogenerator 381 is circulated through a heat exchanger 401 where heat is transferred therefrom to a heat transfer fluid circulated by a pump 402 from the storage tank 382 to the heat exchanger 401 and back to the tank 382. Heat from the absorption apparatus 380, which can be heat incidental to the operation of the apparatus, excess energizing heat, or both, depending on the position of valves 403, 404, 405 and 406, is transferred to a heat transfer fluid circulated by a pump 407 and rejected in the cooling tower 383 or is transferred to a heat transfer fluid circulated by a pump 408 and stored in the tank 382.

The desiccant solution that is sprayed from the nozzles 385 of the conditioner 376, as previously described, flows from a pump 409 through a heat exchanger 410 and to the nozzles 385, flowing by gravity back to the pump 409. Another stream of the desiccant solution flows through a heat exchanger 411 and then to a pump 412 from which a part of it is returned through the heat exchanger 411 to the pump 409 while the rest flows through a heat exchanger 413 and is sprayed from nozzles 414 in the regenerator, returning by gravity to the pump 412 and then through the heat exchanger 411 the pump 409 and the heat exchanger 410 to the nozzles 385. Relief air from the space 388 flows through an air to air heat exchanger 415, a blower 416, the regenerator 377 and the air to air heat exchanger 415 and is vented as indicated by an arrow 417 indicating discharge from the heat exchanger 415. The pump 407 circulates a stream of the heat transfer fluid from the cooling tower 383 to the heat exchanger 410 so that heat is transferred from the desiccant solution which flows through the exchanger 410 on its way to the conditioner 376. A pump 418 circulates a hot heat transfer fluid from the storage tank 382 to the heat exchanger 413 so that heat is transferred to the desiccant solution which flows through the exchanger 413 on its way to the regenerator 377.

The apparatus also includes a heat exchanger 419 to which the pump 418 circulates hot heat transfer fluid from the storage tank 382. When heating is desired in the coil 393 of the induction mixing unit 378, a valve 420 is set so that the circulation of heat transfer fluid from the coil 393 is through the sprinkler branch 379, the heat exchanger 419 and the sprinkler branch 379 back to the coil 393. Ordinarily, heat from the absorption refrigeration apparatus 380 and from the cogenerator 381 is adequate for the needs of the apparatus. However, an electric heating element 421 is provided to add heat to the storage tank 382, if desired.

Figure 17:
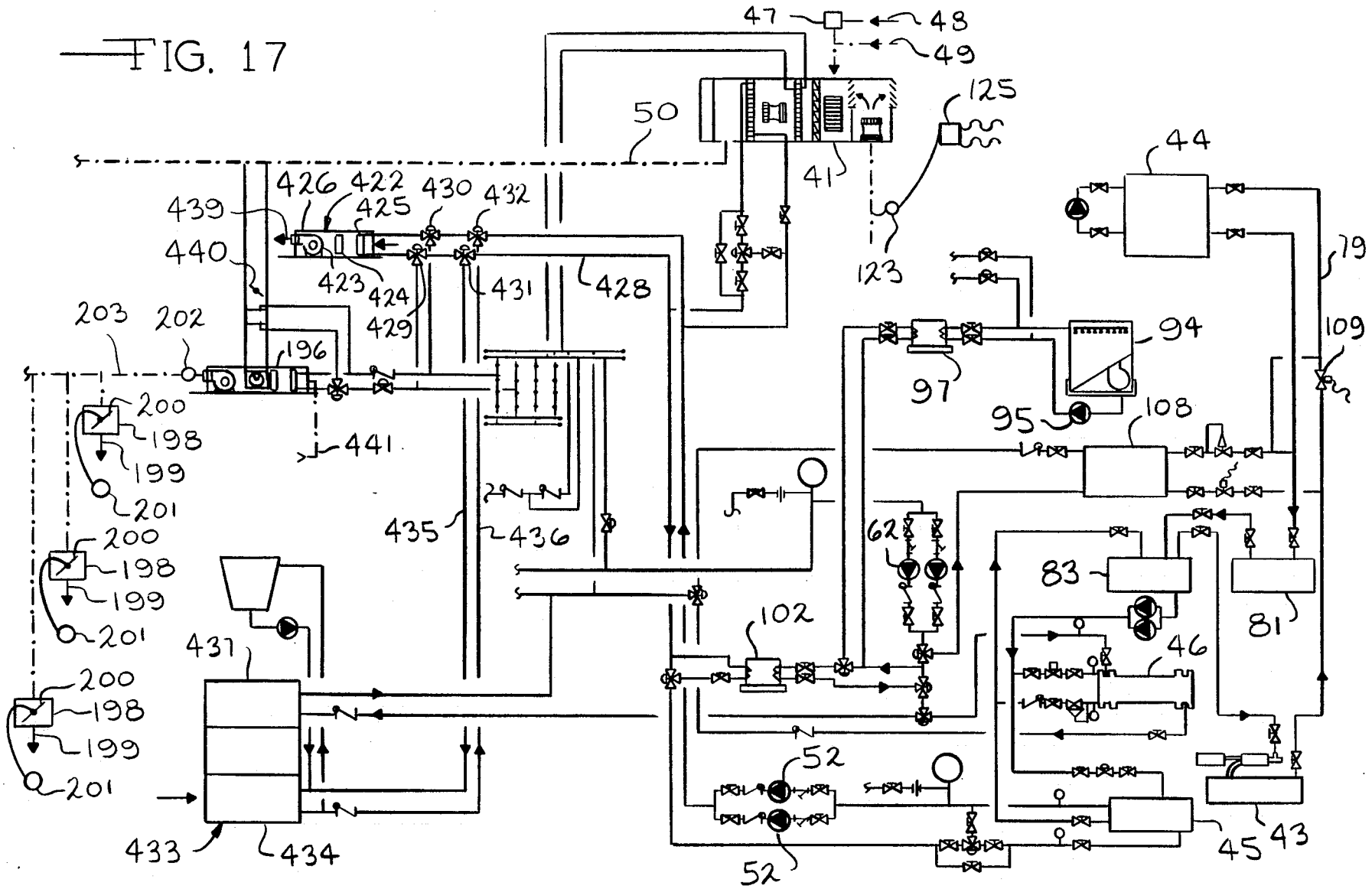
FIG. 17 is a schematic diagram showing apparatus identical with that of FIG. 16 except that the former includes a by-pass from the discharge side to the suction side of a blower which serves the plurality of induction mixing units and a damper in the by-pass which is controlled to maintain a constant pressure in a duct which serves the induction mixing units.

Apparatus similar to that of FIG. 7, but differing in that the gas engine-generator 91 and the absorption refrigeration apparatus 117 have been replaced by an absorption chiller/heater 433 and a circulating unit 422 has been added, is shown in FIG. 17. The circulating unit 422 comprises a blower 423, an electric heater 424, and a coil 425 in a housing 426. The coil 425 is operably connected to lines 427 and 428 through which, depending on the positions of valves 429, 430, 431 and 432, warm water from a heater 434 of the absorption chiller/heater 433 can be circulated thereto, flowing through lines 435 and 436, chilled water from an evaporator 437 can be circulated thereto, or ice water from the ice storage tank 45 can be circulated thereto.

In operation, the blower 423 is energized, causing air from a plenum 438 to flow into the housing 426. After flowing in heat transfer relationship with the coil 425 and with the heater 424, the air is returned to the plenum 438 as indicated by an arrow 439. The circulating unit 422 can be used to counteract heat gains to or heat losses from the plenum 438, or it can even be used to cool or heat the plenum 438 to a temperature sufficiently low or high that plenum air entering the induction mixing units 196 does a substantial portion or even all of the cooling or heating that is required. It is then possible to eliminate the air handler and the ducts. Air inlets in the induction mixing units 196 can be left open to allow plenum air to enter the units 196 and dampers 440 can modulate the flow of plenum air for temperature or humidity control; desirably, room air flows directly into the induction mixing units 196, as indicated by a tail 441, without mixing with the conditioned plenum air.

Figure 18:
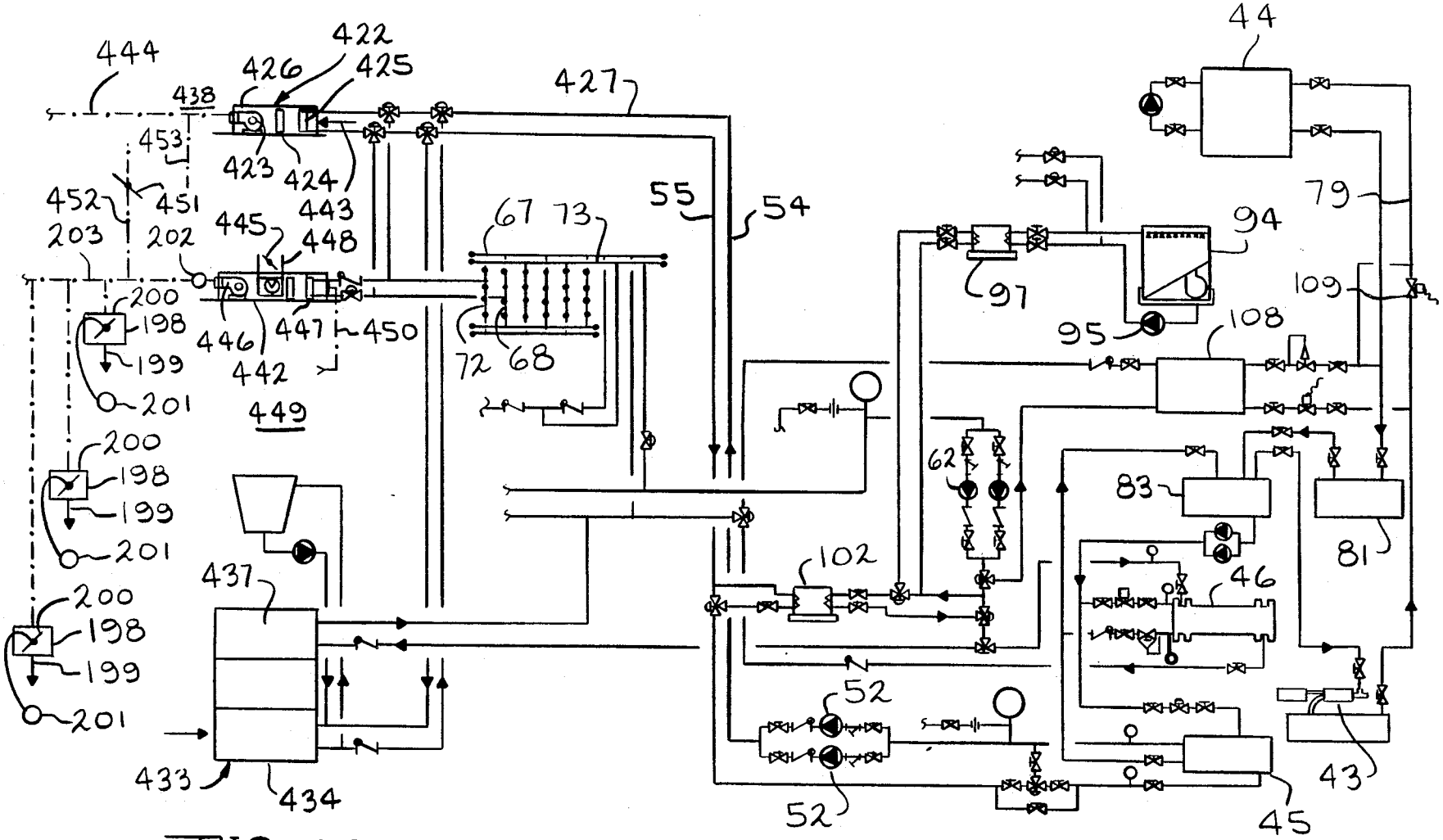
FIG. 18 is a schematic diagram showing apparatus similar to that of FIG. 12 in comprising absorption refrigeration apparatus, compression refrigeration apparatus, an air handler, a circulating system which includes a plurality of sprinkler branches, and a plurality of induction mixing units, and additionally including a cogenerator and a dehumidifying wheel.

Apparatus similar to that of FIG. 17 except that the air handler 41, and the duct 50 have been omitted, the induction mixing units 196 have been replaced by induction mixing units 442, and ducts 443 and 444, the latter being insulated to prevent condensation, have been added to serve the circulation unit 422, as subsequently described, is shown in FIG. 18. Conditioned air from the plenum 438 can enter the induction mixing units 442 at a rate which depends upon the settings of individual dampers 445, each of which is actuated by one of the sensor/controllers 202. The induction mixing units 442 are of the "fan/coil" type, having fans 446 and coils 447. The fans 446 are of the constant speed type, delivering a mixture of plenum air and room air to the duct 203 at a constant rate. The plenum air enters the induction mixing units 442 through a collar 448 at a rate which depends upon the setting of the damper 445, while air from a space 449 enters the induction mixing unit 442, as indicated by a head of an arrow 450 at a rate which equals that at which air enters the suction side of the fan 446 minus the rate at which air enters through the collar 448. The sensor/controller 202 modulates a damper 451 in a duct 452 to maintain a constant pressure in the duct 203. Air that flows through the duct 452 is discharged into the plenum 438, while air which remains in the duct 203 serves the variable air volume diffusers 198, as previously described.

In summer daytime operation, ventilation air enters the circulating unit 422 through the duct 443, and is cooled and dehumidified by contact with the coil 425, while cold dehumidified air is delivered to the duct 444. Water at 36° F. (2° C.) is circulated from the storage tank 45 to the coil 425 and back to the tank 45, so that outside air is cooled to 40° F. (2° C.) and then delivered through the duct 444 and induction outlets 453 into various regions of the plenum 438. The outlets 453 are positioned as required so that substantially uniform conditions of temperature and humidity are maintained throughout the plenum 438. The induction outlets 453 induce a flow of plenum air which mixes with the cold air from the duct 444 to prevent condensation; preferably, the induction ratio is at least one volume of plenum air per volume of cold air. The circulating unit 422 is operated to introduce air into the plenum 438 at the minimum rate required for ventilation or for humidity control, whichever is greater, by the conditioned space or spaces served. It is often adequate for air to be introduced at a rate of 0.15 to 0.20 cubic foot per minute per square foot of space served. Air at this rate will usually maintain the plenum 438 at a temperature in the range of 65° F. (18° C.) to 70° F. (21° C.).

It will be appreciated that each floor of a multi-story building will require a circulating unit 422 sized to serve the space on its floor. Ordinarily, it is preferred that these units be vertically above and below one another so that a single pair of pipes 54 and 55 can serve all of the units. In the apparatus of FIG. 18, heated water from the absorption heater/chiller 433 is also available to the units 422, but through a separate piping system, while chilled water from the absorption heater/chiller 433 or from the water chiller 46, circulated through the sprinkler system as previously explained.

Figure 19:
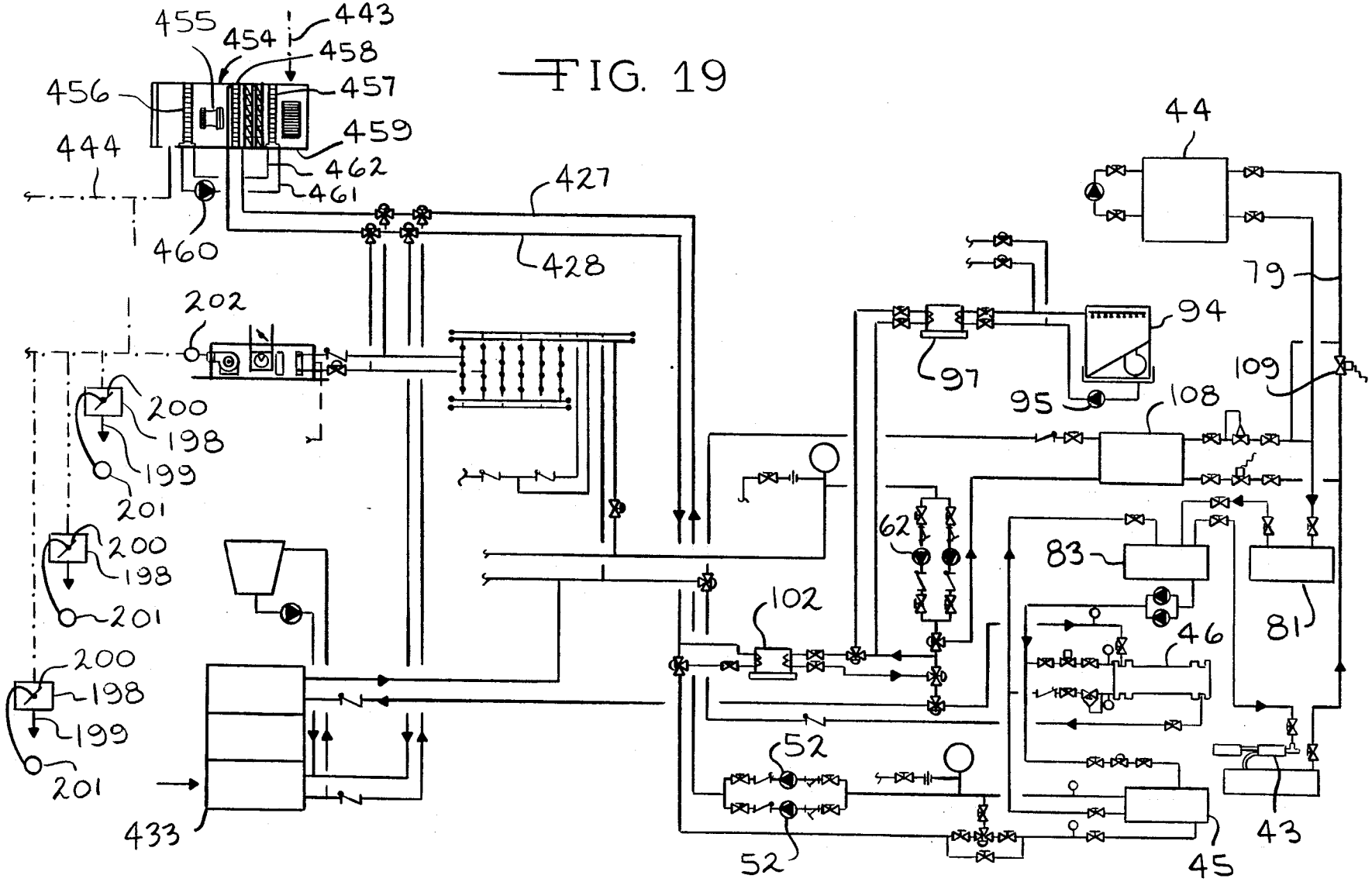
FIG. 19 is a schematic diagram showing apparatus similar to that of FIG. 11, differing in that the former includes a different induction mixing unit and a closed circuit evaporative cooler replaces absorption refrigeration apparatus.

Apparatus similar to that of FIG. 18, except that the circulating unit 422 has been replaced by a circulating unit 454 is shown in FIG. 19. The circulating unit 454 comprises a blower 152, and three coils, designated 456, 457 and 458 in a housing 459. The coil 458 is operably connected to the lines 427 and 428 through which ice water from the ice storage tank 45 is usually circulated thereto, or through which chilled water or warm water can be so circulated, as previously described. A pump 460 circulates water from the coil 456 to the coil 457 and back to the coil 456, the flow being from the pump 460 through a line 461 to the coil 457 and through a line 462 back to the coil 456.

The operation of the apparatus of FIGS. 18 and 19 is substantially identical, the difference being that, in the apparatus of FIG. 19, heat is transferred from the coil 456 to air that has been cooled by contact with the coil 458, while heat is transferred to the coil 457 by outside air entering the circulating unit 454. This transfer is accomplished merely by circulating water or another heat transfer fluid as previously described from the coil 456 to the coil 457 and back. As a consequence of this heat transfer, air enters the duct 444 at a temperature higher than 40° F. (2° C.) by an amount that depends upon the extent of the heat transfer between the coils 456 and 457. For example, the air entering the duct 444 can be at 70° F. (2° C.) and can maintain a plenum temperature of 75° F. (24° C.).

Figure 20:
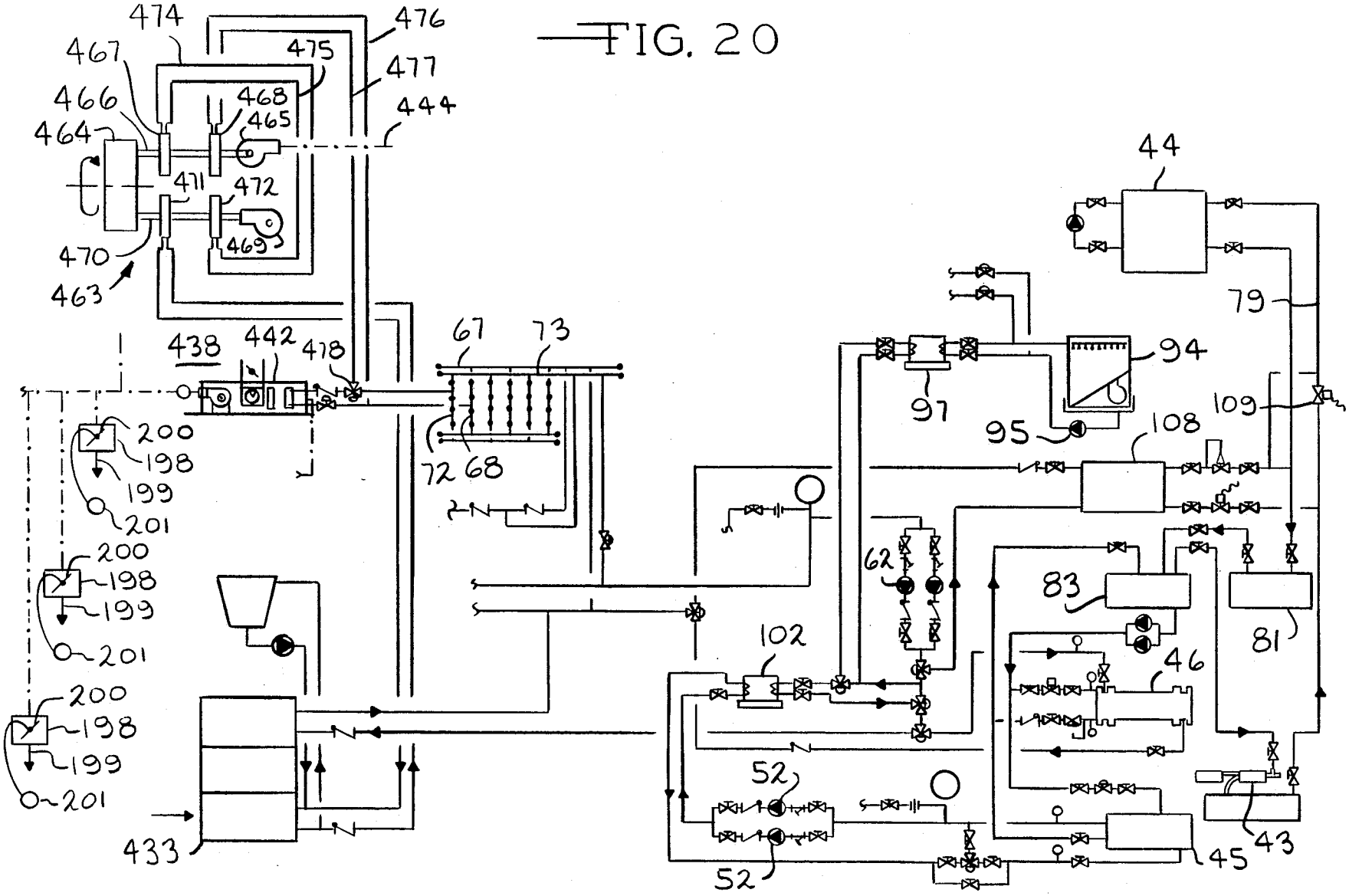
FIG. 20 is a schematic diagram showing apparatus comprising a conditioner, a regenerator, an induction mixing unit, a sprinkler branch, absorption refrigeration apparatus, a cogenerator, a hot water storage tank and a cooling tower.

Apparatus similar to that of FIGS. 18 and 19, differing in that the circulating units 422 and 454 have been eliminated, while chemical dehumidification apparatus indicated generally at 463 has been added, is shown in FIG. 20. The dehumidification apparatus 463 comprises a desiccant wheel 464 through which a blower 465 causes ambient air to flow. The air is dehumidified in flowing through the wheel 464 by contact, for example, with paper impregnated with lithium chloride, and then flows through a duct 466, in heat exchange relationship with coils 467 and 468 and into the blower 465, from which it is discharged into the duct 444. A blower 469 withdraws air from the plenum 438 at the same rate at which dehumidified air is introduced thereinto from the duct 444, discharging into a duct 470 from which it flows through the desiccant wheel 464 and is vented outside the apparatus. Air in the duct 470 is heated by heat transfer thereto from coils 471 and 472 and, as a consequence, regenerates the lithium chloride or other desiccant in the sector of the wheel 464 through which it flows. The wheel 464 rotates, as indicated by an arrow 473, so that one sector is always being regenerated while the apparatus is in operation while ambient air always flows through a regenerated sector and is dehumidified.

Dehumidification in the wheel 464 is exothermic, so that the air entering the duct 466 is above ambient temperature. Water or another heat transfer fluid is circulated from the coil 467 to the coil 472 and back to the coil 467, the flow being through pipes 474 and 475, so that heat is transferred from the dehumidified air to the regenerating air. In addition, the lines 435 and 436 are connected to the coil 471, so that heat from the absorption chiller/heater 433 can be used as required to heat the regenerating air. Finally, the coil 468 is connected by lines 476 and 477 so that chilled water from the absorption chiller/heater 433 or from the water chiller 46 can be circulated therethrough. A valve 478 can be modulated as required to maintain a desired temperature in the plenum 438, usually substantially the same as that being maintained in the space below the plenum. When more cooling is required, the valve 478 can be controlled to maintain a lower plenum temperature.

Although, in the apparatus of FIGS. 18, 19 and 20, the induction mixing units 442 all serve diffusers 198 it will be appreciated that units which discharge directly into the spaces they serve, but receive conditioned air from a plenum and space air, could also be used.

Figure 21:
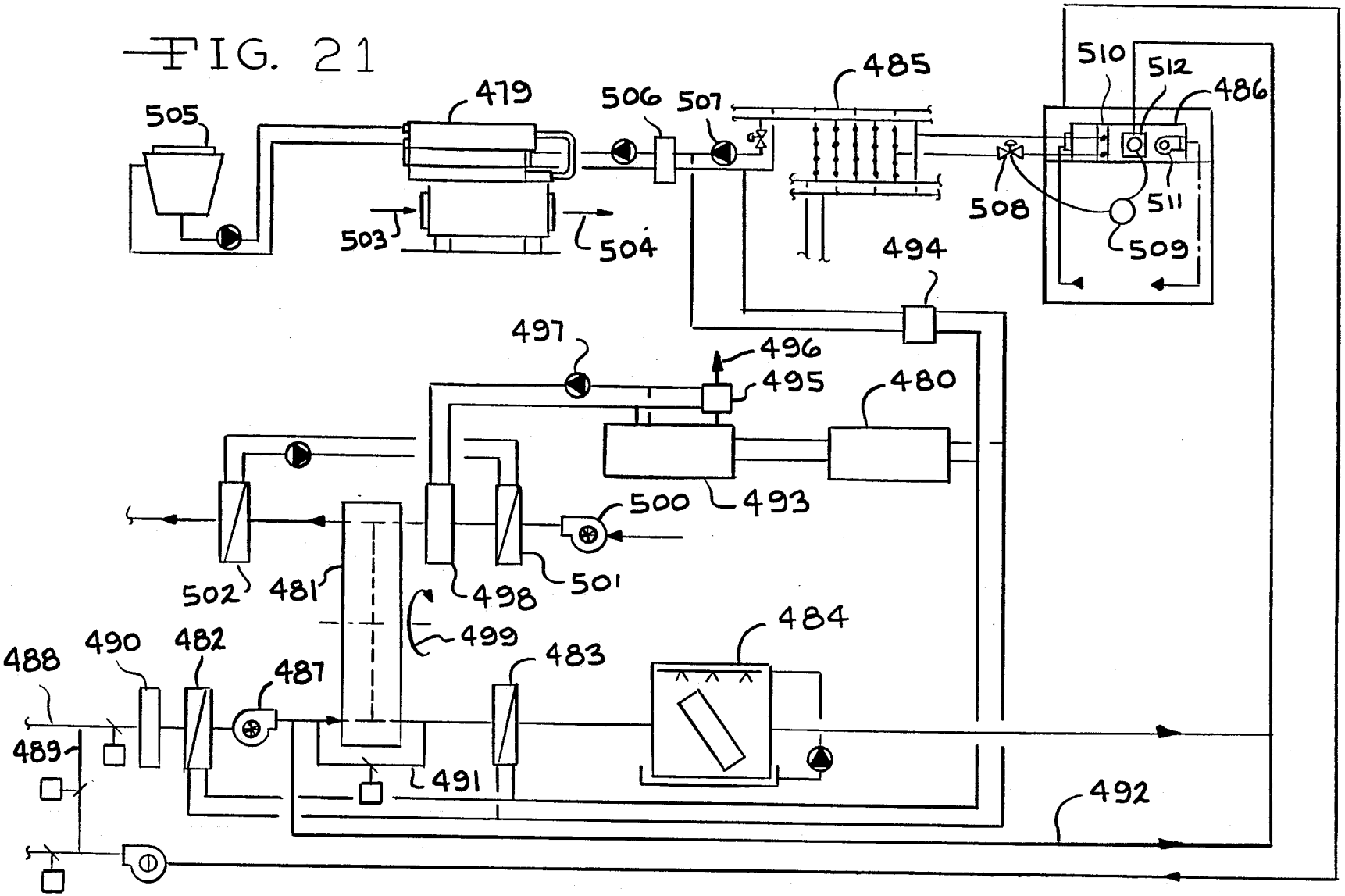
FIG. 21 is a schematic diagram showing apparatus similar to that of FIG. 11, but differing in that the gas engine-generator and the absorption refrigeration apparatus of the latter have been replaced by an absorption chiller/heater, and a circulating unit positioned to transfer heat to or from air in a plenum above a space to be conditioned has been added.

Apparatus shown in FIG. 21 comprises absorption refrigeration apparatus 479, compression refrigeration apparatus 480, a desiccant wheel 481, a precooling coil 482, a post cooling coil 483, a washer 484, a plurality of sprinkler grids 485 (one of which is shown) and a plurality of induction mixing units 486 (one of which is shown).

In operation, a blower 487 causes a mixture of outside air from a duct 488 and return air from a duct 489 to flow through a filter 490, the precooling coil 482, the desiccant wheel 481, the post cooling coil 483 and the washer 484, and to each of the induction mixing units 486. The apparatus will usually be operated so that the air leaving the precooling coil 482 is at a temperature of about 51° F. (11° C.); under many conditions of operation, the air will also be saturated, containing about 51 grains of water vapor per pound of dry air, because the mixture entering the precooling coil 482 has a higher moisture content. The air can be dehumidified and heated in the desiccant wheel 481 so that it enters the post cooling coil 483 at a moisture content of about 10 grains of water vapor per pound of dry air at a temperature of about 100° F. (38° C.), cooled by the coil 483 to about 51° F. (11° C.), and cooled and humidified in the washer 484 so that it leaves at a dry bulb temperature of about 40° F. (4° C.) and containing about 38 grains of water vapor per pound of dry air. It is desirable, under some conditions of operation, for air to flow through a duct 491 or through a duct 492, bypassing the desiccant wheel 481 in the former case, and bypassing the desiccant wheel 481, the post cooling coil 483 and the washer 484 in the latter, but it is usually desirable, on summer cycle, to operate the apparatus as described above.

The compression refrigeration apparatus 480 produces chilled water at about 45° F. (7° C.), and is driven directly by a gas engine 493, although the same result can be achieved if the gas engine 493 drives a generator (not illustrated) which supplies electricity for an electric motor (not illustrated) which, in turn, drives the apparatus 480. Chilled water from the compression refrigeration apparatus 480 is circulated to the coils 482 and 483, where it performs the cooling functions described above and to a heat exchanger 494 which is used under some conditions of operation, as explained below.

Exhaust gases from the engine 493 flow through a heat exchanger 495, and are discharged as indicated by an arrow 496. A pump 497 causes water from the cooling jacket of the engine 493 to flow through the heat exchanger 495 and a heat exchanger 498 and back to the cooling jacket of the engine 493.

The desiccant wheel 481 rotates, as indicated by an arrow 499, so that air which a blower 500 causes to flow through a heat exchanger 501, the heat exchanger 498, the desiccant wheel 481 and a heat exchanger 502, flows through a constantly changing segment of the wheel 481 and, because it is heated by the heat exchanger 498, keeps the desiccant of the wheel 481 in a regenerated condition. A heat exchange fluid flows from the heat exchanger 501 to the heat exchanger 502, so that a part of the heat that would otherwise be discharged from the apparatus with the regenerating air is recovered.

The absorption refrigeration apparatus 479 is of the direct fired type to which gas is supplied as required, as indicated by an arrow 503, and from which flue gases are discharged as indicated by an arrow 504. Heat is transferred therefrom, as required, to a cooling tower 505, while chilled water is circulated therefrom to a heat exchanger 506, as required.

A pump 507 circulates water to the heat exchanger 506, to the heat exchanger 494, or to both, then to the sprinkler grids 485 and back to one or both of the heat exchangers 506 and 494. Valves 508, which are controlled by temperature/humidity sensors and controllers 509, are modulated, as required, to maintain a desired temperature in the space served by each of the induction mixing units 486 by controlling the flow of heat transfer fluid through coils 510 in the induction mixing units 486 while blowers 511 cause recirculated room air that is ultimately mixed with primary conditioned air and returned to the rooms to flow over the coils 510. The temperature/humidity sensors and controllers 509 also modulate dampers 512 in the induction mixing units 486 so that primary, conditioned air delivered thereto maintains a desired humidity in the space served by each of the units 486.

Chilled heat transfer fluid from the compression refrigeration apparatus 480 is circulated to each of the heat exchangers 482 and 483 and, when the load on those heat exchangers is insufficient, to the heat exchanger 494. The engine 493 is the sole source for heat, in the apparatus of FIG. 21, for regeneration of the desiccant of the wheel 481. When the load on the heat exchangers 482 and 483 is sufficiently high, the engine 493 provides all of the heat that is needed for regeneration; when the load is less, chilled heat transfer fluid from the compression apparatus 480 is circulated to the heat exchanger 494 to increase the load, as required, so that the engine 493 provides all of the heat required for regeneration. The absorption refrigeration apparatus 479 is operated to carry all of the load that is not carried by the compression apparatus 480.

Figure 22:
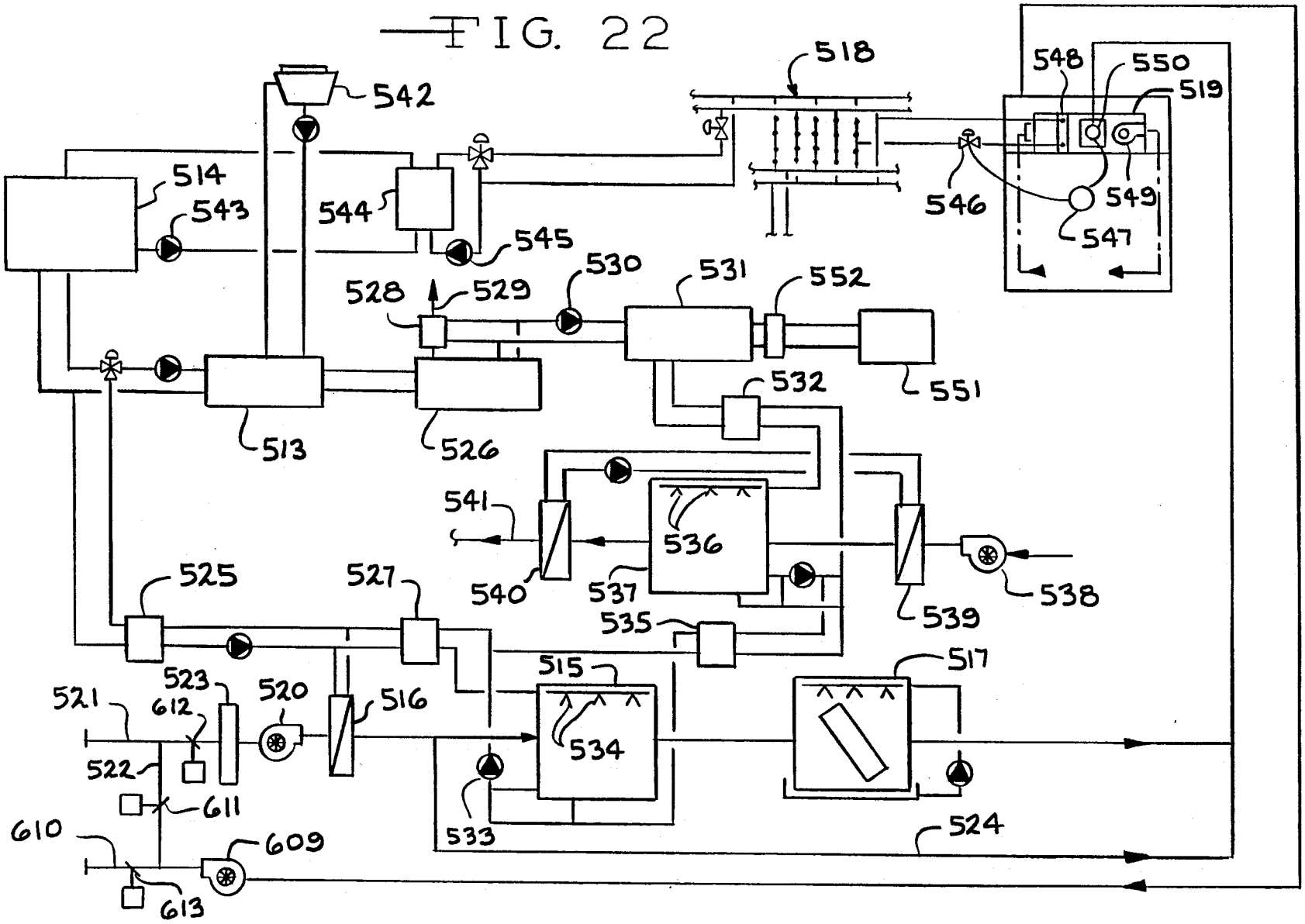
FIG. 22 is a schematic diagram showing apparatus similar to that of FIG. 21, but differing in that the air handler and the primary air duct of the latter have been omitted, and the circulating unit has been connected to the apparatus so that it can condition plenum air as required to maintain a comfort condition, without the necessity for primary air from an air handler.

Apparatus shown in FIG. 22 comprises compression refrigeration apparatus 513 which serves an ice builder 514, a chemical dehumidifier 515, a precooling coil 516, a washer 517, a plurality of sprinkler grids 518 (one of which is shown) and a plurality of induction mixing units 519 (one of which is shown).

In operation, a blower 520 causes a mixture of ambient air from a duct 521 and return air from a duct 522 to flow through a filter 523, the precooling coil 516, the chemical dehumidifier 515, and the washer 517, and to each of the induction mixing units 519. The apparatus will usually be operated so that the air leaving the precooling coil 516 is at a temperature of about 51° F. (11° C.); under many conditions of operation, the air will also be saturated, containing about 51 grains of water vapor per pound of dry air, because the mixture entering the precooling coil 516 has a higher moisture content. The air can be dehumidified isothermally so that it leaves the dehumidifier 515 at a moisture content of about 20 grains of water vapor per pound of dry air at a temperature of about 51° F. (11° C.), and cooled and humidified in the washer 517 so that it leaves at a dry bulb temperature of about 40° F. (4° C.) and containing about 38 grains of water vapor per pound of dry air. It is noteworthy that, as just described, the apparatus uses chilled water at 45° F. (7° C.) to produce conditioned air at 40° F. (4° C.) Under some conditions of operation, it is desirable for air to flow through a duct 524, bypassing the dehumidifier 515 and the washer 517, but it is usually preferable, on summer cycle, to operate the apparatus as described above.

The compression refrigeration apparatus 513 serves the ice builder 514 and a heat exchanger 525, and is driven directly by a gas engine 526, although the same result can be achieved if the gas engine 526 drives a generator (not illustrated) which supplies electricity for an electric motor (not illustrated) which, in turn, drives the apparatus 513. Either refrigerant from the compression refrigeration apparatus 513 or a glycol solution chilled therein is circulated to the ice builder 514, where it removes heat as required to make ice, and to the heat exchanger 525. A heat transfer fluid is circulated from the heat exchanger 525 to the heat exchanger 516 as required to condition air as previously described, and to a heat exchanger 527 in which heat is transferred from liquid desiccant circulated therethrough.

Exhaust gases from the engine 526 flow through a heat exchanger 528, and are discharged as indicated by an arrow 529. A pump 530 causes water from the cooling jacket of the engine 526 to flow through the heat exchanger 528, to a storage tank 531, and back to the cooling jacket of the engine 526. A heat transfer fluid is also circulated from the storage tank 531 through a heat exchanger 532, and back to the storage tank 531.

A pump 533 causes desiccant to flow upwardly in two streams from the dehumidifier 515. One stream flows through the heat exchanger 527, where it is cooled, and then to nozzles 534 from which it is sprayed inside the dehumidifier 515 to dehumidify air being conditioned as previously described. The liquid desiccant can be a solution of a lithium salt such as lithium chloride or can be a glycol solution, the latter being suitable because the desiccant solution is cooled in the heat exchanger 527 so that volatilization of the glycol would not be a problem. The second stream of desiccant from the pump 533 flows through a heat exchanger 535, the heat exchanger 532 and then to nozzles 536 from which it is sprayed inside a regenerator 537. A blower 538 causes regenerating air to flow through a heat exchanger 539, the regenerator 537 and a heat exchanger 540, ultimately being vented as indicated by an arrow 541. A heat transfer fluid is circulated from the heat exchanger 540 to the heat exchanger 539 and back to the heat exchanger 540. Desiccant is also caused to flow from the regenerator 537 through the heat exchanger 535 and to the pump 533. The desiccant, before being sprayed from the nozzles 536 of the regenerator 537, is heated both in the heat exchanger 535 and in the heat exchanger 532 and, as a consequence, water is vaporized in the regenerator 537 and removed by the regenerating air, effecting regeneration of the desiccant. Because the effluent from the regenerator 537 which enters the heat exchanger 540 is hot, heat is transferred therefrom to the heat transfer fluid which flows through the heat exchanger 540 and, in turn, to regenerating air which flows through the heat exchanger 539.

As is stated above, either refrigerant from the compression refrigeration apparatus 513 or glycol solution cooled therein is circulated to the ice builder 514, as required. The operation of the ice builder 514 can be either continuous or intermittent, while there is a need to circulate refrigerant or glycol solution to the heat exchanger 525 only while the space served by the apparatus is being conditioned. If the operation of the ice builder 514 is continuous, the operation of the compression refrigeration apparatus 513 is also continuous, at a given load when only the ice builder 514 is operating, and at a higher load when all of the apparatus is operating. If the operation of the ice builder 514 is intermittent, for example, only when the rest of the apparatus is not operating, the compression refrigeration apparatus 513 can operate continuously, serving the ice builder 514 whenever the rest of the apparatus is not operating and the heat exchanger 525 the rest of the time, or intermittent, serving the ice builder 514 a part of the time that the rest of the apparatus is not operating and the heat exchanger 525 whenever required. Many factors are involved in the determining what type of operation is optimum. In any event, heat of compression from the apparatus 513 is transferred to a heat transfer fluid and rejected from the apparatus in an evaporative cooler 542.

A pump 543 circulates chilled water from the ice builder 514 to a heat exchanger 544, and back to the ice builder 514, while a pump 545 circulates water at, say, 58° F. (14° C.), from the heat exchanger 544 to the sprinkler grids 518 and back to the heat exchanger 544. Valves 546, which are controlled by temperature/humidity sensors and controllers 547, are modulated, as required, to maintain a desired temperature in the space served by each of the induction mixing units 519 by controlling the flow of heat transfer fluid through coils 548 in the induction mixing units 519 while blowers 549 cause recirculated room air that is ultimately mixed with primary conditioned air and returned to the rooms to flow over the coils 548. The temperature/humidity sensors and controllers 547 also modulate dampers 550 in the induction mixing units 519 so that primary, conditioned air delivered thereto maintains a desired humidity in the space served by each of the units 519.

The engine 526 is the main source for heat, in the apparatus of FIG. 22, for regeneration of desiccant in the regenerator 537. When the load on the compression refrigeration apparatus 513 is not sufficiently high, a supplemental heater 551 can be operated, as required, to transfer heat through a heat exchanger 552 to the storage tank 531 so that the heat needed for regeneration is available.

Figure 23:
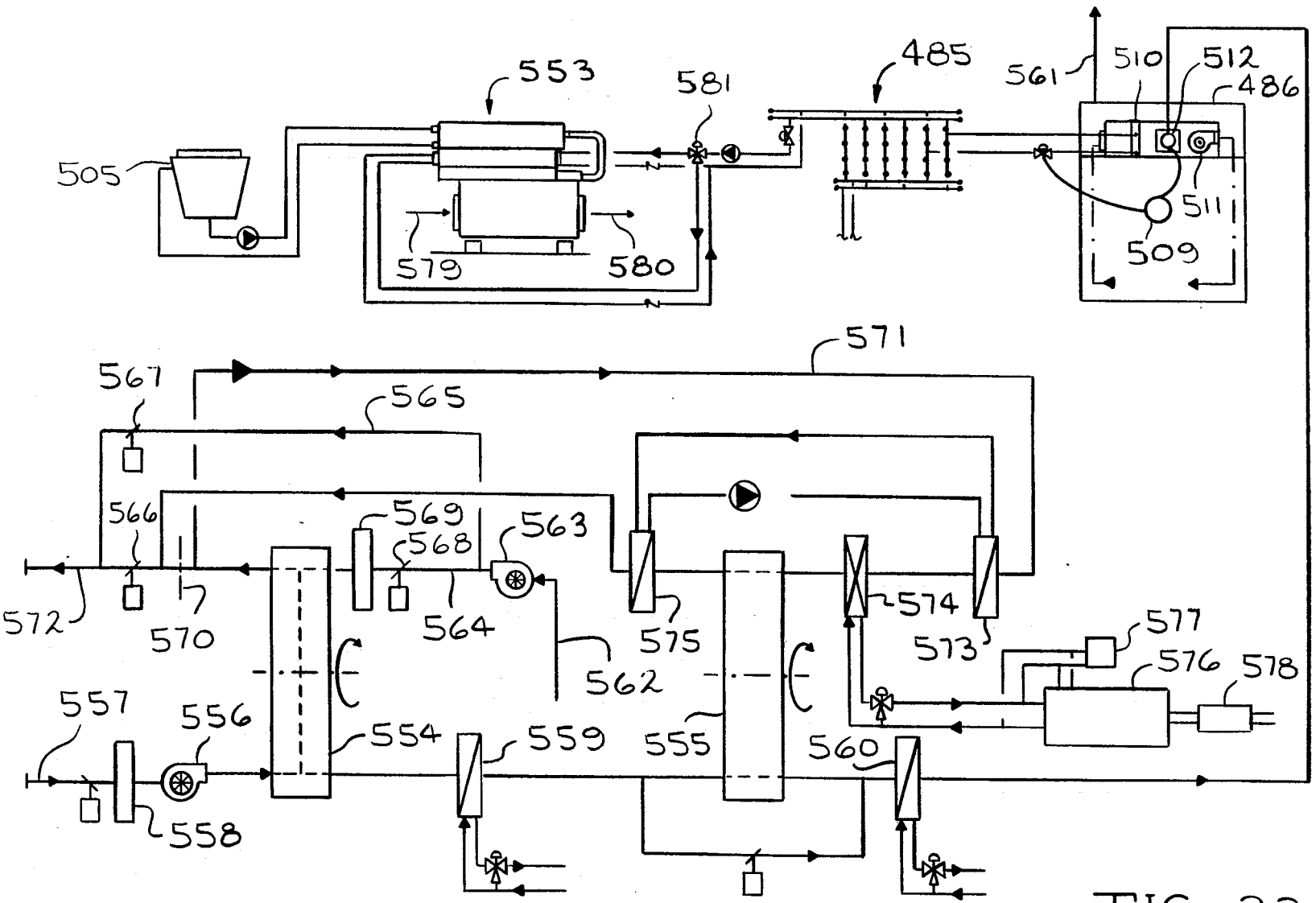
FIG. 23 is a schematic diagram showing apparatus similar to that of FIG. 22, differing mainly in that the circulating unit thereof is different from that of the FIG. 22 apparatus.

Apparatus shown in FIG. 23 is similar to that of FIG. 21 in that it comprises absorption refrigeration apparatus 553 that is similar to the apparatus 479, the plurality of sprinkler grids 485 (one of which is shown) and the plurality of induction mixing units 486 (one of which is shown), but differs in that the portion of the apparatus that conditions air for delivery to the induction mixing units 486 is composed of a desiccant wheel 554, a desiccant wheel 555, and associated apparatus.

A blower 556 causes ambient air to enter the apparatus as indicated by an arrow 557. The air flows through a filter 558, the blower 556, the desiccant wheel 554, a heat exchanger 559, the desiccant wheel 555, a heat exchanger 560, and then to the induction mixing units 486. The heat exchanger 559 can sometimes be omitted, in which case it is usually preferred that the heat exchanger 560 be operably connected to transfer heat to the evaporative cooler 505. When both heat exchangers 559 and 560 are used, it is usually preferred that both be operably connected to transfer heat to the absorption apparatus 553. The operation of the induction mixing units 486 is as previously described in the discussion of FIG. 21.

The desiccant wheels 554 and 555 are regenerated by relief air from the spaces served by the apparatus. An arrow 561 represents relief air leaving the space served by one of the induction mixing units 486, while an arrow 562 represents relief air from all of the spaces entering a blower 563. Air discharged from the blower 563 enters a duct 564, a duct 565, or both, depending upon the positions of dampers 566, 567 and 568. Air that enters the duct 564 flows through a filter 569, and a segment of the desiccant wheel 554 to an orifice plate 570. The orifice in the plate 570 is so sized that a portion of the air flowing in the duct 564 is forced to flow through a duct 571 while the rest flows through the orifice and is discharged as indicated by an arrow 572. Air which is forced to flow through the duct 571 is heated in heat exchangers 573 and 574, flows through a segment of the desiccant wheel 555, is cooled in a heat exchanger 575, and is then discharged. Heat is transferred to the heat exchanger 574 from a heat transfer fluid that is circulated through the cooling jacket of a gas engine 576 through a heat exchanger 577, through the heat exchanger 574 and back to the cooling jacket. The engine 576 drives an electric generator 578 which introduces electricity into the electric grid (not illustrated) of the building served by the apparatus.

The desiccant wheel 554, because relief air from the building served by the apparatus flows through a segment thereof, is capable of lowering both the enthalpy and the moisture content of ambient air whose humidity is high without requiring either heat for regeneration or the transfer of heat from the air being conditioned. For example, if relief air at a dry bulb temperature of 81° F. (27° C.), specific humidity 70 grains of water vapor per pound of dry air is introduced into the blower 563 while outside air at a dry bulb temperature of 93° F. (34° C.), specific humidity 105 grains of water vapor per pound of dry air, is introduced into the blower 556 at about the same rate, air entering the heat exchanger 559 has a dry bulb temperature of 84° F. (39° C.), specific humidity 78 grains of water vapor per pound of dry air, while air which enters the duct 571 or flows through the orifice plate 570 has a dry bulb temperature of 90° F. (32° C.), specific humidity 97 grains of water vapor per pound of dry air. By reference to a psychrometric chart, it can be ascertained that the foregoing relief air had an enthalpy of 30.4 Btu per pound of dry air, that the outside air had an enthalpy of 39.3 Btu per pound of dry air, that the air entering the duct 571 had an enthalpy of 37.2 Btu per pound of dry air, and that the air entering the heat exchanger 559 had an enthalpy of 32.5 Btu per pound of dry air. Thus, the enthalpy of the regenerating air increased by 7.2 Btu per pound of dry air, while that of the air that was dehumidified decreased by only 6.8 Btu per pound of dry air. This difference occurs because heat that is released in the desiccant wheel 554 as an incident of dehumidification therein is transferred to the desiccant, is retained while the wheel makes a half revolution, and then is released to the regenerating air. The heat that is released includes the heat of sorption and additional heat of the exothermic dehumidification by the desiccant of the dehumidifier.

When the apparatus of FIG. 23 includes, as shown, both the heat exchanger 559 and the heat exchanger 560, heat should be transferred from both to the absorption refrigeration apparatus 553. If the heat exchanger 559 is not used, it is then preferred to transfer heat from the exchanger 560 to the evaporative cooler 505.

The absorption apparatus 553 is directly fired, receiving gas fuel and discharging combustion products as indicated by arrows 579 and 580, respectively. It can also be used as a heater, furnishing warm water to the sprinkler grids 485 when a valve 581 is in one position and chilled water when the valve 581 is in the other position.

Figure 24:
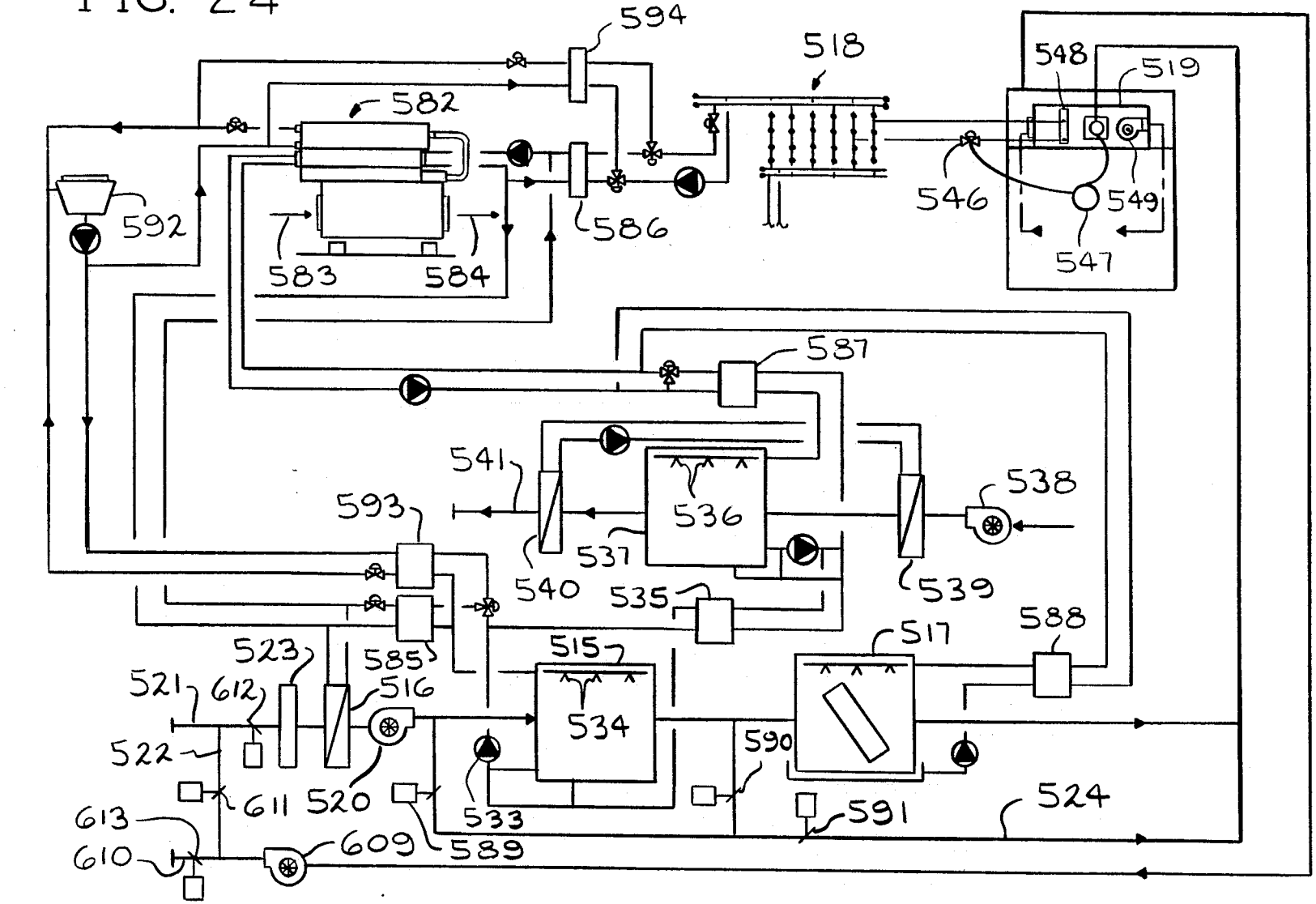
FIG. 24 is a schematic diagram showing apparatus similar to that of FIGS. 22 and 23, differing mainly in that a desiccant dehumidifier which is used to dehumidify the air of a plenum above a space to be conditioned takes the place of the circulating units of the apparatus of the latter FIGS.

Apparatus similar to that of FIG. 22 in that it includes the chemical dehumidifier 515, the precooling coil 516, the washer 517, the plurality of sprinkler grids 518 (one of which is shown), the plurality of induction mixing units 519 (one of which is shown), and associated apparatus, and differing mainly in that the gas engine 526, the compression refrigeration apparatus 513 and the ice builder 514 have been replaced by direct fired absorption refrigeration apparatus 582 is shown in FIG. 24. The absorption apparatus 582, which is fired by gas or other fuel, as indicated by an arrow 583, and discharges combustion products as indicated by an arrow 584, chills water which, under summer operation, is circulated to heat exchangers 585 and 586 and heats water which, under summer operation, is circulated to a heat exchanger 587 and, under winter operation, is circulated to a heat exchanger 588. The heat exchanger 587 serves the regenerator 537 by providing heat, as previously described, for regeneration of the desiccant therein. The heat exchanger 588 provides the heat required for humidification on winter cycle. Water that is sprayed in the washer 517 is circulated through the heat exchanger 588 where it is heated, as required, for humidification. Dampers 589, 590 and 591 are modulated, as required, so that, at the temperature at which water is sprayed in the washer 517, the amount of moisture required for humidity control is added to air which flows therethrough, while the rest of the air that is required for comfort conditioning is bypassed through the duct 524.

A cooling tower 592 serves the absorption apparatus 582 by rejecting heat therefrom, as required, and also serves heat exchangers 593 and 594, whenever outside conditions are such that it is possible, by rejecting heat therefrom to maintain the required temperatures in the sprinkler grids 518 and in the desiccant sprayed in the dehumidifier 515.

Figure 25:
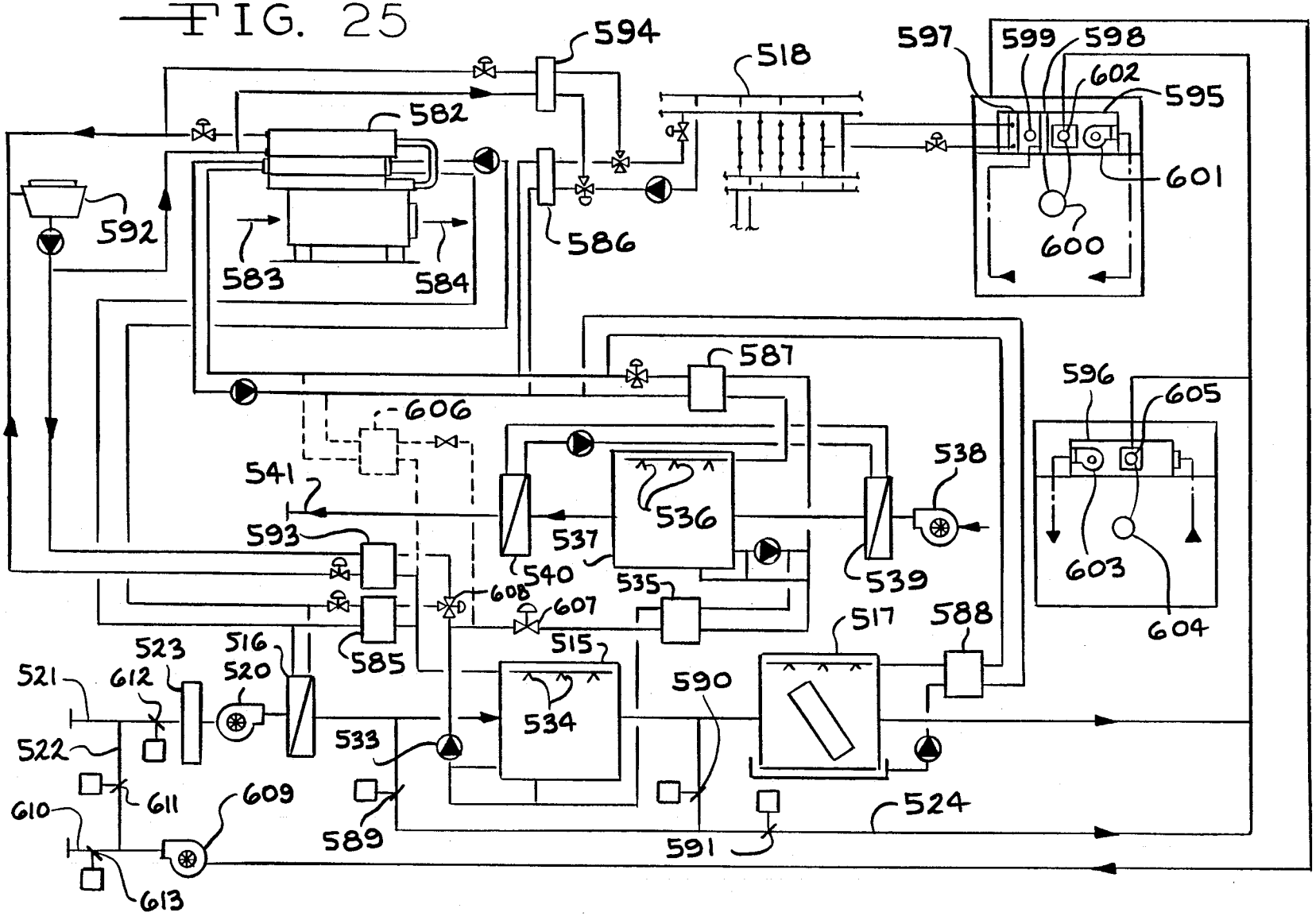
FIG. 25 is a schematic diagram showing apparatus according to the invention which includes absorption refrigeration apparatus and compression refrigeration apparatus to produce relatively high temperature chilled water to remove heat from air that is recirculated locally and from air that is conditioned centrally and circulated to spaces to be conditioned, a solid desiccant chemical dehumidifier to dehumidify air that is conditioned centrally and circulated, and a washer to transfer heat from air that is conditioned centrally and circulated.

Apparatus similar to that of FIG. 24 in that it includes the chemical dehumidifier 515, the precooling coil 516, the washer 517, the plurality of sprinkler grids 518 (one of which is shown), the absorption refrigeration apparatus 582, and the cooling tower 592, but differing in that the induction mixing units 519 are replaced by heat pump induction mixing units 595 which serve perimeter zones and by powered induction terminals 596 which serve interior zones is shown in FIG. 25. Heat can be removed from the fluid circulated through the sprinkler grids 518 either by the heat exchanger 594, in which case the heat is rejected directly by the cooling tower 592, or by the heat exchanger 586, in which case it is heat pumped by the absorption apparatus 582 to a higher temperature before it is rejected by the cooling tower 592.

The heat pump induction units 595 have condensers 597, compressors 598 and DX coils 599; under the control of temperature/humidity sensors and controllers 600 they pump heat between a heat transfer fluid which is circulated through the sprinkler grids 518 and air that blowers 601 withdraw from the spaces served by the units 595, and ultimately return, mixed with primary air. Heat is pumped from the circulated air when cooling is required, and to the air when heating is needed and, in both cases, the amount of cooling or heating is controlled to maintain a desired temperature. The temperature/humidity sensors and controllers 600 also modulate dampers 602 to maintain the humidity in the spaces served within predetermined limits.

The powered induction terminals 596 have blowers 603 which withdraw air from the spaces served by the terminals 596, and ultimately return a mixture of primary air and withdrawn air to the spaces. Temperature sensors and controllers 604 modulate dampers 605 to maintain the temperature in the spaces served within predetermined limits.

A heat exchanger 606 is operably connected to receive hot water from the absorption refrigeration apparatus 582. When a valve 607 is closed and a valve 608 is set appropriately, liquid desiccant can be pumped from the dehumidifier 515 to the heat exchanger 606 and heated desiccant solution can be pumped from the heat exchanger 606 to the nozzles 534, from which it can be sprayed to humidify air flowing through the dehumidifier 515.

All or a part of the return air from a blower 609, in the apparatus of FIGS. 22, 24 and 25, can be discharged from a duct 610, and the rest, if any, can flow through the duct 522 for mixture, as previously described, with air entering the duct 521. The proportions in which outside air and return air enter the blower 520 depend upon the settings of dampers 611, 612 and 613.

Figure 26:
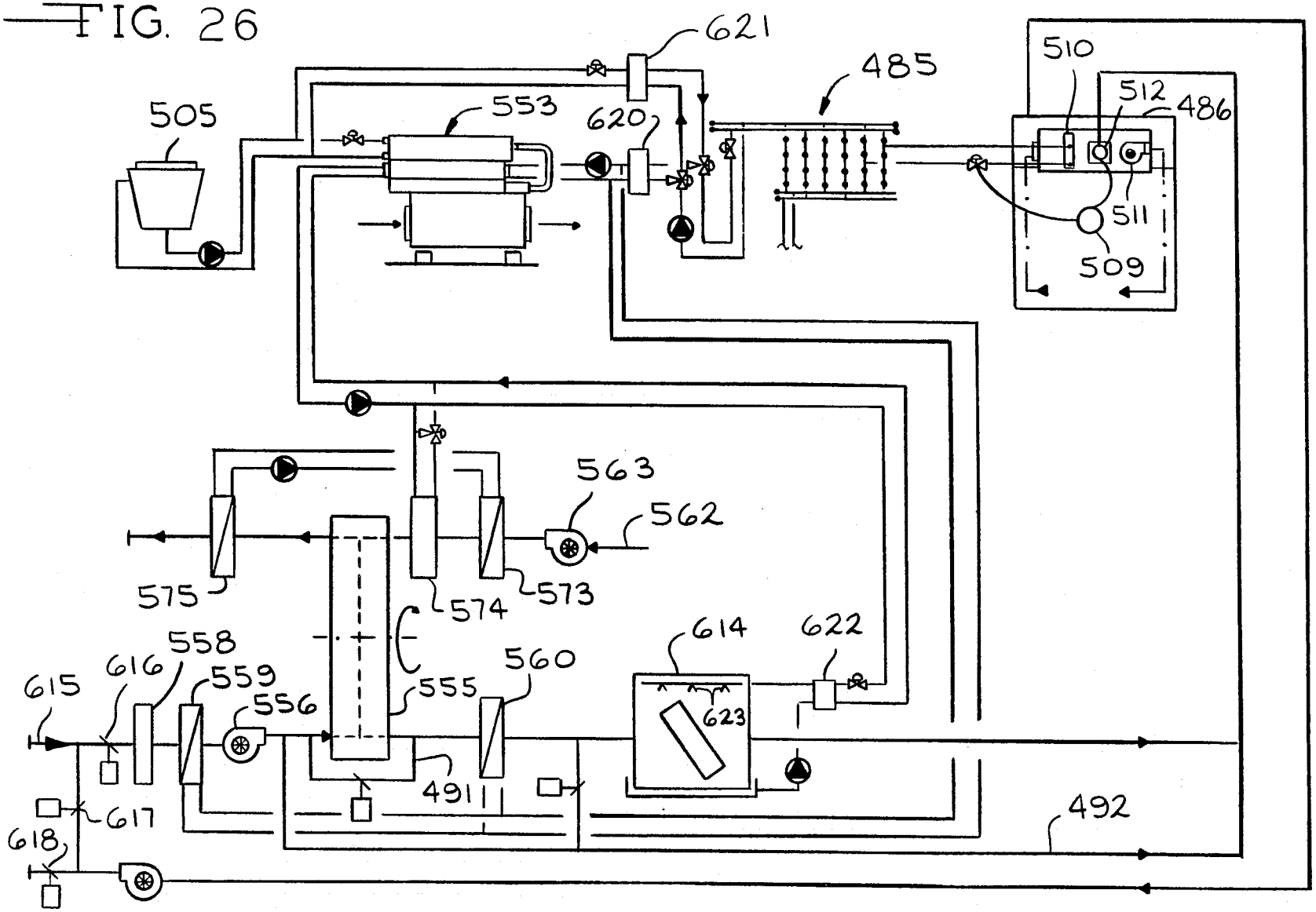
FIG. 26 is a schematic diagram showing apparatus according to the invention which is similar to that of FIG. 25, differing mainly in that the absorption refrigeration apparatus and solid desiccant chemical dehumidifier of the apparatus of FIG. 25 have been replaced in that of FIG. 26 by second compression refrigeration apparatus and a liquid desiccant chemical dehumidifier.

Apparatus similar to that of FIG. 23, differing mainly in that the desiccant wheel 554 has been omitted and a washer 614 has been added is shown in FIG. 26. On summer cycle, outside air enters the apparatus, as indicated by an arrow 615, and may, depending upon the positions of dampers 616, 617 and 618, be mixed with return air from a duct 619, flowing through the filter 558, the supply fan 556, the heat exchanger 559, the desiccant wheel 555, the heat exchanger 560, the washer 614 and to the induction mixing units 486 from which, as previously described, it is delivered to the spaces being air conditioned, as required for humidity control.

A heat transfer fluid at about 44° F. (7° C.) is circulated from a heat exchanger 620 or from a heat exchanger 621 through the sprinkler grids 485 to the coils 510 of the induction mixing units 486 and through the heat exchangers 560 and 559, and back to the heat exchanger. Whenever outside conditions are such that it is possible, it is preferable to use the heat exchanger 621 and to reject heat in the evaporative cooler 505, but it is necessary to use the heat exchanger 620 and the absorption refrigeration apparatus 553 whenever the evaporative cooler 505 is not capable of providing a heat exchange fluid at a sufficiently low temperature.

The apparatus will usually be operated so that the air leaving the heat exchanger 559 is at a temperature of about 51° F. (11° C.); under many conditions of operation, the air will also be saturated, containing about 51 grains of water vapor per pound of dry air, because the mixture entering the heat exchanger 559 has a higher moisture content. The air can be dehumidified and heated in the desiccant wheel 555 so that it enters the heat exchanger 560 at a moisture content of about 10 grains of water vapor per pound of dry air and at a dry bulb temperature of about 100° F. (38° C.), cooled by the heat exchanger 560 to about 51° F. (11° C.), and cooled and humidified in the washer 614 so that it leaves at a dry bulb temperature of about 40° F. (4° C.) and containing about 38 grains of water vapor per pound of dry air.

A heat transfer fluid is circulated from the absorption refrigeration apparatus 553 to the heat exchanger 574 and back, and the absorption apparatus 553 is controlled as required to provide the heat necessary for regeneration of the desiccant of the wheel 555. As previously stated, the combustion of gas in the apparatus 553 makes both chilled water and heated water available; further, the apparatus 553 can be controlled to vary the proportions of heated water and chilled water it makes available, and even to reduce the proportion of chilled water to zero. The absorption apparatus 553 is capable, therefore, of providing the heat necessary for regeneration of the desiccant of the wheel 555 even when the outside conditions are such that it is not necessary to remove heat from the exchanger 620.

The by-pass ducts 491 and 492 of the apparatus of FIG. 21 are also included in the apparatus of FIG. 26, and for the same purpose. In addition, a heat exchanger 622 is operably connected to receive heat from the absorption refrigeration apparatus 553 and to transfer heat to water that is flowing to nozzles 623 to be sprayed in the washer 614. This enables the washer 614 to function as a humidifier on winter cycle.

Figure 27:
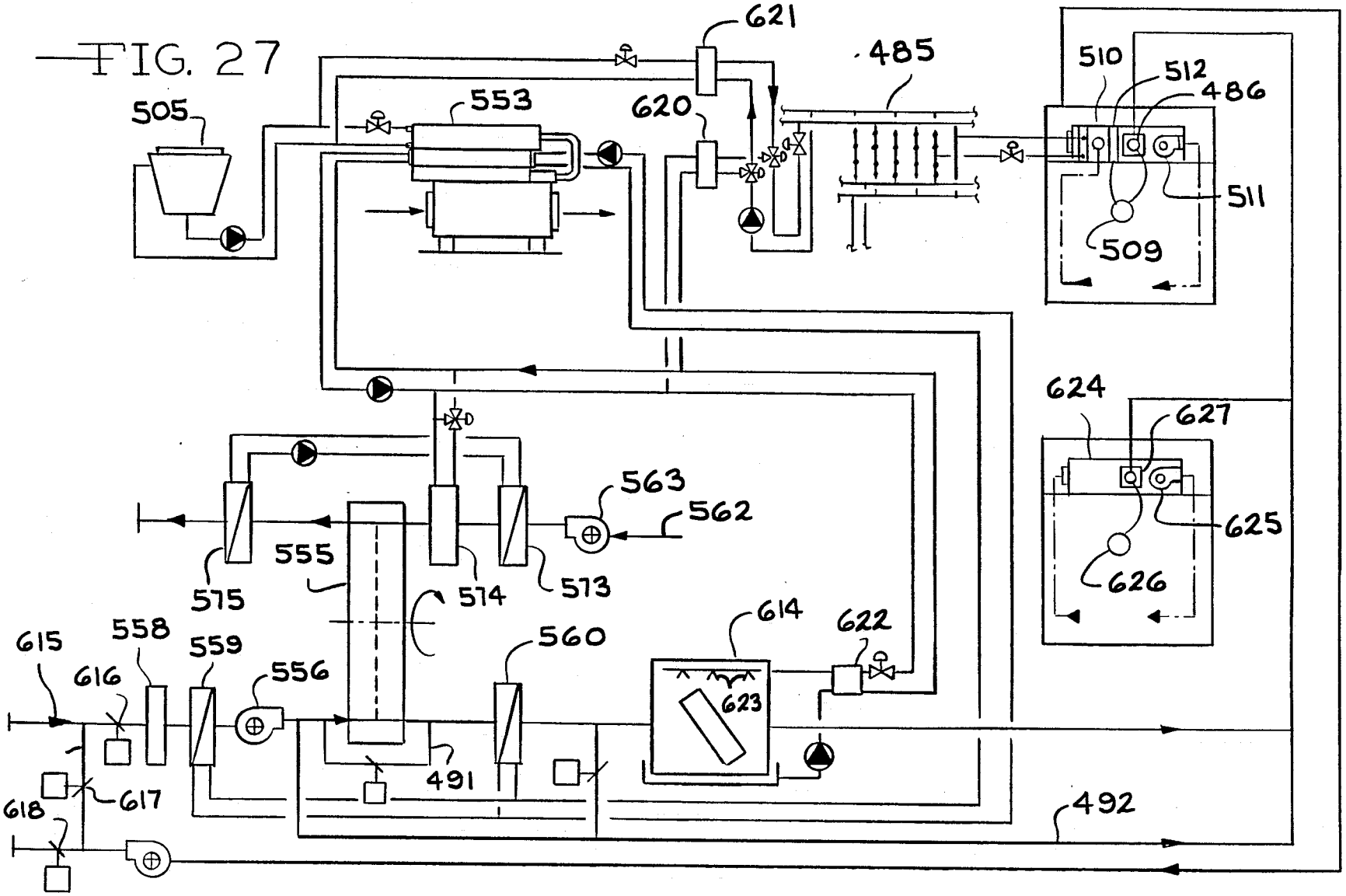
FIG. 27 is a schematic diagram showing apparatus according to the invention which is similar to that of FIG. 25, differing mainly in that a second stage solid desiccant chemical dehumidifier has been added, and the compression refrigeration apparatus has been eliminated.

Apparatus shown in FIG. 27 is identical with that of FIG. 26 and, in addition, includes powered induction terminals 624 (one of which is shown) to serve interior zones. The powered induction terminals 624 have blowers 625 which withdraw air from the spaces served by the terminals 627, and ultimately return a mixture of primary air and withdrawn air to the spaces. Temperature sensors and controllers 626 modulate dampers 627 to maintain the temperature in the spaces served within predetermined limits. The induction mixing units 486 serve perimeter zones of the apparatus, where there are large changes in load during the course of a typical day, and where there are, from time to time, zones which require heating while other zones require cooling.

Figure 28:
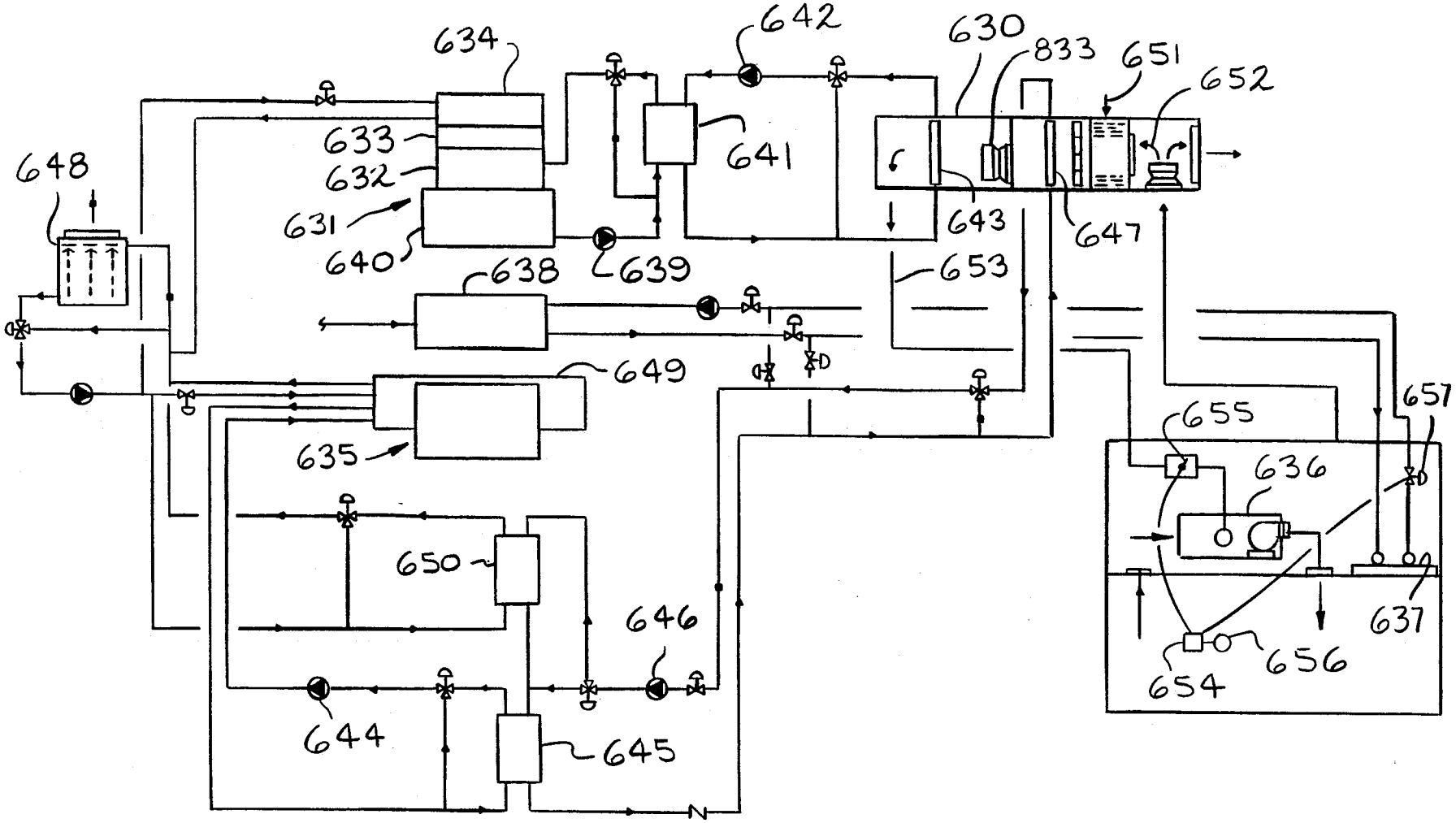
FIG. 28 is a schematic diagram showing heating, ventilating and air conditioning apparatus according to the invention which comprises a chemical dehumidifier, a precooling coil, a washer, a plurality of sprinkler grids, a plurality of induction mixing units, and direct fired absorption refrigeration apparatus.

Apparatus comprising an air handler 630, an ice maker indicated generally at 631 and comprising an evaporator 632, a compressor 633 and a condenser 634, compression refrigeration apparatus 635, a plurality of induction mixing units 636, a plurality of radiant panels 637 and a hot water boiler 638 is shown in FIG. 28. On summer cycle, the ice maker 631 operates at times when its use of electricity does not contribute to a demand charge, making ice which is used when air conditioning is required by the building served by the apparatus to chill water which is circulated by a pump 639 from an ice storage tank 640 of the ice maker 631 to a heat exchanger 641, to the evaporator 632 and back to the ice storage tank 640. Chilled water is circulated by a pump 642 from the heat exchanger 641 to a primary cooling coil 643 in the air handler 630 and back to the heat exchanger 641. Chilled water at a higher temperature, say 55° F. (21° C.), is circulated by a pump 644 from the compression refrigeration apparatus 635 to a heat exchanger 645 and back to the compression refrigeration apparatus 635, while a heat transfer fluid is circulated by a pump 646 from the heat exchanger 645 to a precooling coil 647 in the air handler 630 and back to the heat exchanger 645 and, in another stream, to the radiant panels 637 and back to the heat exchanger 645. The apparatus also includes a cooling tower 648 which is operably connected to transfer heat from the condenser 634 of the ice maker 631, from a condenser 649 of the compression refrigeration apparatus 635, and from a heat exchanger 650. Whenever ambient conditions make it appropriate, the pump 646 circulates a heat transfer fluid from the heat exchanger 650 to the precooling coil 647 and to the radiant panels 637, so that heat therefrom is transferred to the cooling tower 648.

In operation, outside air as indicated by an arrow 651, and return air as indicated by an arrow 652, mix in the air handler 630 and, after flowing in heat transfer relationship with the precooling coil 647 and with the primary cooling coil 643, the mixture enters ducts 653, one of which is shown in FIG. 28, from which it is delivered to the induction mixing units 636. Controllers 654 modulate dampers 655 in response to signals from thermostat-humidistat sensors 656 so that the air from the ducts 653 provides humidity control in the spaces served by the induction mixing units 636. The controllers 654 also modulate valves 657 in response to signals from the thermostat-humidistat sensors 656 so that chilled water in the radiant panels 637 provides temperature control in the spaces. An over ride can also be provided, so that the dampers 655 are modulated for temperature control in spaces where the temperature is too high with the relevant valves fully open. The foregoing mode of operation of the controllers 654 is preferred, but it is also possible to program them to modulate the dampers 655 for temperature control, leaving the valves 657 closed except when a temperature above the set point is sensed with the associated damper in a full open position, and then modulating the associated valve 657 for temperature control with the damper 655 fully open.

On winter cycle, heated water from the hot water boiler 638 is circulated to the radiant panels 637 and to the coil 647 as required for heating.

Figure 29:
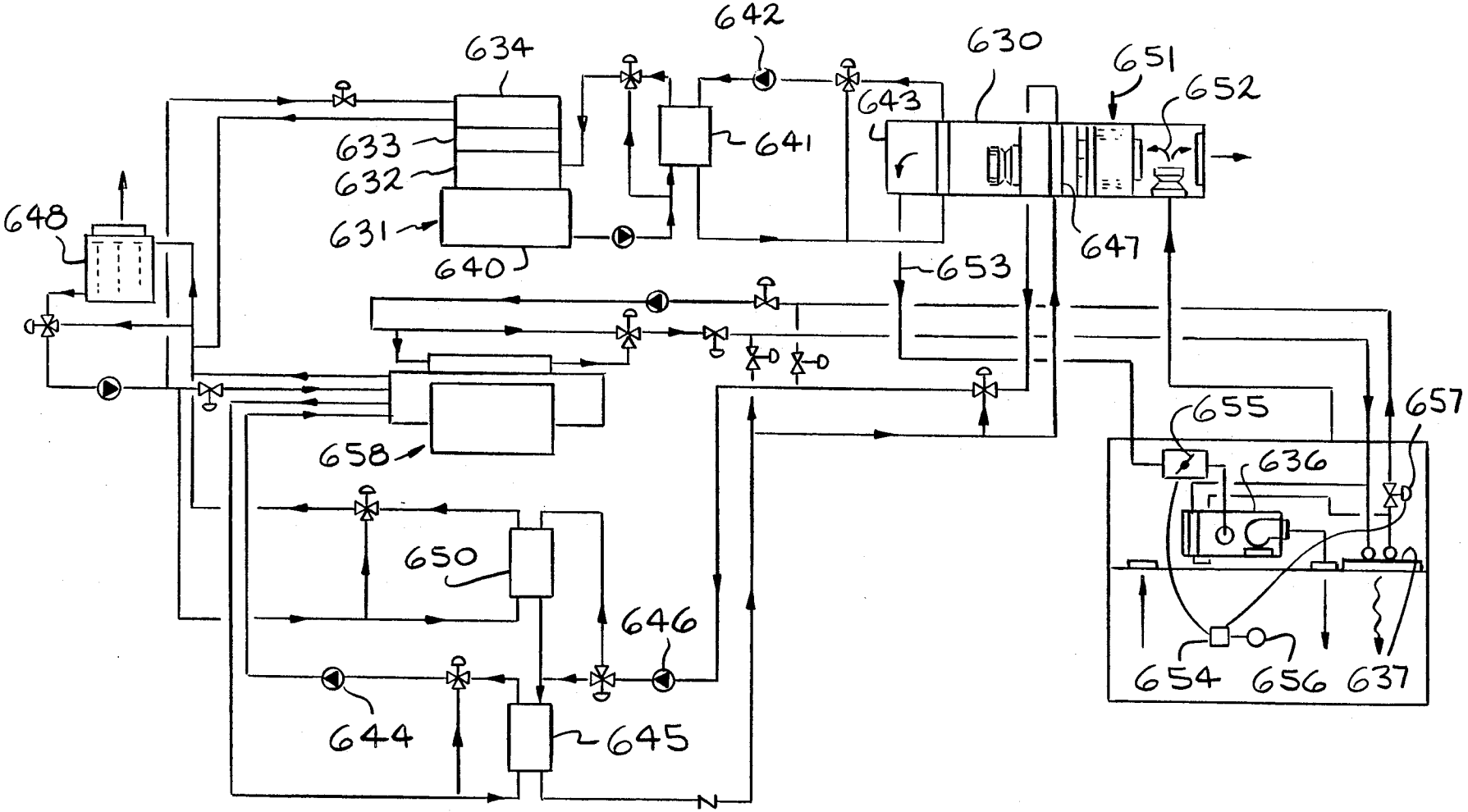
FIG. 29 is a schematic diagram showing apparatus similar to that shown in FIG. 28, differing in that it additionally includes induction mixing units of a different kind.

Apparatus that is substantially the same as that of FIG. 28, except that the hot water boiler 638 and the compression refrigeration apparatus 635 have been replaced by a direct fired absorption chiller/heater 658 is shown in FIG. 29. The operation of the apparatus of FIG. 29 is the same as that of the apparatus of FIG. 28.

Figure 30:
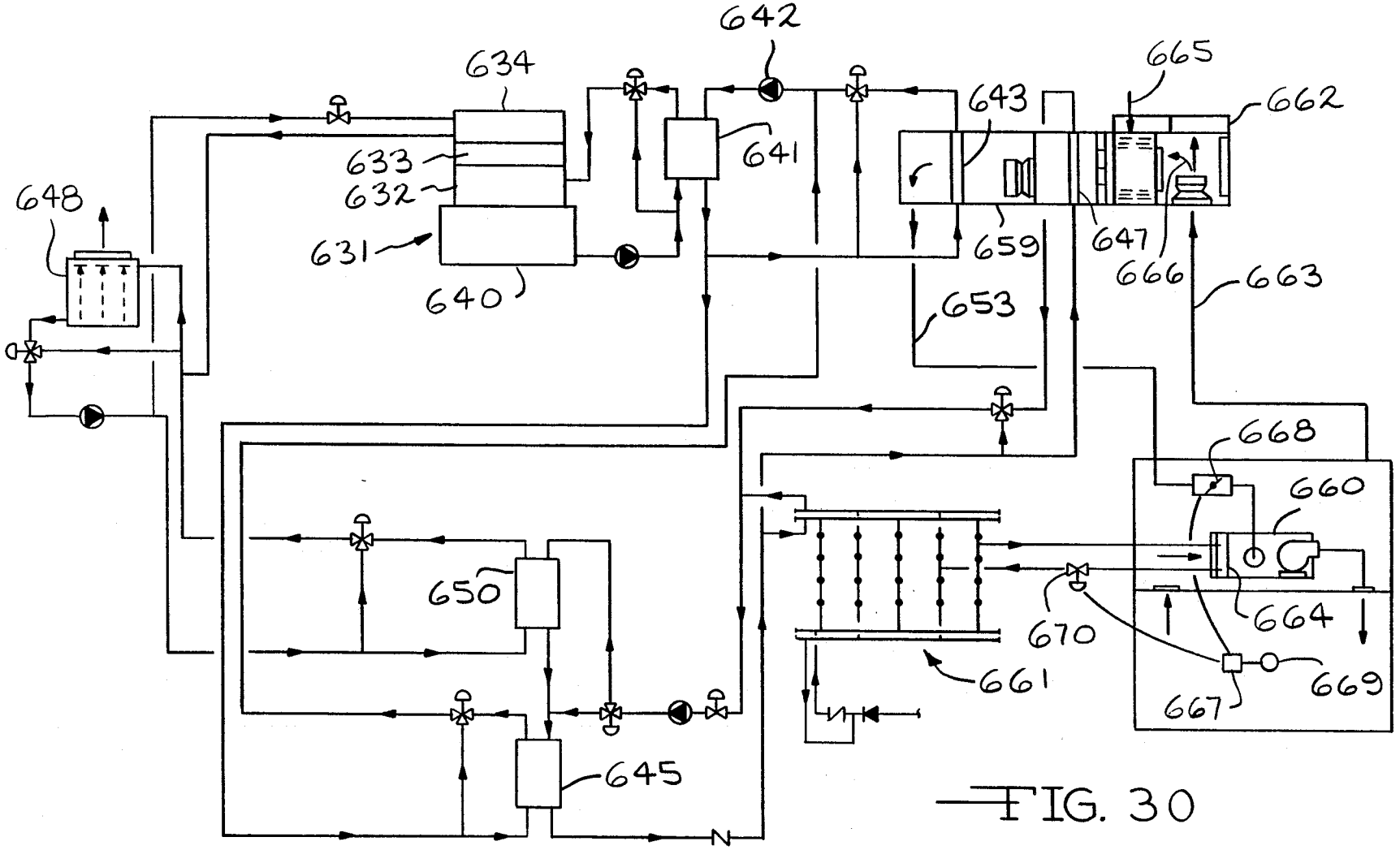
FIG. 30 is a schematic diagram showing apparatus similar to that shown in FIG. 28, differing mainly in that a desiccant wheel has been omitted and a washer has been added.

Apparatus comprising an air handler 659, the ice maker 631, a plurality of induction mixing units 660, the heat exchangers 641, 645 and 650 and a sprinkler grid indicated generally at 661 is shown in FIG. 30. The air handler 659 is similar to the air handler 630 of FIGS. 28 and 29, including the precooling coil 647 and the primary cooling coil 643, heat being transferred from the former to the heat exchanger 645 or to the heat exchanger 650, and from the latter to the heat exchanger 641, but differs in additionally including a desiccant wheel 662. Building return air flows through a duct 663 to the air handler 659; some of the return air flows through a segment of the desiccant wheel 662 as relief air, while a mixture of outside air with the rest of the return air flows in heat transfer relationship with the precooling coil 647 and with the primary coil 643, and then through the ducts 653 to the induction mixing units 660. Because of its low enthalpy, the relief air which flows through the desiccant wheel 662 removes water from the desiccant of the wheel, enabling it to dehumidify humid outside air which flows through another segment thereof to a humidity ratio of about 80 grains of water vapor per pound of dry air.

Chilled water or other heat transfer fluid is circulated from the heat exchanger 641 to the primary coil 643 of the air handler 659 and back, and to the heat exchanger 645 and back. Heat from the precooling coil 647 and from coils 664 in the induction mixing units 660 is transferred either to the heat exchanger 650 and to the cooling tower 648 or to the heat exchanger 645 and to the heat exchanger 641.

In operation, outside air as indicated by an arrow 665, and return air as indicated by an arrow 666, mix in the air handler 659 and, after flowing in heat transfer relationship with the precooling coil 647 and with the primary cooling coil 643, the mixture enters ducts 653, one of which is shown in FIG. 30, from which it is delivered to the induction mixing units 660. Controllers 667 modulate dampers 668 in response to signals from thermostat-humidistat sensors 669 so that the air from the ducts 663 provides humidity control in the spaces served by the induction mixing units 660. The controllers 667 also modulate valves 670 in response to signals from the thermostat-humidistat sensors 669 so that chilled water in the coils 664 in the induction mixing units 660 provides temperature control in the spaces. An over ride can also be provided, so that the dampers 668 are modulated for temperature control in spaces where the temperature is too high with the relevant valves fully open. The foregoing mode of operation of the controllers 667 is preferred, but it is also possible to program them to modulate the dampers 668 for temperature control, leaving the valves 670 closed except when a temperature above the set point is sensed with the associated damper in a full open position, and then modulating the associated valve 670 for temperature control with the damper 668 fully open.

Figure 31:
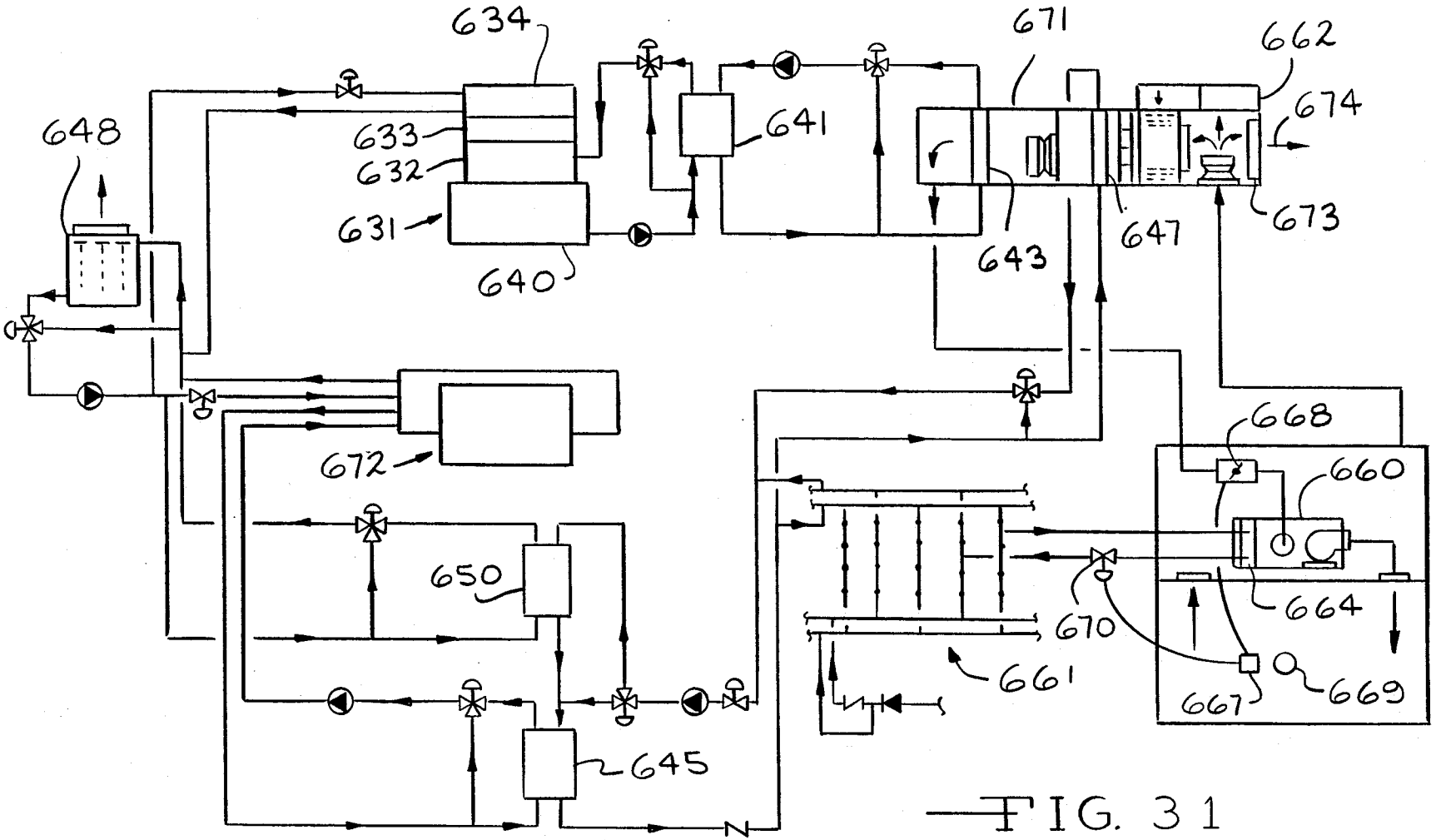
FIG. 31 is a schematic diagram showing apparatus similar to that shown in FIG. 30, differing in that it additionally includes induction mixing units of a different kind.

Apparatus comprising an air handler 671, the ice maker 631, a plurality of the induction mixing units 660, the heat exchangers 641, 645 and 650, gas absorption refrigeration apparatus 672, and the sprinkler grid indicated generally at 661 is shown in FIG. 31. The air handler 671 is similar to the air handler 659 of the apparatus of FIG. 30, including the precooling coil 647, the primary cooling coil 643, and the desiccant wheel 662, but differs in that some of the relief air is discharged through the desiccant wheel 662 while the rest is discharged through an outlet 673, as indicated by an arrow 674. Heat from the precooling coil 647 and from the coils 664 in the induction mixing units 660 is transferred to the heat exchanger 645 or to the heat exchanger 650 while heat from the primary cooling coil 643 is transferred to the heat exchanger 641. The operation of the apparatus of FIG. 31 is the same as that of the apparatus of FIG. 30.

Figure 32:
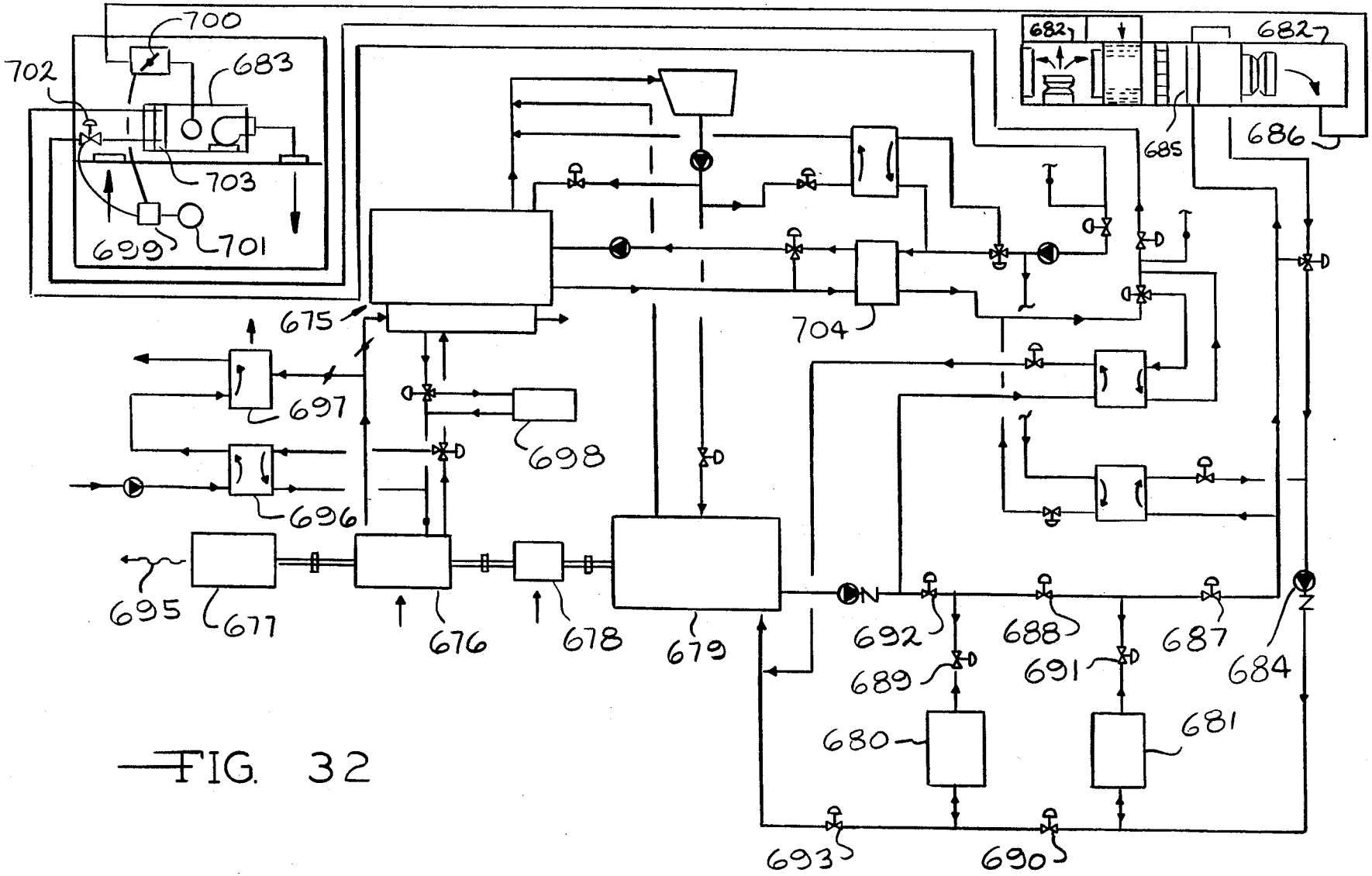
FIG. 32 is a schematic diagram showing apparatus similar to that shown in FIG. 1, differing mainly in that induction mixing units of the FIG. 32 apparatus omit secondary cooling coils and the apparatus additionally includes radiant panels for secondary cooling.

Apparatus shown in FIG. 32 comprises a gas absorption chiller 675, a gas engine 676, a generator 677, a motor 678 operatively connected to drive the compressor (not separately illustrated) of a glycol chiller 679, two ice makers 680 and 681 connected in parallel, an air handler 682, and a plurality of induction mixing units 683 (one of which is shown in FIG. 32). When air conditioning is required in the building served by the apparatus of FIG. 32, a pump 684 circulates cold water from one or both of the ice makers 680 and 681, both of which are stocked with ice, to a coil 685 of the air handler 682 and back, while a mixture of return air from the building and outside air flows in heat transfer relationship with the coil 685, into a duct 686 and is delivered to the induction mixing units 683. Preferably, valves 687, 688, 689, and 690 are open and valves 691, 692 and 693 are closed, so that the water flow is through the ice maker 680 until the ice therein is depleted. Thereupon, the valves 688 and 690 are closed; the valves 691, 692 and 693 are opened; and the motor 678 and a pump 694 are energized, so that the glycol chiller produces ice in the ice maker 680 while ice in the ice maker 681 is used to remove heat from the water that is circulated to the coil 685 of the air handler 682. While the motor 678 is driven by electricity, the use of which would ordinarily contribute to the demand charge, the gas engine 676 is also operated to drive the generator 677, producing electricity as indicated by an arrow 695. The electricity from the generator 677 is introduced into the building grid (not illustrated), more than compensating for that used to operate the glycol generator 679.

Exhaust heat from the gas engine 676 is transferred into generating relationship with the gas absorption chiller 675, any excess being used in heat exchangers 696 and 697 to heat water, or being transferred from the system in a radiator 698.

The operation of the induction mixing units 683 in the apparatus of FIG. 32 is the similar to the operation of the induction mixing units 660 in the apparatus of FIG.

31. Controllers 699 modulate dampers 700 in response to signals from thermostat-humidistat sensors 701 so that the air from the ducts 686 provides humidity control in the spaces served by the induction mixing units 683. The controllers 699 also modulate valves 702 in response to signals from the thermostat-humidistat sensors 701 so that chilled water circulated in the coils 703 in the induction mixing units 683 provides temperature control in the spaces. An over ride can also be provided, so that the dampers 700 are modulated for temperature control in spaces where the temperature is too high with the relevant valves fully open. The foregoing mode of operation of the controllers 699 is preferred, but it is also possible to program them to modulate the dampers 700 for temperature control, leaving the valves 702 closed except when a temperature above the set point is sensed with the associated damper in a full open position, and then modulating the associated valve 702 for temperature control with the damper 700 fully open. Heat can be removed from the coil 703 by circulating a heat transfer fluid thereto from a heat exchanger 704 and back to the coil 703. Heat is transferred from the heat transfer fluid so circulated to chilled water circulated to the heat exchanger 704 from the gas absorption chiller 675 and back to the heat exchanger.

Figure 33:
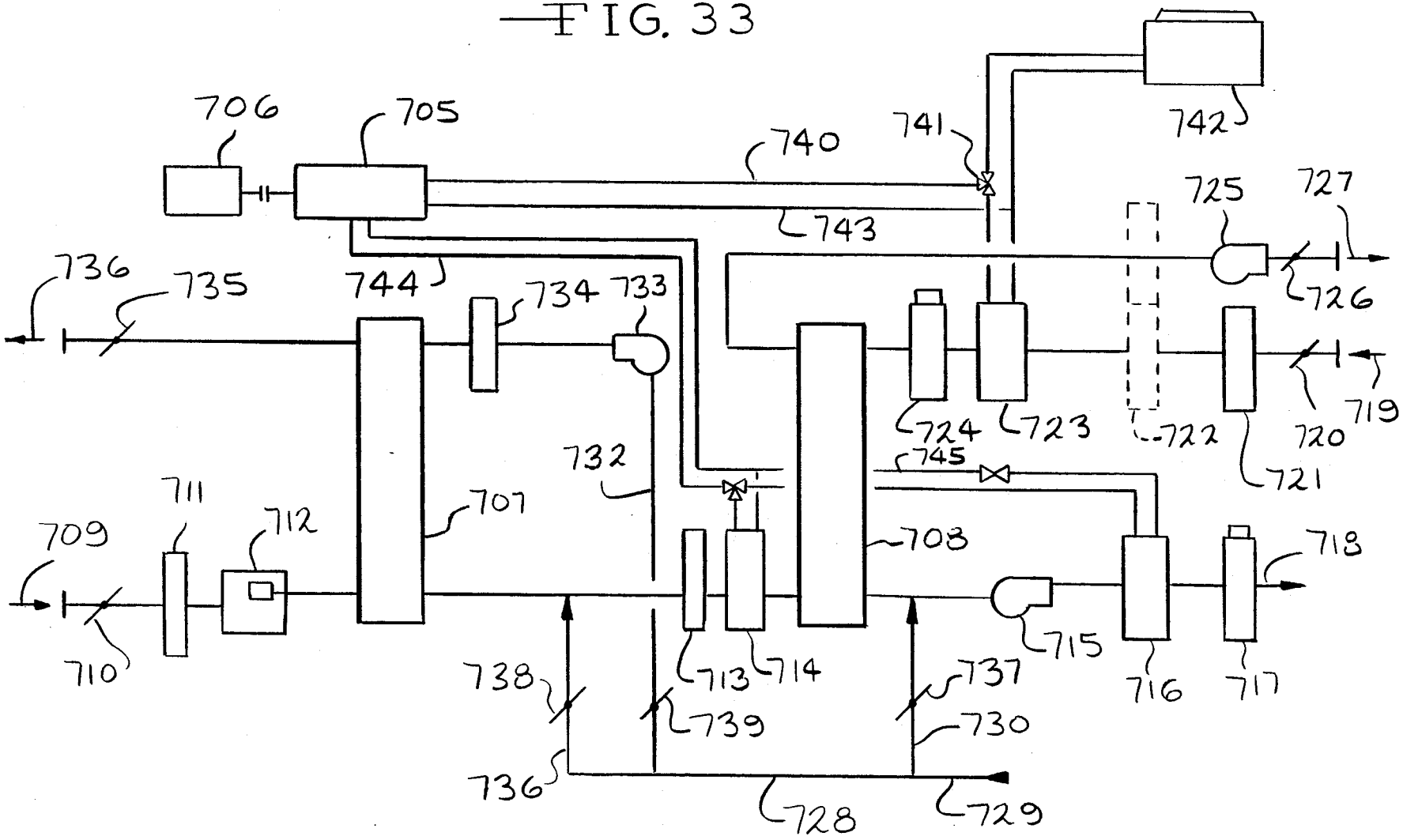
FIG. 33 is a schematic diagram showing apparatus similar to that of FIG. 32, differing mainly in that a direct-fired boiler has been eliminated and an absorption chiller/heater has been substituted for an electric chiller.

Apparatus comprising compression refrigeration apparatus 705, a motor 706 connected in driving relationship with the apparatus 705, first and second desiccant dehumidifiers 707 and 708, various heat exchange devices, and incidental components is shown in FIG. 33. Air to be conditioned enters the apparatus as indicated by an arrow 709, flowing past a damper 710, through a filter 711, a constant volume regulator 712, the first desiccant dehumidifier 707, a filter 713, a precooling coil 714, the second desiccant dehumidifier 708, a blower 715, a final cooling coil 716 and a gas-fired heater 717, and then being delivered to a space to be conditioned as indicated by an arrow 718.

The desiccant dehumidifiers 707 and 708 are segmented wheels which rotate when in operation, so that air entering the apparatus as described above flows through and is dehumidified by desiccant in successive segments of the wheels, while regenerating air which enters the apparatus as subsequently described flows through and regenerates the desiccant in successive segments of the wheels. The desiccant can be activated alumina, silica gel, a hygroscopic salt such as lithium chloride, calcium chloride or the like on paper or another carrier.

Regenerating outside air enters the FIG. 33 apparatus as indicated by an arrow 719, flowing past a damper 720, through a filter 721, an air to air heat exchanger 722, a reactivation heating coil 723, a gas-fired heater 724, the second desiccant dehumidifier 708, the air to air heat exchanger 722 and a blower 725, and then past a damper 726 before being vented from the apparatus as indicated by an arrow 727.

Return air from the building served by the apparatus of FIG. 33, which flows through a duct 728 as indicated by an arrow 729, can return to the apparatus from a duct 730, can return to the apparatus from a duct 731, or can flow through a duct 732, a blower 733, a filter 734 and the desiccant wheel 707 before flowing around a damper 735 and being vented as indicated by an arrow 736. The flow of air through the ducts 730, 731 and 732 is controlled by dampers 737, 738 and 739.

The first desiccant dehumidifier 707, in the apparatus of FIG. 33, acts as what has been called an enthalpy exchanger; because of its low enthalpy, the return air from the building which flows therethrough is capable of removing moisture from, or regenerating, the desiccant to a limited extent, and without the necessity for adding heat to the air.

The second desiccant dehumidifier 708 is regenerated by outside air which is heated by heat transfer thereto from hot refrigerant in the reactivation heating coil 723, in the gas fired heater 724, or in both. The compression refrigeration apparatus 705 has a compressor (not separately illustrated) which is driven by the motor 706; this compresses and heats the refrigerant and causes it to flow through a line 740 to a three way valve 741 which directs it either to an air cooled condensing unit 742 or to the reactivation heating coil 723. Heat is transferred from the refrigerant in the condensing unit 742 or in the heating coil 723, being rejected from the apparatus in the former case, and being transferred to regenerating air in the latter. It is usually preferred that the valve 741 be modulated to maintain the air leaving the heating coil 723 at a required temperature, and to reject any excess heat in the condensing unit 742; in the alternative, if there is insufficient heat for regeneration, the gas fired heater can be used as required to maintain the regenerating temperature. In either event, cooled refrigerant is returned to the apparatus 705, flowing through a line 743.

Cooled refrigerant flows through a line 744 from the apparatus 705 to the precooling coil 714 and to the final cooling coil 716, being expanded in each to maintain a predetermined air temperature at the exit side thereof. Finally, expanded refrigerant returns through a line 745 to the suction side of the compressor of the apparatus 705.

The gas fired heater 717 is used on winter cycle to heat conditioned air before it enters the space served by the apparatus.

Figure 34:
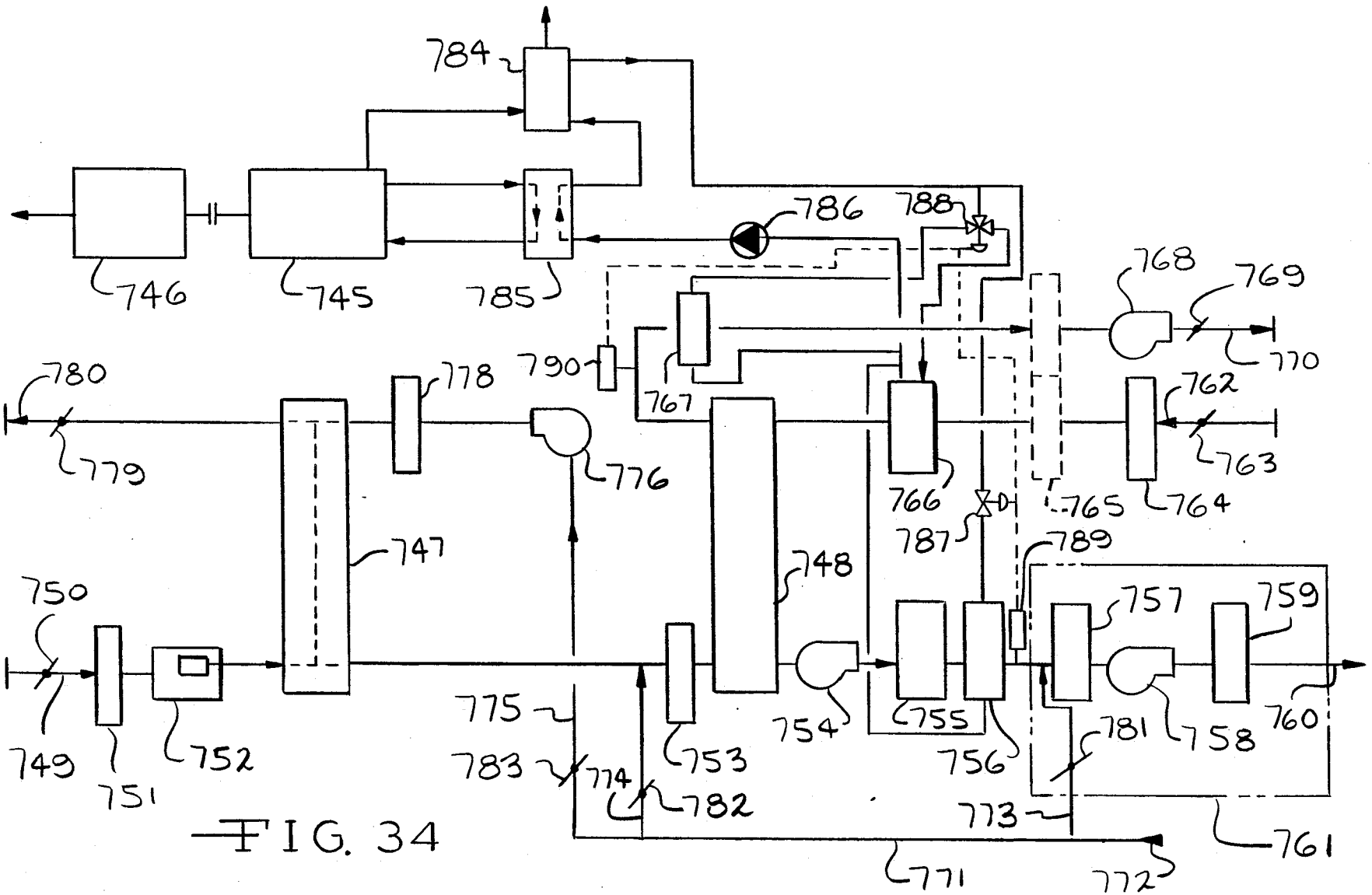
FIG. 34 is a schematic diagram showing apparatus similar to that of FIG. 1 which includes an air handler equipped with an enthalpy wheel.

Apparatus comprising a gas engine 745 operably connected in driving relationship with an electric generator 746, first and second desiccant dehumidifiers 747 and 748, various heat exchange devices, and incidental components is shown in FIG. 34. Air to be conditioned enters the apparatus as indicated by an arrow 749, flowing past a damper 750, through a filter 751, a constant volume regulator 752, the first desiccant dehumidifier 747, a filter 753, the second desiccant dehumidifier 748, a blower 754, an evaporative cooler, a heating coil 756, a filter 757, a blower 758 and a cooling coil before being delivered to a space to be conditioned as indicated by an arrow 760. The apparatus of FIG. 34 is intended to be a combination of existing equipment (enclosed within a fantom line 761) and equipment to be added in making a retrofit installation.

The desiccant dehumidifiers 747 and 748 (FIG. 34) and the desiccant dehumidifiers 707 and 708 (FIG. 33) are identical in construction and operation.

Regenerating outside air enters the FIG. 34 apparatus as indicated by an arrow 762, flowing past a damper 763, through a filter 764, an air to air heat exchanger 765, a reactivation heating coil 766, the second desiccant dehumidifier 748, a dump coil 767, the air to air heat exchanger 765 and a blower 768, and then past a damper 769 before being vented from the apparatus as indicated by an arrow 770.

Return air from the building served by the apparatus of FIG. 34, which flows through a duct 771 as indicated by an arrow 772, can return to the apparatus from a duct 773, can return to the apparatus from a duct 774, or can flow through a duct 775, a blower 776, a filter 778 and the desiccant wheel 747 before flowing around a damper 779 and being vented as indicated by an arrow 780. The flow of air through the ducts 773, 774 and 775 is controlled by dampers 781, 782 and 783.

Gaseous exhaust from the gas engine 745 is directed through a heat exchanger-silencer 784 while cooling jacket water is circulated from the engine 745, through a heat exchanger 785 and back. A pump 786 circulates a heat transfer fluid from the heat exchanger 785, through the heat exchanger-silencer 784, in parallel, through the heating coil 756, through the reactivation heating coil 766 and through the dump coil 767, and back to the pump 786. The flow of the heat transfer fluid through the heating coil 756, through the reactivation heating coil 766 and through the dump coil 767 is controlled by valves 787 and 788, which are set by thermostat-controllers 789 and 790. The heating coil 756 is used when it is necessary to introduce heat into the space served by the apparatus, for example, on winter cycle. The reactivation heating coil 766 is used as required to provide heat for regeneration of the desiccant of the wheel 748, and any excess heat is transferred to the air which flows through the dump coil 767.

Figure 35:
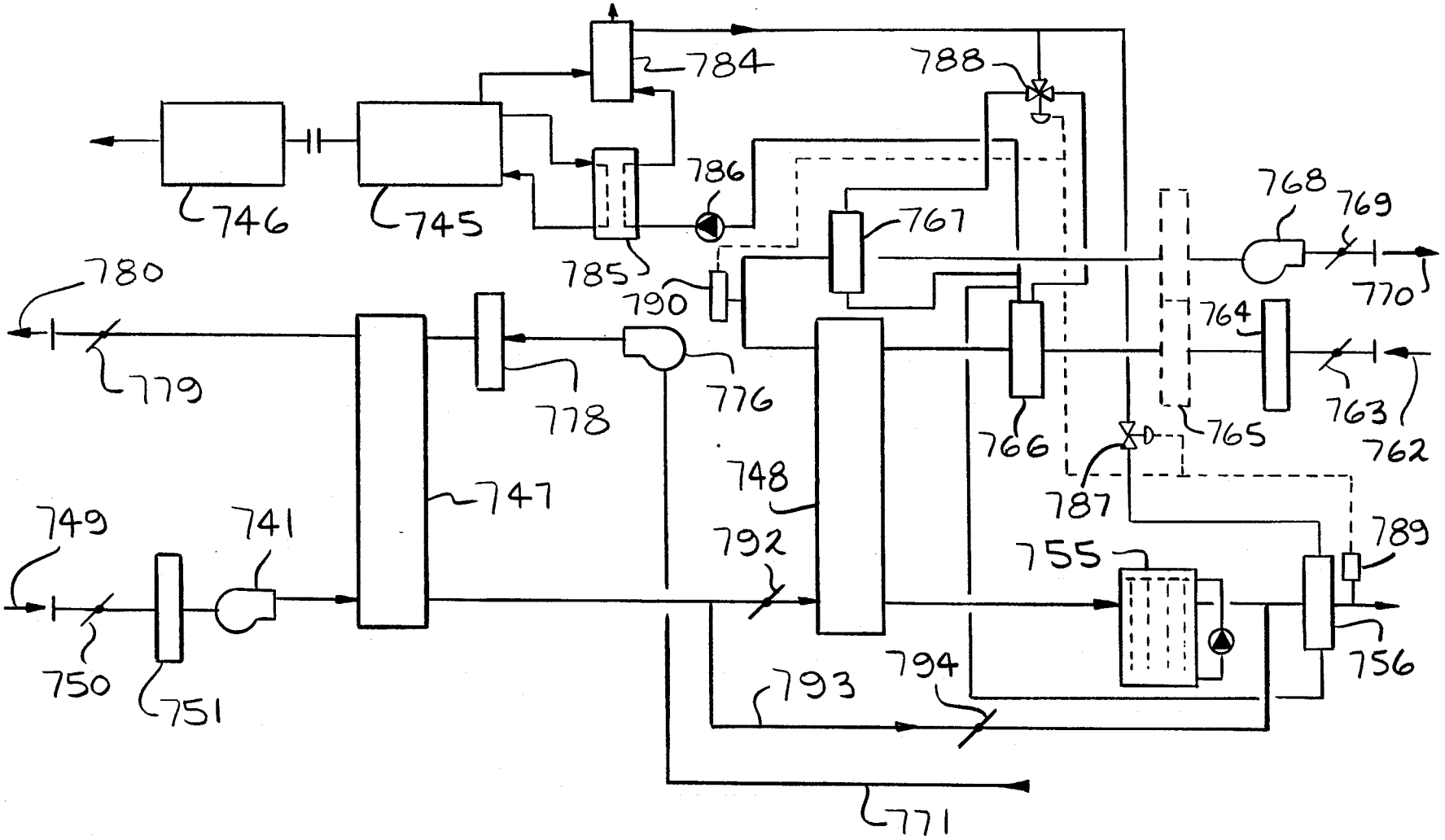
FIG. 35 is a schematic diagram showing apparatus similar to that of FIG. 34, differing mainly in that a gas absorption chiller has been added.

Apparatus shown in FIG. 35, as indicated by the use of the same reference numerals, is substantially identical with that of FIG. 34, the differences being that the phantom line 761 and the apparatus therein, the blower 754, and the ducts 773 and 774 are omitted from the FIG. 35 apparatus, the constant volume regulator 752 has been replaced by a blower, and a damper 792, a by-pass duct 793 and a damper 794 therein have been added. The by-pass duct 793, which is around the desiccant wheel 748 and the evaporative cooler 755, can be used at times when the ambient humidity is relatively low, so that it is not necessary to dehumidify all of the air that is delivered to the space served. Otherwise, the operation of the apparatus is the same as that of the apparatus of FIG. 34.

Figure 36:
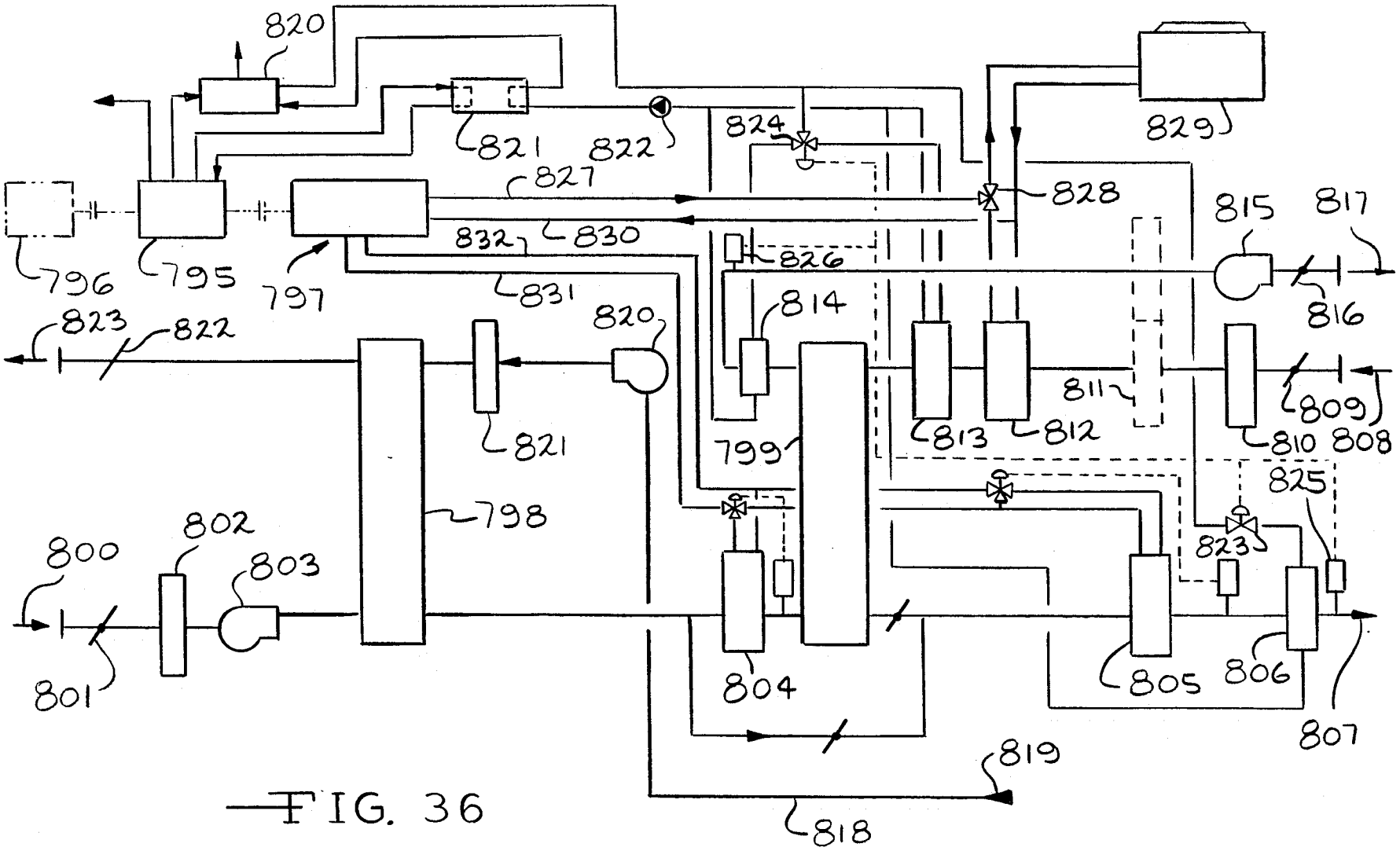
FIG. 36 is a schematic diagram showing apparatus which includes two ice makers connected in parallel, a glycol chiller to serve the ice makers on night cycle and to provide supplemental cooling on day cycle, and a gas absorption chiller to provide cooling on day cycle.

Apparatus comprising a gas engine 795 operably connected in driving relationship with an electric generator 796 and with the compressor of compression refrigeration apparatus indicated generally at 797, first and second desiccant dehumidifiers 798 and 799, various heat exchange devices, and incidental components is shown in FIG. 36. Air to be conditioned enters the apparatus as indicated by an arrow 800, flowing past a damper 801, through a filter 802, a blower 803, the first desiccant dehumidifier 798, a precooling coil 804, the second desiccant dehumidifier 799, a final cooling coil 805, and a heating coil 806 before being delivered to a space to be conditioned as indicated by an arrow 807.

The desiccant dehumidifiers 798 and 799 (FIG. 36) and the desiccant dehumidifiers 707 and 708 (FIG. 33) are identical in construction and operation.

Regenerating outside air enters the FIG. 36 apparatus as indicated by an arrow 808, flowing past a damper 809, through a filter 810, an air to air heat exchanger 811, a first reactivation heating coil 812, a second reactivation heating coil 813, the second desiccant dehumidifier 799, a dump coil 814, the air to air heat exchanger 811 and a blower 815, and then past a damper 816 before being vented from the apparatus as indicated by an arrow 817.

Return air from the building served by the apparatus of FIG. 36, which flows through a duct 818 as indicated by an arrow 819, flows through a blower 820, a filter 821 and the desiccant wheel 798 before flowing around a damper 822 and being vented as indicated by an arrow 823.

Gaseous exhaust from the gas engine 795 is directed through a heat exchanger-silencer 820 while cooling jacket water is circulated from the engine 795, through a heat exchanger 821 and back. A pump 822 circulates a heat transfer fluid from the heat exchanger 821, through the heat exchanger-silencer 820, in parallel, through the heating coil 806, through the second reactivation heating coil 813 and through the dump coil 814, and back to the pump 822. The flow of the heat transfer fluid through the heating coil 806, through the second reactivation heating coil 813 and through the dump coil 814 is controlled by valves 823 and 824, which are set by thermostat-controllers 825 and 826. The heating coil 806 is used when it is necessary to introduce heat into the space served by the apparatus, for example, on winter cycle.

The compression refrigeration apparatus 797 has a compressor (not separately illustrated) which is driven by the gas engine 795; this compresses and heats the refrigerant and causes it to flow through a line 827 to a three way valve 828 which directs it either to an air cooled condensing unit 829 or to the first reactivation heating coil 812. Heat is transferred from the refrigerant in the condensing unit 829 or in the heating coil 812, being rejected from the apparatus in the former case, and being transferred to regenerating air in the latter. The first and second reactivation coils 812 and 813 are operated to maintain the air leaving the coil 813 at a required temperature, and any excess heat is rejected in the condensing unit 829, in the dump coil 814, or in both. Cooled refrigerant from the first reactivation heating coil 812 is returned to the apparatus 797, flowing through a line 830.

Cooled refrigerant flows through a line 831 from the apparatus 797 to the precooling coil 804 and to the final cooling coil 805, being expanded in each to maintain a predetermined air temperature at the exit side thereof. Finally, expanded refrigerant returns through a line 832 to the suction side of the compressor of the apparatus 797.

Which apparatus is optimum for any given installation depends upon such factors as the local climate, including both temperatures and humidities and the local rate structures for electricity, gas and fuel oil, including not only cost per unit of energy, but also demand charges and incentives. In general, it is necessary to provide conditioned air at a sufficiently low humidity that only a small quantity thereof is required for humidity control, to deliver only a small quantity of the low humidity conditioned air, and to circulate a heat transfer fluid, preferably, in most cases, through at least a part of a sprinkler system, for on site use, i.e., in or adjacent a space being conditioned, rather than in an equipment room, to remove sensible heat. It is usually important to vary the rate at which the low humidity air is delivered so that humidity control is achieved, but over dehumidification is avoided. The low humidity conditioned air can be made by chemical dehumidification, using ice that was produced on night cycle, or using a low temperature coil from which heat is transferred directly to the refrigerant of a refrigeration unit. Similarly, the heat can be removed from water that is circulated to carry the sensible heat load by absorption refrigeration apparatus, by compression refrigeration, or with ice. When cogeneration is used, it is important to waste neither the shaft work nor the heat; the heat can be used on winter cycle for heating and on summer cycle either to regenerate a desiccant or as an energy source for absorption refrigeration apparatus, while the shaft work can be used, summer and winter, either to generate electricity or to drive compressors, pumps, blowers and the like.

Most of the apparatus that is shown in the attached drawings transfers heat to evaporatively cooled water. This is advantageous over transferring heat to water that has been chilled by refrigeration, because there are substantial savings in energy. However, ground water, for example from wells, when it is available, may also be at least equally advantageous, particularly in climates where high humidity limits the use of evaporative cooling. When used, ground water should usually be circulated through a heat exchanger and returned to the ground. A suitably treated heat transfer fluid can then be chilled by heat exchange with the ground water and used in place of the evaporatively cooled water that has been described above.

It is important that air conditioning apparatus introduce sufficient fresh or ventilation air into a building to prevent the accumulation of excessive concentrations of such inert gases as radon. Apparatus for determining the concentrations of such inert gases and for controlling ventilation air to keep their concentrations within safe limits is not presently available; occupants are not capable of detecting dangerously high concentrations of these gases. As a consequence, there is presently no mechanism for monitoring a variable to determine whether or not ventilation is adequate in a building. The apparatus of the instant invention makes the occupants of a building sensors to detect the inadequacy of ventilation; this occurs because the primary, conditioned air is relied upon to control humidity, and is circulated at a rate which is at least adequate for ventilation and at a sufficiently low moisture content that it also provides humidity control. If the apparatus is properly designed, and if it provides humidity control, it also provides adequate ventilation; if the apparatus fails to provide humidity control, ventilation may be inadequate, but the problem will be solved to quiet the complaints of the occupants.

It will be appreciated that various changes and modifications can be made from the specific details of the invention as shown in the attached drawings and described with reference thereto without departing from the spirit and scope thereof as defined in the appended claims.

For example, lithium chloride solutions have been described as aqueous desiccants, but other solutions are also operable, including other lithium halides, calcium chloride, and even glycol solutions. In one aspect, the invention involves the use of air conditioning apparatus to perform one function on day cycle and a different function on night cycle, one function during winter operation and a different function during summer operation, and minimizing the size of equipment required by storing what is made during one mode of operation for use at a different time in a different mode of operation. For example, on summer operation, ice is produced on night cycle is used on day cycle to minimize energy requirements and to enable a given air conditioning job to be performed with smaller equipment than would otherwise be required. Similarly, on winter-night cycle, heat is stored and ice is made; both are used on day cycle.

The various cogenerators to which reference is made herein can be diesel engines, Otto cycle, or gas turbine (Brayton cycle) engines. A Stirling engine can also be used, with its shaft coupled directly to an electric generator or to a second Stirling engine, which then acts as a heat pump.

The apparatus of FIG. 30, for example, comprises an air handler 659 which includes a desiccant wheel 662 through which outside air flows into the air handler, and through which building relief air flows from the apparatus. The wheel 662 rotates, so that the segment thereof that is regenerated at one time by the flow therethrough of relief air is presented to incoming air at a different time, thereby enabling constant, limited dehumidification of the incoming air. The air handler 659 can also be used in the apparatus of other figures hereof, in lieu of the air handlers specifically disclosed therein.

The apparatus of several figures hereof, e.g., FIGS. 33–36, includes a first chemical dehumidifier that functions as an enthalpy wheel because low enthalpy building air flows therethrough for regeneration. Similarly, the same figures disclose apparatus wherein heat for regeneration of a second dehumidifier is supplied by a gas fired heater, by a coil through which a hot refrigerant is circulated, or by a coil through which heat from a combustion engine is circulated. Heat for regeneration of the first chemical dehumidifier can also be supplied by a gas fired heater, by a coil through which a hot refrigerant is circulated, or by a coil through which heat from a combustion engine is circulated. In a like manner, heat from a hot refrigerant can be transferred to a heat transfer fluid and then from the heat transfer fluid to regenerating air.

A blower 833 (FIG. 28) in the air handler 630 operates to maintain a constant pressure in the duct 653 so that air will be available for all of the induction mixing units 636, notwihstanding variations in the total rate at which conditioned air is used in the apparatus. Other equivalent blowers operate in the same way.

I claim:

1. Air conditioning apparatus comprising a plurality of air outlets each of which is operable to deliver air circulated thereto to a space to be conditioned, means for dehumidifying air, means for circulating dehumidified air to said air outlets at a rate per unit of area in the spaces served by said air outlets which varies between a predetermined minimum rate greater than zero and a maximum rate, the maximum rate being substantially less than that which would be required to maintain the design temperature in each of the spaces at the maximum design cooling load with air supplied to the spaces at a dry bulb temperature of 55° F., means operable to control its moisture content and temperature so that the dehumidified air is incapable, at the rate at which it is required for humidity control, of maintaining the desired space temperature at the maximum design cooling load, a plurality of means positioned for heat transfer to or from spaces to be conditioned by the apparatus or to or from air delivered to spaces to be conditioned by the apparatus, and means operable to control the rate at which dehumidified air is delivered by said air outlets to the spaces they serve to one not less than the predetermined minimum rate and higher than that minimum when required to maintain a monitored condition of the space within control limits.

2. Air conditioning apparatus as claimed in claim 1 wherein at least some of said air outlets are induction mixing units which additionally include means operable to cause a flow of recirculated air from the space, and, when dehumidified air is delivered thereto, to deliver to the space they serve a mixture of dehumidified air and recirculated air.

3. Apparatus as claimed in claim 1 wherein each of said a plurality of means positioned for heat transfer to or from spaces to be conditioned by the apparatus or to or from air delivered to spaces to be conditioned by the apparatus, is a panel positioned for heat transfer to or from the spaces.

4. Apparatus as claimed in claim 1 wherein each of said air outlets is an induction mixing unit operable to induce air to flow from the space it serves and to return to the space a mixture of induced air and conditioned air, and each of said plurality of means positioned for heat transfer to or from spaces to be conditioned by the apparatus or to or from air delivered to spaces to be conditioned by the apparatus, is a coil positioned for heat transfer with dehumidified air delivered to one of said induction mixing units, air one of said induction mixing units induces to flow from the space it serves or a mixture of dehumidified air with such induced air.

* * * * *